US012016440B2

(12) United States Patent
Holland

(10) Patent No.: US 12,016,440 B2
(45) Date of Patent: Jun. 25, 2024

(54) USER CONFIGURABLE MODULAR STORAGE APPARATUS

(71) Applicant: Leslie Hill Holland, Arlington, VA (US)

(72) Inventor: Leslie Hill Holland, Arlington, VA (US)

( * ) Notice: Subject to any disclaimer, the term of this patent is extended or adjusted under 35 U.S.C. 154(b) by 94 days.

(21) Appl. No.: 17/840,763

(22) Filed: Jun. 15, 2022

(65) Prior Publication Data

US 2023/0404228 A1 Dec. 21, 2023

(51) Int. Cl.

| | |
|---|---|
| ***A45C 11/16*** | (2006.01) |
| ***A47B 46/00*** | (2006.01) |
| ***A47B 47/00*** | (2006.01) |
| ***A47B 57/10*** | (2006.01) |
| ***A47B 67/00*** | (2006.01) |
| ***A47B 67/02*** | (2006.01) |
| ***A47B 81/00*** | (2006.01) |
| ***A47B 88/417*** | (2017.01) |
| ***A47F 7/02*** | (2006.01) |

(52) U.S. Cl.

CPC ..... *A45C 11/16* (2013.01); *A47B 47/00* (2013.01); *A47B 47/0091* (2013.01); *A47B 57/10* (2013.01); *A47B 67/00* (2013.01); *A47B 67/02* (2013.01); *A47B 81/00* (2013.01); *A47B 88/417* (2017.01); *A47F 7/02* (2013.01); *A47B 46/00* (2013.01)

(58) Field of Classification Search

CPC ..... A45C 11/16; A47B 47/00; A47B 47/0091; A47B 81/00; A47B 81/007; A47B 46/00; A47B 67/00; A47B 67/005; A47B 67/02; A47B 57/10; A47B 57/34; A47B 57/20; A47B 57/22; A47B 57/48; A47B 57/482; A47B 57/485; A47B 57/50; A47B 88/417; A47B 88/0451; A47B 53/00; A47F 3/004; A47F 7/02

See application file for complete search history.

(56) References Cited

U.S. PATENT DOCUMENTS

| | | | | |
|---|---|---|---|---|
| 258,720 A | | 5/1882 | Dickson | |
| 622,195 A | * | 4/1899 | Allison | A47B 53/00 312/351 |
| 740,001 A | * | 9/1903 | Flanagin | A47K 10/38 206/748 |
| 2,872,144 A | * | 2/1959 | Hobson | A47B 57/32 248/225.11 |

(Continued)

FOREIGN PATENT DOCUMENTS

| | | | | |
|---|---|---|---|---|
| DE | 3329069 A1 | * | 2/1985 | A47B 57/10 |
| DE | 4223868 A1 | * | 1/1994 | A47B 57/10 |
| FR | 2861967 A1 | * | 5/2005 | A47B 57/34 |

*Primary Examiner* — Andrew Roersma

(74) *Attorney, Agent, or Firm* — Robert L Protheroe

(57) ABSTRACT

Various implementations and configurations of a user configurable modular storage apparatus are disclosed. In an example implementation, a storage apparatus comprises: a side wall and a back wall which form an interior portion of a cabinet and an opening through which the interior portion is accessible; and a pair of slotted walls comprising pairs of slots configured to receive a storage module comprising a left mounting rod and a right mounting rod, wherein the storage module is insertable into the interior portion through the opening thereby enabling a user mounting and unmounting of the storage module to a pair of slots of the pair of slotted walls.

31 Claims, 20 Drawing Sheets

(56) References Cited

U.S. PATENT DOCUMENTS

| | | | | | |
|---|---|---|---|---|---|
| 2,995,257 | A * | 8/1961 | D Anka | A47B 31/00 | 211/208 |
| 3,347,187 | A * | 10/1967 | Khoury | A47B 57/10 | 108/147.11 |
| 3,813,138 | A * | 5/1974 | Doohan | A47B 46/00 | 312/309 |
| 4,086,858 | A * | 5/1978 | Howitt | A47B 57/34 | 211/187 |
| 4,444,323 | A * | 4/1984 | Travis | A47B 57/52 | 211/208 |
| 4,776,650 | A * | 10/1988 | Ferenzi | A47B 67/02 | 211/85.2 |
| 5,511,873 | A * | 4/1996 | Mech | A45C 11/16 | 312/351 |
| 7,147,291 | B1 * | 12/2006 | Greiner | A47B 67/00 | 312/294 |
| 7,651,178 | B2 | 1/2010 | Greiner | | |
| 9,192,231 | B1 * | 11/2015 | Steffen | A47B 81/005 | |
| 9,386,847 | B1 * | 7/2016 | Jeffries | A47B 88/417 | |
| 9,516,957 | B2 | 12/2016 | Riegle | | |
| 9,723,904 | B1 * | 8/2017 | Taylor | A47B 96/20 | |
| 10,477,991 | B1 | 11/2019 | Fragala | | |
| 10,653,221 | B2 | 5/2020 | Larsh | | |
| 2005/0087505 | A1 | 4/2005 | Lukas | | |
| 2005/0093405 | A1 * | 5/2005 | Greiner | A47B 67/02 | 312/321.5 |
| 2006/0180481 | A1 | 8/2006 | McGaughey | | |
| 2007/0164643 | A1 * | 7/2007 | Greiner | A45C 11/16 | 312/227 |
| 2008/0129171 | A1 * | 6/2008 | Greiner | A47F 7/02 | 312/348.3 |
| 2010/0102689 | A1 | 4/2010 | Chambers | | |
| 2014/0263116 | A1 | 9/2014 | Wojciechowski | | |
| 2019/0008274 | A1 * | 1/2019 | Wolf | E05B 47/06 | |

* cited by examiner

USER CONFIGURABLE MODULAR STORAGE APPARATUS

CROSS-REFERENCE TO RELATED APPLICATIONS

Not Applicable

FIELD OF THE DISCLOSURE

The present disclosure relates to the field of storage apparatus for storing items and more particularly relates to a user configurable modular storage apparatus, wherein in some implementations, a storage apparatus may facilitate both storage and display of items.

SUMMARY

Various implementations of a user configurable modular storage apparatus are disclosed herein. A storage apparatus of the present disclosure may comprise slotted walls configured to receive a storage module. In some implementations, slotted walls may be configured in pairs, wherein a pair of slotted walls may receive a storage module. In some implementations, a pair of slotted walls may be configured to receive a plurality of storage modules. In some implementations, a storage apparatus may facilitate both storage and display of items. A storage apparatus of the present disclosure may be configured to store various types of items, such as arts and crafts supplies, fishing tackle, jewelry and the like. Example implementations which may be directed towards storage of items of jewelry are disclosed, however a disclosure of a particular type of item, such a jewelry, is not intended to be restrictive or limiting, but is intended to be illustrative of the novel user configurable modular storage apparatus of the present disclosure from which those skilled in the art shall appreciate various novel approaches and features developed by the inventor. As such, those having skill in the art and having the benefit of the present disclosure will appreciate utility of the present disclosure in applications other than storage of items of jewelry.

In some aspects, the techniques described herein relate to a storage apparatus, including: a cabinet including a side wall and a back wall, wherein the side wall and the back wall form an interior portion of the cabinet, and the side wall forms an opening through which the interior portion is accessible; a storage module including a left mounting rod and a right mounting rod, wherein the storage module is insertable into the interior portion through the opening; and a pair of slotted walls including a left slotted wall and a right slotted wall, wherein: both slotted walls are vertically oriented and include a slotted wall face having a plurality of slots, wherein each slot of the plurality of slots extends from a location at or near a front of its respective slotted wall and towards a back of its respective slotted wall, and each slot has at least one slot above it on its respective slotted wall face or at least one slot below it on its respective slotted wall face; both slotted wall faces of the pair of slotted walls are directed towards each other within the interior portion; a slot of the left slotted wall and a slot of the right slotted wall are directed towards each other and form a pair of slots including a left slot and a right slot; and the left slot is configured to receive the left mounting rod and the right slot is configured to receive the right mounting rod, thereby enabling a user mounting and unmounting of the storage module to the pair of slots of the pair of slotted walls.

In some aspects, the techniques described herein relate to a storage apparatus, wherein the storage module is a jewelry bar.

In some aspects, the techniques described herein relate to a storage apparatus, wherein: the storage module is a first storage module, wherein the left mounting rod is a first left mounting rod and the right mounting rod is a first right mounting rod; the left slot is a first left slot; the right slot is a first right slot; and the pair of slots is a first pair of slots, the storage apparatus further including: a second storage module including a second left mounting rod and a second right mounting rod, wherein the second storage module is insertable into the interior portion through the opening; a second left slot of the left slotted wall; a second right slot of the right slotted wall, wherein the second left slot and the second right slot are directed towards each other and form a second pair of slots; and the second left slot is configured to receive the second left mounting rod and the second right slot is configured to receive the second right mounting rod, thereby enabling a user mounting and unmounting of the second storage module to the pair of slotted walls.

In some aspects, the techniques described herein relate to a storage apparatus, wherein: the left mounting rod is a left rear mounting rod; the right mounting rod is a right rear mounting rod; the storage module further includes a left forward mounting rod and a right forward mounting rod, wherein the left forward mounting rod and the right forward mounting rod are configured at locations on the storage module that are forward to the locations of the left rear mounting rod and the left rear mounting rod on the storage module; and the left slot is further configured to receive the left forward mounting rod and the right slot is further configured to receive the right forward mounting rod, thereby enabling a user mounting and unmounting of the storage module to the pair of slots of the pair of slotted walls, wherein, when mounted, each slot of the pair of slots engages a forward mounting rod and a rear mounting rod of the storage module, and a rotation of the storage module about an axis normal to both slotted wall faces is limited.

In some aspects, the techniques described herein relate to a storage apparatus, wherein the storage module is a drawer assembly.

In some aspects, the techniques described herein relate to a storage apparatus, wherein: the left mounting rod is a left upper mounting rod; the right mounting rod is a right upper mounting rod; the storage module further includes a left lower mounting rod and a right lower mounting rod, wherein the left lower mounting rod and the right lower mounting rod are configured at locations on the storage module that are below the locations of the left upper mounting rod and the right upper mounting rod on the storage module; the left slot is a left upper slot; the right slot is a right upper slot; and the pair of slots is an upper pair of slots, wherein the pair of slotted walls further includes: a left lower slot of the left slotted wall; a right lower slot of the right slotted wall, wherein the left lower slot and the right lower slot are directed towards each other and form a lower pair of slots; and the left lower slot is configured to receive the left lower mounting rod and the right lower slot is configured to receive the right lower mounting rod, thereby enabling a user mounting and unmounting of the storage module to the upper pair of slots and the lower pair of slots of the pair of slotted walls, wherein, when mounted, each slot of the upper pair of slots and each slot of the lower pair of slots engage a mounting rod of the storage module, and a rotation of the storage module about an axis normal to both slotted wall faces is limited.

In some aspects, the techniques described herein relate to a storage apparatus, wherein the storage module is a ring holder.

In some aspects, the techniques described herein relate to a storage apparatus, further including: two panel hinge mount components disposed on a vertical portion of the side wall proximate to the opening; and a panel including two panel hinge components, wherein the two panel hinge mount components are configured to receive the two panel hinge components, thereby enabling a user mounting and unmounting of the panel to the storage apparatus.

In some aspects, the techniques described herein relate to a storage apparatus, wherein the panel includes foam configured to receive items pinned thereto.

In some aspects, the techniques described herein relate to a storage apparatus, wherein the panel includes a plurality of pendant hangers configured to receive pendants attached thereto.

In some aspects, the techniques described herein relate to a storage apparatus, wherein the panel includes a mirror.

In some aspects, the techniques described herein relate to a storage apparatus, wherein the panel further includes a plurality of holes configured to receive an attachment of an earring.

In some aspects, the techniques described herein relate to a storage apparatus, wherein the panel includes a plurality of eyeglasses holders configured to receive eyeglasses or sunglasses.

In some aspects, the techniques described herein relate to a storage apparatus, wherein the panel further includes a bezel having a first bezel component and a second bezel component configured to be mated together, wherein: the first bezel component and the second bezel component are substantially similar or identical; the first bezel component includes a first mating side including first mating features of the first bezel component and second mating features of the first bezel component; and the second bezel component includes a second mating side including first mating features of the second bezel component and second mating features of the second bezel component, wherein when the first mating side and second mating side are directed towards each other, and the first bezel component and the second bezel component are rotated 180 degrees respective to each other, the first mating features of the first bezel component align with the second mating features of the second bezel component, and the first mating features of the second bezel component align with the second mating features of the first bezel component, thereby enabling a mating of the first bezel component to the second bezel component.

In some aspects, the techniques described herein relate to a storage apparatus, wherein the panel includes a bezel having a first bezel component and a second bezel component configured to be mated together, wherein: the first bezel component and the second bezel component are substantially similar or identical; the first bezel component includes a first mating side and a first panel hinge component; and the second bezel component includes a second mating side and a second panel hinge component, wherein when the first mating side and second mating side are directed towards each other, and the first bezel component and the second bezel component are rotated 180 degrees respective to each other and mated together, the two panel hinge components receivable by the two panel hinge mount components include the first panel hinge component and the second panel hinge component.

In some aspects, the techniques described herein relate to a storage apparatus, wherein: the left slot includes a left pocket configured to receive the left mounting rod, the left pocket having a left front surface; and the right slot includes a right pocket configured to receive the right mounting rod, the right pocket having a right front surface, wherein when the left mounting rod is received in the left pocket and the right mounting rod is received in the right pocket, the left front surface and the right front surface prevent an unmounting of the storage module when a horizontal outward force is applied to the storage module, unless the horizontal outward force is accompanied by a vertical upward force sufficient to lift the storage module and the left mounting rod and the right mounting rod from the left pocket and the right pocket, respectively.

In some aspects, the techniques described herein relate to a storage apparatus, wherein the left slotted wall is included by a left vertical portion of the side wall and the plurality of slots of the slotted wall face of the left slotted wall are formed by slots recessed into the side wall.

In some aspects, the techniques described herein relate to a storage apparatus, including: a first base unit including: a first cabinet including a first side wall and a first back wall, wherein the first side wall and the first back wall form a first interior portion of the first cabinet, and the first side wall forms a first opening through which the first interior portion is accessible; a first storage module including a first left mounting rod and a first right mounting rod, wherein the first storage module is insertable into the first interior portion through the first opening; and a first pair of slotted walls including a first left slotted wall and a first right slotted wall, wherein: both the first left slotted wall and first right slotted wall are vertically oriented and include a slotted wall face having a plurality of slots, wherein each slot of the plurality of slots extends from a location at or near a front of its respective slotted wall and towards a back of its respective slotted wall, and each slot has at least one slot above it on its respective slotted wall face or at least one slot below it on its respective slotted wall face; both slotted wall faces of the first pair of slotted walls are directed towards each other within the first interior portion; a first slot of the first left slotted wall and a first slot of the first right slotted wall are directed towards each other and form a first pair of slots including a first left slot and a first right slot; and the first left slot is configured to receive the first left mounting rod and the first right slot is configured to receive the first right mounting rod, thereby enabling a user mounting and unmounting of the first storage module to the first pair of slots of the first pair of slotted walls; a second base unit including: a second cabinet including a second side wall and a second back wall, wherein the second side wall and the second back wall form a second interior portion of the second cabinet, and the second side wall forms a second opening through which the second interior portion is accessible; a second storage module including a second left mounting rod and a second right mounting rod, wherein the second storage module is insertable into the second interior portion through the second opening; and a second pair of slotted walls including a second left slotted wall and a second right slotted wall, wherein: both the second left slotted wall and the second right slotted wall are vertically oriented and include a slotted wall face having a plurality of slots, wherein both the second left slotted wall and second right slotted wall are vertically oriented and include a slotted wall face having a plurality of slots, wherein each slot of the plurality of slots extends from a location at or near the front of its respective slotted wall and towards the back of its respective slotted wall, and each slot has at least one slot above it on its respective slotted wall face or at least one slot below it on its respective slotted wall face; both slotted wall faces of the second pair of slotted walls are directed towards each other within the second interior portion; a second slot of the second left slotted wall and a second slot of the second right slotted wall are directed towards each other and form a second pair of slots including a second left slot and a second right slot; and the second left slot is configured to receive the second left mounting rod and the second right slot is configured to receive the second right mounting rod, thereby enabling a user mounting and unmounting of the second storage module to the second pair of slots of the second pair of slotted walls.

In some aspects, the techniques described herein relate to a storage apparatus, wherein at least one of the first storage module or the second storage module is a jewelry bar.

In some aspects, the techniques described herein relate to a storage apparatus, wherein: the first left mounting rod is a left rear mounting rod; the first right mounting rod is a right rear mounting rod; the first storage module further includes a left forward mounting rod and a right forward mounting rod, wherein the left forward mounting rod and the right forward mounting rod are configured at locations on the first storage module that are forward to the locations of the left rear mounting rod and the left rear mounting rod on the first storage module; and the first left slot is further configured to receive the left forward mounting rod and the first right slot is further configured to receive the right forward mounting rod, thereby enabling a user mounting and unmounting of the first storage module to the first pair of slots of the first pair of slotted walls, wherein, when mounted, each slot of the first pair of slots engages a forward mounting rod and a rear mounting rod of the first storage module, and a rotation of the first storage module about an axis normal to both slotted wall faces of the first pair of slotted walls is limited.

In some aspects, the techniques described herein relate to a storage apparatus, wherein the first storage module is a drawer assembly.

In some aspects, the techniques described herein relate to a storage apparatus, wherein: the first left mounting rod is a left upper mounting rod; the first right mounting rod is a right upper mounting rod; the first storage module further includes a left lower mounting rod and a right lower mounting rod, wherein the left lower mounting rod and the right lower mounting rod are configured at locations on the first storage module that are below the locations of the left upper mounting rod and the right upper mounting rod on the first storage module; the first left slot of the first left slotted wall is a left upper slot; the first right slot of the first right slotted wall is a right upper slot; and the first pair of slots is an upper pair of slots, wherein the first pair of slotted walls further includes: a left lower slot of the first left slotted wall; a right lower slot of first right slotted wall, wherein the left lower slot and the right lower slot are directed towards each other and form a lower pair of slots, wherein the lower pair of slots is configured at a location on the first pair of slotted walls below a location of the upper pair of slots on the first pair of slotted walls; and the left lower slot is configured to receive the left lower mounting rod and the right lower slot is configured to receive the right lower mounting rod, thereby enabling a user mounting and unmounting of the first storage module to the upper pair of slots and the lower pair of slots of the first pair of slotted walls, wherein, when mounted, each slot of the upper pair of slots and each slot of the lower pair of slots engage a mounting rod of the first storage module, and a rotation of the first storage module about an axis normal to both slotted wall faces of the first pair or slotted walls is limited.

In some aspects, the techniques described herein relate to a storage apparatus, wherein the first storage module is a ring holder.

In some aspects, the techniques described herein relate to a storage apparatus, wherein the storage apparatus is a storage feature mounted in furniture, and access to the storage apparatus is dependent on a state of a lock included by the furniture.

In some aspects, the techniques described herein relate to a storage apparatus, wherein the first left slotted wall is included by a left vertical portion of the first side wall and the plurality of slots of the slotted wall face of the first left slotted wall are formed by slots recessed into the first side wall.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of the disclosed subject matter.

DETAILED DESCRIPTION

Various detailed example implementations of a user configurable modular storage apparatus of the present disclosure are disclosed herein; however, it is to be understood that the disclosed implementations are merely illustrative and storage apparatus of the present disclosure may be embodied in various forms. In addition, each of the examples given in connection with the various implementations is intended to be illustrative, and not restrictive.

The following detailed example implementations refer to the accompanying drawings. The same reference number may appear in multiple drawings and when appearing in multiple drawings will identify the same or similar elements.

Figure 1A:
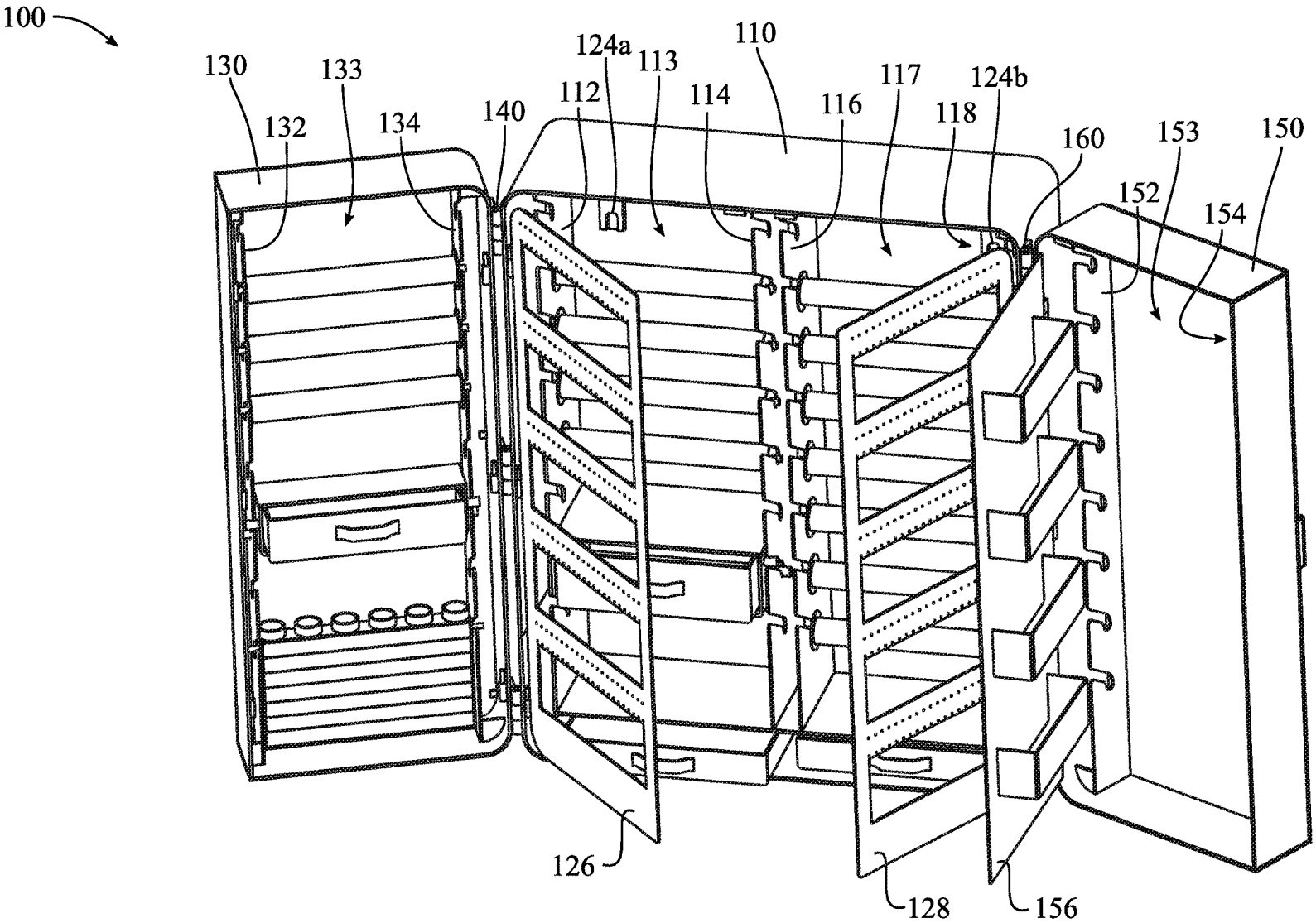
FIG. 1A depicts a perspective front view of an example implementation of a user configurable modular storage apparatus (which may also be referred to as a storage and display apparatus) of the present disclosure.

FIG. 1A depicts a perspective front view of an example implementation of a user configurable modular storage apparatus 100 of the present disclosure (which may also be referred to as a storage and display apparatus), wherein storage apparatus 100 is shown in an open configuration such that an example configuration of user configurable modular storage modules is visible. In the example implementation of FIG. 1A, storage apparatus 100 may be useable for storing jewelry, such as rings, earrings, necklaces, pendants, etc., and items such as eyeglasses, sunglasses, watches, hair bands, hair clips and the like.

In some implementations, storage apparatus 100 may comprise a main cabinet 110, a left door 130 and a right door 150. In some implementations, left door 130 and right door 150 may be hinged to main cabinet 110 along vertical lines at hinge 140 proximate to the left side of main cabinet 110 and at hinge 160 proximate to the right side of main cabinet 110, respectively, and open from a location between the left and right sides of main cabinet 110. In some implementations, a single door configuration (not shown) of apparatus 100 may be hinged to main cabinet 110 at a location proximate to the left side or the right side of main cabinet 110, wherein a left hinged door may be hinged along a vertical line at hinge 140 and a right hinged door may be hinged along a vertical line at hinge 160. In some implementations, storage apparatus 100 may be configured with a single door, e.g. a right door or left door as discussed, or with two doors such as the example shown in FIG. 1A, or more than two doors (not shown). In some implementations (not shown), one or more doors may be hinged to main cabinet 110 along vertical lines at a location between the between the left side and right side of main cabinet 110 and may open from a location at the left side or right side, or between the left and right side of main cabinet 110. In some implementations not shown, one or more doors of storage apparatus may be hinged to main cabinet 110 along horizontal lines, wherein in some implementations, such doors may serve as trays or shelves when in an open position. In some implementations not shown, one or more doors may be hinged to main cabinet 110 along horizontal lines, and one or more doors may be hinged to main cabinet 110 along vertical lines. For example, a door may be hinged along a horizontal line proximate to the bottom of main cabinet 110 and when open may serve as a shelf/tray extending from the bottom of main cabinet 110, and when closed cover a lower portion of main cabinet 110; and a left door and right door may be hinged to main cabinet 110 along a vertical line at hinge 140 and along a vertical line at hinge 160, respectively, and collectively cover an upper portion of main cabinet 110 when closed.

In the example implementation depicted in FIG. 1A, storage apparatus 100 comprises a plurality of pairs of slotted walls, wherein each pair may be configured to receive one or more of one or more types of storage modules. In the example implementation of FIG. 1A, main cabinet 110 comprises a left pair of slotted walls 112 and 114 and a right pair of slotted walls 116 and 118; left door 130 comprises a pair of slotted walls 132 and 134; and, right door 150 comprises a pair of slotted walls 152 and 154, wherein slotted walls 118 and 154 are not visible but their general locations are indicated with arrows. As will be discussed in more detail later herein, a slotted wall pair may receive (i.e., have installed or mounted therein) storage modules of one or more various types, which, when received, are situated in a storage area between the pair of slotted walls. Types of storage modules and the locations they are mounted may be chosen and mounted by a user. As such, storage apparatus 100 may be referred to as a user configurable modular storage apparatus. A storage area may be defined as an area between a pair of slotted walls, such as storage area 113, which is between slotted walls 112 and 114; storage area 117, which is between slotted walls 116 and 118; storage area 133, which is between slotted walls 132 and 134; and storage area 153, which is between slotted walls 152 and 154. The example implementation of FIG. 1A is shown having various types of storage modules configured in storage areas 113, 117 and 133. Storage area 153 is depicted in the example implementation of FIG. 1A as having no storage modules configured therein.

Storage apparatus 100 is depicted having a left earring panel 126, a right earring panel 128 and an eyeglasses panel 156. In some implementations, a variety of panel types may be configured to vary storage (and display) features. For example, earring panels 126 and 128 (as will be discussed in more detail later herein) allow for storage of a plurality of earrings (and/or piercings) which may be attached thereto by securing earring (or piercing) posts and hoops to holes therein. In some implementations, earring panels 126 and 128 may comprise openings that allow dangling styled earrings to hang freely. Such opening may also enable a user to potentially see what is stored behind panels 126 and 128 when in closed positions. Such openings may additionally provide locations around their periphery to clip clip-on earrings. As another example of storage (and display) features of a panel type, eyeglasses panel 156 provides storage for a plurality of eyeglasses, such as eyeglasses, reading eyeglasses or sunglasses, however, when panel 156 is closed, items stored therein are not visible to a user. In some implementations, the outwardly facing side of eyeglasses panel 156, when closed, may comprise a mirror.

In some implementations, storage apparatus 100 may comprise mounting holes 124*a* and 124*b* as shown in FIG. 1A, and thereby may be mountable to a vertical surface. In some implementations, storage apparatus 100 may be configured to be situated on a horizontal surface and may comprise feet (not shown in FIG. 1A) generally located in the corner regions of the base of main cabinet 110. Such feet may comprise a height adjustment, such as a screw adjustment to aid in leveling storage apparatus 100 when placed on a generally horizontal surface. In some implementations, storage apparatus may comprise both feet and mounting holes 124*a* and 124*b*, such that a user has multiple options and methods for locating and positioning storage apparatus 100.

In some implementations, storage apparatus may be constructed of cut and formed sheet metal or stamped, drawn or extruded metal, wherein seams and attachment points may be secured using one or more methods such as welds, rivets, screws, nuts and bolts, snaps, clips and the like. In some implementations, storage apparatus may be constructed of cut and shaped wood, composite wood, plywood, and the like, wherein joints and attachment points may be secured using one or more methods such as butt joints, rabbet joints, miter joints, lap joints, dado joints, spline joints, mortise and tenon joints, tongue and groove joints, finger joints, dovetail joints and the like, wherein such joints may be secured using one or more of glue, nails, screws, dowels and the like. In some implementations, storage apparatus may be constructed of rigid plastic sheet, cut and shaped, or formed (such as thermoformed), or injection molded or the like, wherein seams and attachment points may be secured using one or more methods such as sonic welds, solvent welds, glue, rivets, screws, nuts and bolts, snaps, clips and the like. In some implementations, more than one of the aforementioned construction materials of metal, wood and plastic, may be used in combination.

In some implementations, various components of storage apparatus 100 may be coated, covered or otherwise finished using one or more of many possible methods, such as for example, metal components (such as aluminum, steel, galvanized steel, etc.) may be powder coated or painted or the like, or may be covered with a material such as a velvet flocking or the like; wooden components may be stained and/or finished, or painted or the like, or be covered with a material such as a velvet flocking or the like; plastic material may be painted or the like or be covered with a material such as a velvet flocking or the like. Components covered in velvet flocking (or other suitable material) may yield a soft and nonabrasive surface which may be desirable when storing jewelry or other types of items in storage apparatus 100. In some implementations, components may be employed without a secondary operation to apply a finish, such as for example, a stainless steel component having an inherently finished appearance, or a plastic component fashioned from a plastic material inherently having a desired color which may have a desired texture produced during a molding operation. In some implementations, components may have a variety of finishing (or unfinished) operations and materials applied, such as for example, a door (e.g. door 130) may have an unfinished stainless steel front and a velvet flocking lined interior (e.g. interior 133).

Figure 1B:
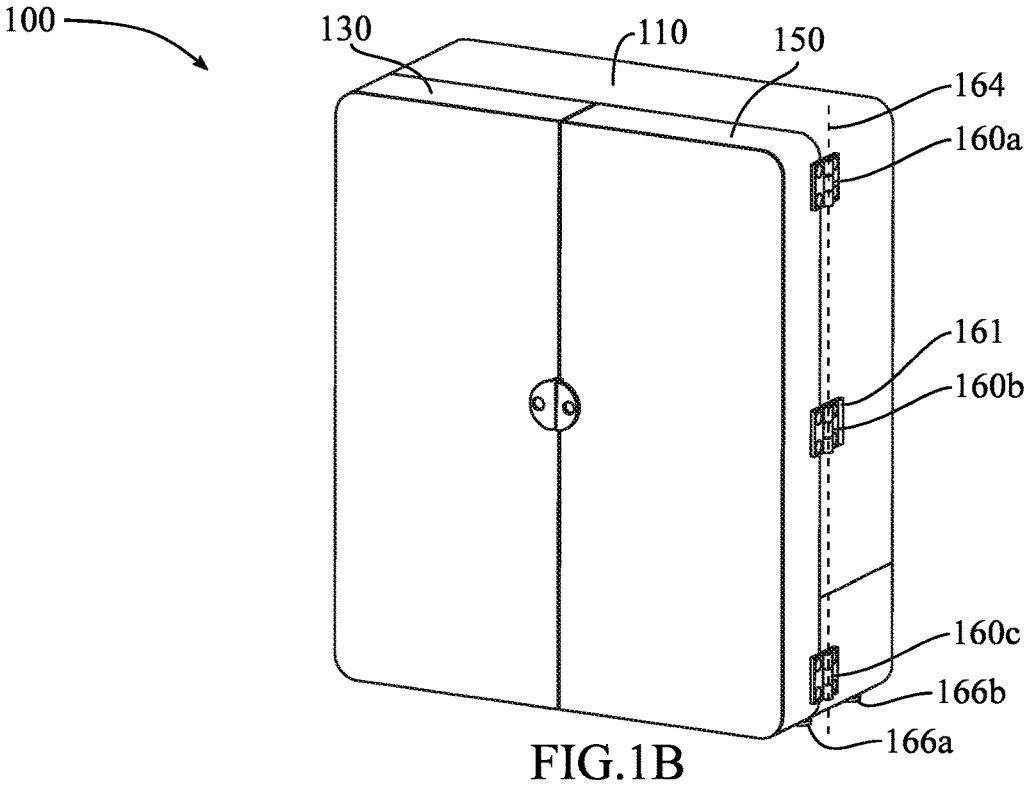
FIG. 1B depicts a perspective front view the storage apparatus of FIG. 1A, wherein a left door and a right door are in a closed orientation.

FIG. 1B depicts a perspective front view of storage apparatus 100, wherein left door 130 and right door 150 are closed upon main cabinet 110, and an upper right hinge 160*a*, middle right hinge 160*b* and lower right hinge 160*c* are visible and are aligned along a vertical line 164 (shown in a dashed line). In some implementations, a cabinet, door or hinge may be configured with a magnet to maintain an open state of a door, such as for example, middle right hinge 160*b* may be configured with or have proximate to it a magnet 161 such that when door 150 is opened, magnet 161 may apply sufficient magnetic force to a side wall of door 150 and maintain an open state until an opposing force is applied to overcome the magnetic force. As noted above, in some implementations, storage apparatus 100 may comprise feet. Visible in FIG. 1B are a right front foot 166*a* and right rear foot 166*b* comprised by storage apparatus 100 and usable when storage apparatus 100 is placed on a horizontal surface. Not visible in FIG. 1B are a left front foot and left rear foot. In some implementations, one or more feet of storage apparatus 100 may be adjustable in length and be usable to eliminate an unstable placement. In some implementations, feet of storage apparatus 100 may comprise a rubber pad, or other nonabrasive pad such as felt or the like, on the lower most portion of the foot. In some implementations, feet of storage apparatus 100 may be removable, which may enhance the appearance of storage apparatus 100 when mounted on a vertical surface.

Figure 1C:
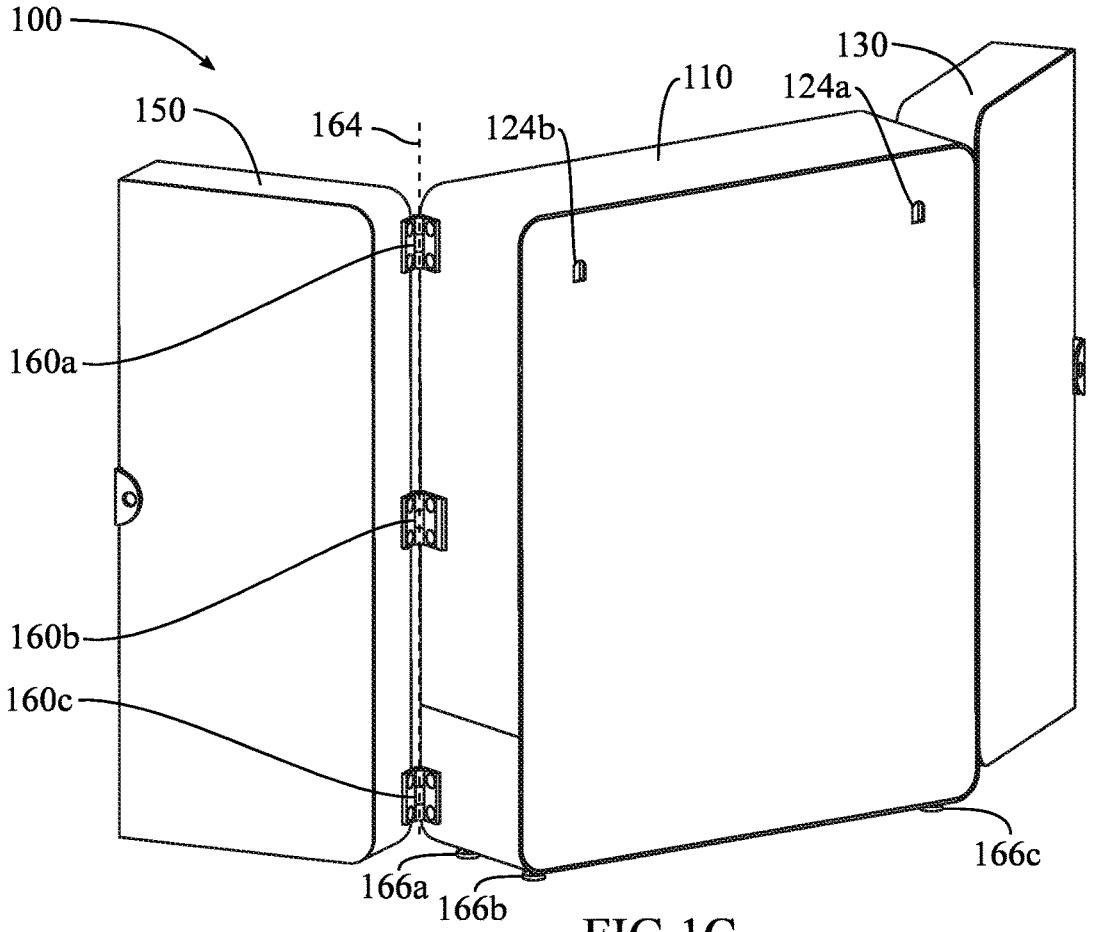
FIG. 1C depicts a perspective rear view of the storage apparatus of FIG. 1A.

FIG. 1C depicts a perspective rear view of storage apparatus 100, wherein left door 130 and right door 150 are opened away from main cabinet 110, and upper right hinge 160*a*, middle right hinge 160*b* and lower right hinge 160*c* are visible and are aligned along vertical line 164 (shown in a dashed line). Visible in FIG. 1C are right front foot 166*a*, right rear foot 166*b* and a left rear foot 166*c*; not visible is a left front foot. Also visible in the rear perspective view of FIG. 1C are mounting holes 124*a* and 124*b* disposed in a rear wall of main cabinet 110, through which mounting screws may pass and be screwed into a suitable vertical structure to which storage apparatus 100 may be mounted.

Figure 2A:
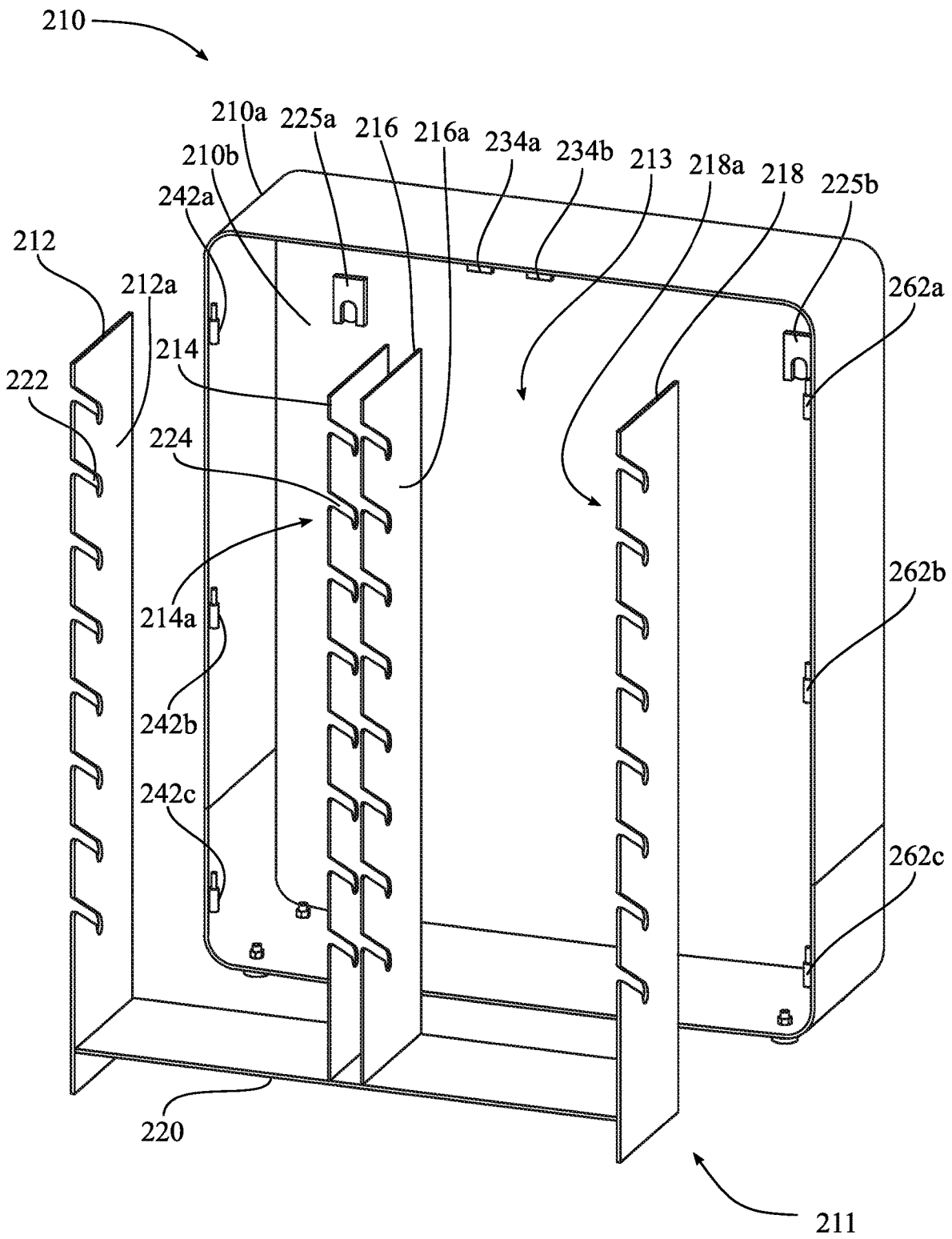
FIG. 2A depicts a perspective front view of an example implementation of a main cabinet, wherein, removed for illustration purposes, is a slotted wall assembly.

FIG. 2A depicts a perspective front view of an example implementation of main cabinet 210, wherein, removed for illustration purposes, is a slotted wall assembly 211 comprising slotted walls 212, 214, 216 and 218, and a bottom inner wall 220. In some implementations, main cabinet 210 may comprise a side wall 210*a* and a back wall 210*b*, wherein side wall 210*a* may form an opening in the front of main cabinet 210 and may be generally rectangular in shape as shown in FIG. 2A, and may have a top horizontal portion, bottom horizontal portion, left vertical portion and right vertical portion of side wall 210*a*. In some implementations (not shown), a side wall may be oval, circular, triangular or of some other shape. Back wall 210*b* may terminate along its periphery at side wall 210*a* and inner surfaces, i.e. wall surfaces within main cabinet 210, of side wall 210*a* and back wall 210*b* may define an interior 213 of main cabinet 210. Left panel hinge mount components 242*a*, 242*b* and 242*c*, and right panel hinge mount components 262*a*, 262*b* and 262*c* may be welded, or otherwise attached, to a left vertical portion or a right vertical portion, respectively, of side wall 210*a* of main cabinet 210 to provision for a mounting of panels thereto. In some implementations, at least three panel hinge mount components may be disposed on a vertical portion of side wall 210*a*. In some implementations, at least two panel hinge mount components may be disposed on a vertical portion of side wall 210*a*. Main cabinet 110 may comprise panel stops 234*a* and 234*b*, which may establish a stopping point for panels, such as panels 126 and 128 of FIG. 1A, respectively, when closed. Panel stops 234*a* and 234*b* may be constructed of or comprise magnetic material which may magnetically engage a panel to assist is maintaining a closed position until an opening force overcomes the magnetic force between a panel stop and associated panel. Also shown in FIG. 2A are mounting holes 225*a* and 225*b*.

In the example implementation of FIG. 2A, slotted walls 212 and 214 form a pair of slotted walls having a left slotted wall 212 and a right slotted wall 214, and slotted walls 216 and 218 form a pair of slotted walls having a left slotted wall 216 and a right slotted wall 218, wherein slotted walls 212, 214, 216 and 218 are vertically oriented and comprise slotted wall faces 212*a*, 214*a*, 216*a* and 218*a*, respectively, wherein each slotted wall face comprises a plurality of slots, such as slot 222 of slotted wall 212 and slot 224 of slotted wall 214, wherein each slot of the plurality of slots may extend from a location at or near a front of its respective slotted wall and towards a back of its respective slotted wall, and each slot may have at least one slot above it on its respective slotted wall face or at least one slot below it on its respective slotted wall face. Both slotted wall faces of a pair of slotted walls, such as slotted walls 212 and 214, are directed towards each other within the interior portion 213 (as will be seen in FIG. 2B), wherein a slot of a left slotted wall and a slot of a right slotted wall are directed towards each other and form a pair of slots comprising a left slot and a right slot, such as left slot 222 and right slot 224, of a pair of slotted walls comprising a left slotted wall and a right slotted wall, such as slotted walls 212 and 214, respectively, may receive a storage module as generally shown in FIG. 1A, and as will be described in more detail later herein. Both slotted walls of a pair of slotted walls may be substantially parallel to each other, thereby providing a uniform spacing between pairs of slots comprised by the pair of slotted walls, wherein a spacing between slotted walls may be of a predetermined dimension. Slots on each slotted wall of a pair of slotted walls may be configured to provide a horizontal and level orientation between corresponding pairs of slots comprised by the pair of slotted walls (e.g. the top slot on a left slotted wall of a pair of slotted walls is at an equal height as its corresponding top slot on a right slotted wall of the pair of slotted walls, thereby making the top pair of slots level), such that storage modules mounted therein will have a horizontal and level mounting.

Figure 2B:
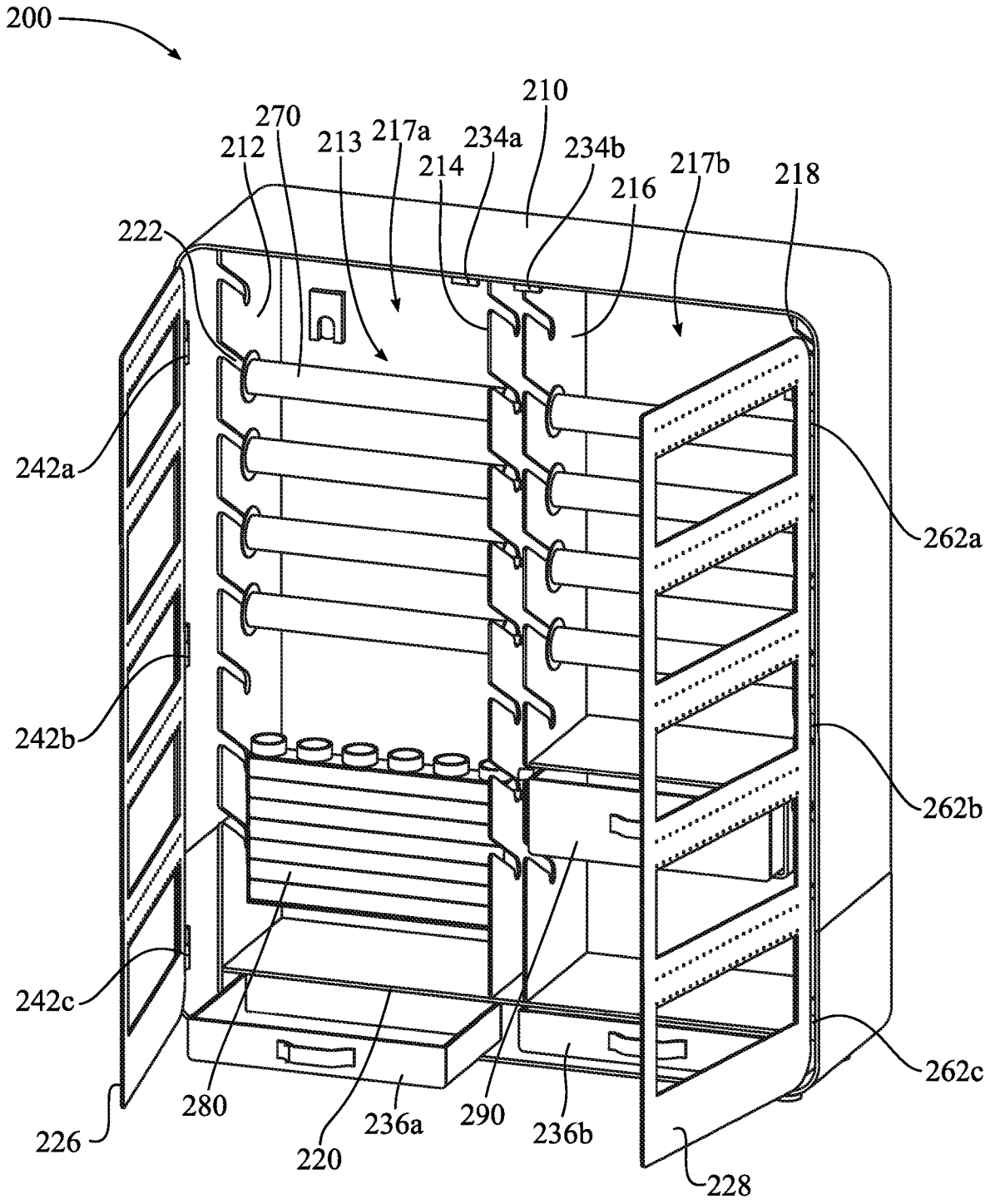
FIG. 2B depicts a perspective front view of an example implementation a main cabinet populated (or configured) with a plurality of storage modules and a left earring panel and a right earring panel.

FIG. 2B depicts a perspective front view of an example implementation a main cabinet 200 populated (or configured) with a plurality of storage modules mounted therein, a left earring panel 226 and a right earring panel 228, wherein earring panels 226 and 228 are shown in open positions, hung from panel hinge mount components 242*a*-242*c*, and panel hinge mount components 262*a*-262*c*, respectively. In the example implementation of FIG. 2B, earring panels 226 and 228, when closed, may be closed against panel stops 234*a* and 234*b*, respectively. In some implementations, as previously discussed, a panel stop may be constructed of or comprise magnetic material which may magnetically engage a panel to maintain a closed position until an opening force overcomes the magnetic force therebetween. Populated within a storage area 217*a* between slotted walls 212 and 214 are four jewelry bars, such as jewelry bar 270, and a ring holder 280, wherein such populated storage modules are mounted in slots of slotted walls 212 and 214, such as jewelry bar 270 in slot 222 of slotted wall 212. Populated within a storage area 217*b* between slotted walls 216 and 218 are four jewelry bars, and a drawer module 290, wherein such populated storage modules are mounted in slots of slotted walls 216 and 218. In the example implementation 200, below bottom inner wall 220 are a left drawer 236*a* and a right drawer 236*b*.

Figure 3A:
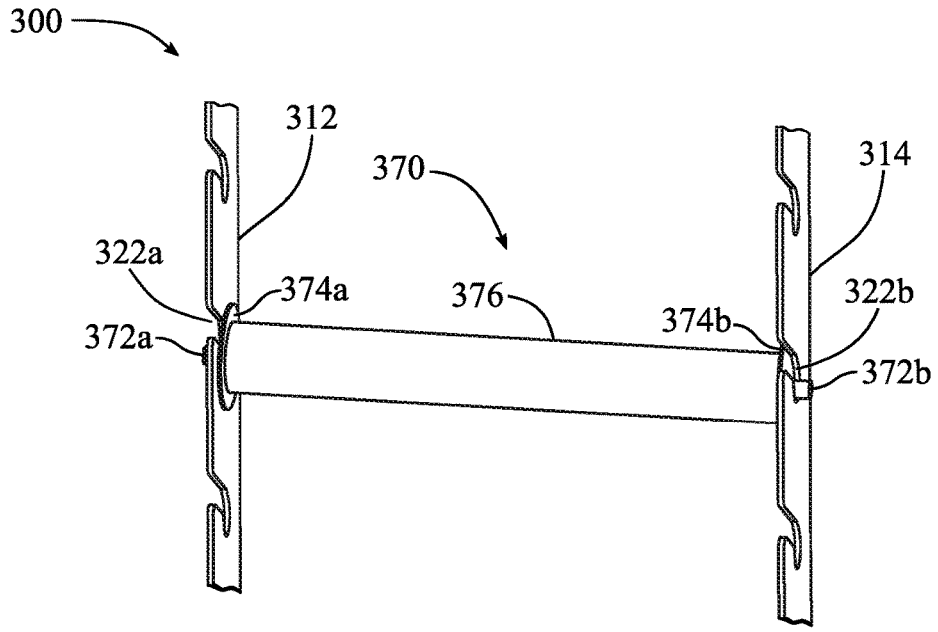
FIG. 3A depicts a perspective front view of an example implementation of slotted walls and a jewelry bar removably attached (i.e. mounted) thereto.

FIGS. 3A-3D are directed to the interoperation of slotted walls and storage modules to facilitate a removable attachment (also called "a mounting" herein) of storage modules to slotted walls. FIG. 3A depicts a perspective front view of an example implementation 300 of a pair of slotted walls, comprising left slotted wall 312 and right slotted wall 314, and a jewelry bar 370 removably attached (i.e. mounted) thereto, wherein portions of slotted walls 312 and 314 are shown, the depicted portions comprising three slots each, including a pair of slots comprising a left slot 322*a* and right slot 322*b*, respectively. In the example implementation 300, jewelry bar 370 has an elongated cylinder 376 terminating on a left end with a disk 374*a* and on a right end with a disk 374*b*, wherein disks 374*a* and 374*b* have mounting rods projecting outwardly therefrom, namely, left mounting rod 372*a* and right mounting rod 372*b*, respectively, and elongated cylinder 376, disks 374*a* and 374*b* and mounting rods 372*a* and 372*b* are concentrically aligned. In some implementations, disks 374*a* and 374*b* may have larger diameters than elongated cylinder 376, and mounting rods 372*a* and 372*b* may have smaller diameters than elongated cylinder 376. For example, in some implementations, elongated cylinder 376 may have a diameter of one inch, disks 374*a* and 374*b* may have diameters of one and one-half inches and mounting rods 372*a* and 372*b* may have diameters of one-quarter inch. As will be recognized by those skilled in the art, many other suitable combinations of diameters are possible. Jewelry bar 370 may be used to store and display necklaces, bracelets, anklets and the like, wherein jewelry bar 370 may be removed (i.e. unmounted) from slotted walls 312 and 314 in order to allow a closed bracelet or necklace to be situated on jewelry bar 370 by passing jewelry bar 370 through it prior to returning jewelry bar 370 to a mounted position in between slotted walls 312 and 314. Given the diameters listed above and the concentric alignment, disks 374*a* and 374*b* will extend radially one-quarter inch beyond elongated cylinder 376, wherein disks 374*a* and 374*b* may prevent a bracelet, necklace, anklet or the like from slipping off jewelry bar 370, and may tend to maintain jewelry on elongated cylinder 376 and between disks 374*a* and 374*b* despite a tipping from a horizontal orientation while jewelry bar 370 may be manipulated and not mounted within slotted walls 312 and 314.

Figure 3B:
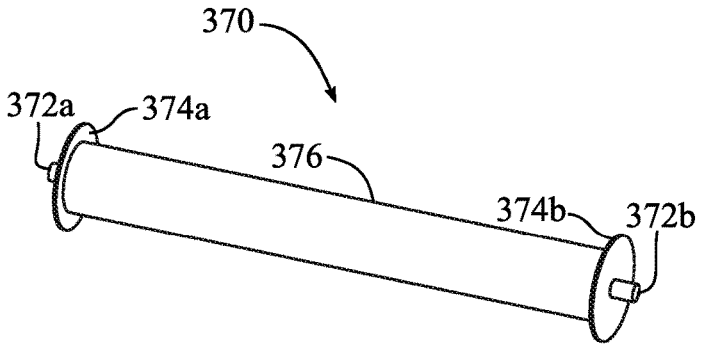
FIG. 3B depicts a perspective front view of the example implementation of a jewelry bar of FIG. 3A when removed from slotted walls.
Figure 3C:
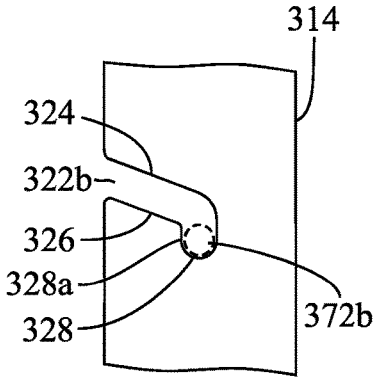
FIG. 3C depicts a right side view of the example implementation of a slot of a slotted wall of FIG. 3A.

FIG. 3B depicts a perspective front view of the example implementation of jewelry bar 370 of FIG. 3A when removed from slotted walls 312 and 314. FIG. 3C depicts a right side view of the example implementation of slot 322*b* of right slotted wall 314 of FIG. 3A, wherein the interoperation of right slotted wall 314 (shown as a portion thereof, the portion comprising one slot, i.e. right slot 322*b*) and a storage module mounting rod, namely, right mounting rod 372*b* (shown as a broken-lined circle) of jewelry bar 370, is shown in more detail. In a mounting operation of a storage module to a pair of slotted walls, such as jewelry bar 370 to left slotted wall 312 and right slotted wall 314, a user may align mounting rods, such as mounting rods 372*a* and 372*b* of jewelry bar 370, to pass into a pair of slots, such as left slot 322*a* and right slot 322*b* of slotted walls 312 and 314, respectively, and slide the storage module and mounting rods to the back of the slots, wherein the slots are configured to receive the mounting rods, thereby enabling a user mounting and unmounting of the storage module to the pair of slotted walls. Looking at FIG. 3C in more detail, in a mounting operation, right mounting rod 372*b* passes into right slot 322*b* in between an upper slot surface 324 and a lower slot surface 326 thereof (and similarly left mounting rod 372*a* passes into left slot 322*a*) to a mounted position of right mounting rod 372*b* in a right pocket 328 at the back of right slot 322*b* (and similarly left mounting rod 372*a* to a mounted position in a corresponding left pocket of left slot 322*a*). In some implementations, the degree of slope of surfaces 324 and 326, and the depth of a pocket 328 may vary from those depicted, and those depicted are only one of many possible implementations. In some implementations, upper and lower surfaces 324 and 326, respectively, need not be parallel, such that a wider throat/opening may be provided to facilitate an easier entry of a mounting rod. In a removal (i.e. unmounting) operation, a user may apply a vertical upward force to lift a storage module and its mounting rods out of their corresponding pockets and with an outward horizontal force, slide the mounting rods out of the slots of the slotted walls which they occupy, such as in the case of jewelry bar 370, a user may apply a vertical upward force to lift right mounting rod 372*b* out of right pocket 328 and slide right mounting rod 372*b* out of right slot 322*b*, while doing the same of left mounting rod 372*a* (i.e., lifting it out of a corresponding left pocket of left slot 322*a* and sliding it out of left slot 322*a*). In some implementations, such as depicted in FIG. 3A and FIG. 3C, should a user pull by applying a generally horizontal force directed outward on a mounted jewelry bar 370, or jewelry stored thereon, outward from slotted walls 312 and 314 on which jewelry bar 370 is mounted, without applying a vertical upward force sufficient to lift mounting rods of jewelry bar 370 out of corresponding pockets, such as right mounting rod 372*b* out of right pocket 328 (and left mounting rod 372*a* out of a corresponding left pocket of slot 322*a*), a right front surface 328*a* of right pocket 328 of right slot 322*b* (and a corresponding left front surface of the left pocket of left slot 322*a*) will provide resistance (opposing force) to the horizontal outward force and prevent the outward movement of mounting rods 372*a* and 372*b*. As such, slots, such as slots 322*a* and 322*b* of slotted walls 312 and 314, and mounting rods 372*a* and 372*b* may be configured to prevent an inadvertent removal of a storage module due to an inadvertent horizontal outward force when there is not an accompanying vertical upward force sufficient to lift mounting rods out of the corresponding pockets in which they are mounted.

Figure 3D:
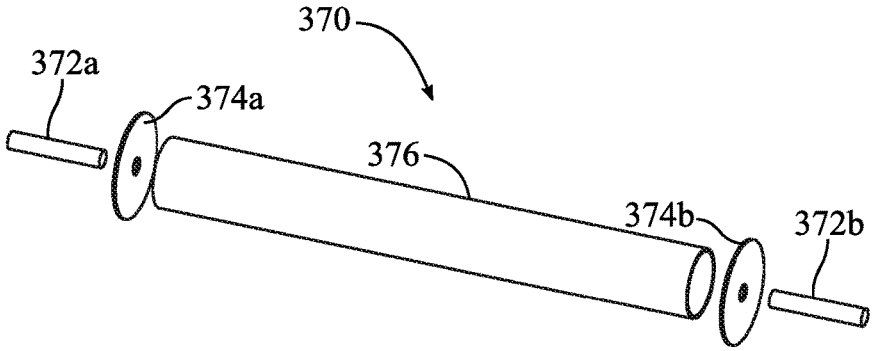
FIG. 3D depicts an exploded perspective front view of the example implementation of jewelry bar 370.

FIG. 3D depicts an exploded perspective front view of the example implementation of jewelry bar 370. In some implementations, jewelry bar 370 may be made of metal components, wherein elongated cylinder 376 may be cut from material such as 1/16 inch thick walled metal tubing, or other suitable material, disks 374*a* and 374*b* may be cut from material such as 1/16 inch thick sheet metal, or other suitable material, and mounting rods 372*a* and 372*b* may be cut from material such as 1/4 inch metal rod, or other suitable material. Such metal components may, for example, be assembled together by welding. In some implementations, plastic components may be used, and for example, solvent welds and/or sonic welds may be used to assemble a plastic elongated cylinder 376, disks 374*a* and 374*b* and mounting rods 372*a* and 372*b*. Other suitable materials and combinations of types of materials may be used to construct jewelry bar 370. For example, elongated cylinder 376 may be cut from a wood dowel, and mounting rods 372*a* and 372*b* and disks 374*a* and 374*b* may be metal, wherein centers of elongated cylinder 376 ends may be drilled to form holes concentric along its axis to accept, in an interference fit, mounting rods 372*a* and 372*b* of sufficient length to: penetrate the drilled holes of elongated cylinder 376 and be securely attached therein; and receive disks 374*a* and 374*b* welded to mounting rods 372*a* and 372*b* so as to be situated against the ends of elongated cylinder 376, such that mounting rods 372*a* and 372*b* protrude beyond disks 374*a* and 374*b* as shown in FIG. 3B. In some implementations, such protrusion beyond disks 374*a* and 374*b* may be 3/8 inch, 1/4 inch or some other suitable length to engage slots of slotted walls, such as left slot 322*a* and right slot 322*b* of left slotted wall 312 and right slotted wall 314, respectively. In some implementations, elongated cylinder 376 and disks 374*a* and 374*b* may be covered in a velvet flocking, or other suitable material which may yield soft and nonabrasive surfaces with which jewelry stored and displayed thereon may interact.

FIGS. 3E-3K are directed to the interoperation of slotted walls and storage modules to facilitate a removable attachment (i.e. mounting) of storage modules to slotted walls, wherein the slotted walls comprise recessed slots rather than slots that are cut-through the slotted wall (which may be referred to as "cut-through slots" herein), wherein the recessed slots do not extend through the full thickness of the slotted walls and are formed by recessed portions within the side(s) of the slotted walls. In some implementations, such recessed slots may be implemented as a milled or routed recessed slot in a slotted wall in a material such as metal, wood or wood composite, or may be a recessed slot molded in a slotted wall comprised of plastic, wood plastic composite (WPC) or the like. In some implementations, recessed slots may be formed by building up the wall face surrounding the recessed slots. In some implementations, the side walls of a main cabinet or a door may have a flat outer surface and the interior surface of the side wall may have recessed slots therein. In such an implementation, the number of main cabinet or door structures needed to complete an assembly may be reduced by virtue of a side wall incorporating recessed slots, thereby eliminating a need for a slotted wall separate from the side wall. Similarly, the outer dimension of width from side wall to side wall may be reduced by virtue of the eliminated separate slotted wall.

Figure 3E:
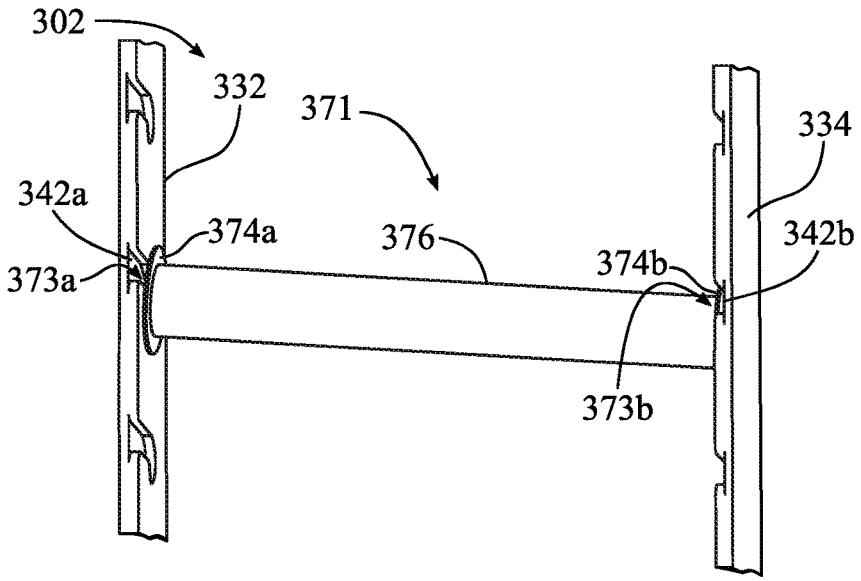
FIG. 3E depicts a perspective front view of an example implementation of slotted walls comprising recessed slots and a jewelry bar removably attached thereto.
Figure 3F:
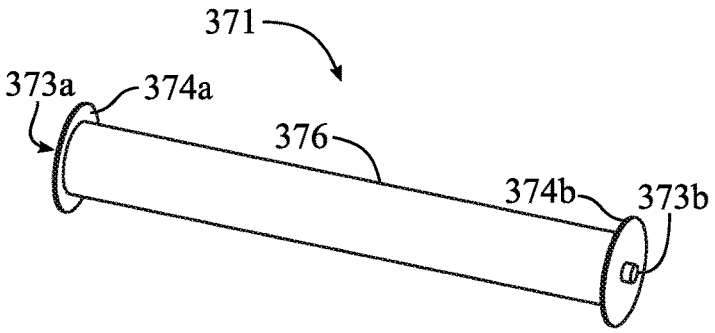
FIG. 3F depicts a perspective view of the example implementation of a jewelry bar of FIG. 3E when removed from slotted walls.

FIG. 3E depicts a perspective front view of an example implementation 302 of slotted walls 332 and 334 and a jewelry bar 371 removably attached (i.e. mounted) thereto, wherein portions of slotted walls 332 and 334 are shown, the depicted portions comprising three recessed slots each, including recessed left slot 342*a* and recessed right slot 342*b*, respectively. Jewelry bar 371 has an elongated cylinder 376 terminating on a left end with a disk 374*a* and on a right end with a disk 374*b*, wherein disks 374*a* and 374*b* have mounting rods projecting outwardly therefrom, namely, left mounting rod 373*a* and right mounting rod 373*b*, respectively. In some implementations, disks 374*a* and 374*b* have larger diameters than elongated cylinder 376, and mounting rods 373*a* and 373*b* have smaller diameters than elongated cylinder 376. For example, in some implementations, elongated cylinder 376 may have a diameter of one inch, disks 374*a* and 374*b* may have diameters of one and one-half inches and mounting rods 373*a* and 373*b* may have diameters of one-quarter inch, wherein elongated cylinder 376, disks 374*a* and 374*b* and mounting rods 373*a* and 373*b* may be concentrically aligned. As will be recognized by those skilled in the art, many other suitable combinations of diameters are possible. Similar to jewelry bar 370 described above, jewelry bar 371 may be used to store and display necklaces, bracelets and the like, wherein jewelry bar 371 may be removed or unmounted from left slotted wall 332 and right slotted wall 334 in order to allow a closed bracelet or necklace to be situated on jewelry bar 371 by passing jewelry bar 371 through it prior to returning jewelry bar 371 to a removably attached or mounted position in between slotted walls 332 and 334. Similar to jewelry bar 370 described above, jewelry bar 371 may comprise the same example diameters listed above, and the same concentric alignment thereof, wherein disks 374*a* and 374*b* will extend radially one-quarter inch beyond elongated cylinder 376, wherein disks 374*a* and 374*b* may prevent a bracelet or necklace (or the like) from slipping off jewelry bar 371 and tend to maintain jewelry on elongated cylinder 376 and between disks 374*a* and 374*b* despite a tipping from a horizontal orientation while jewelry bar 371 is manipulated and not mounted within slotted walls 332 and 334. In some implementations, jewelry bar 371 may differ from jewelry bar 370, such as for example, mounting rods 373*a* and 373*b* of jewelry bar 371 may each protrude a shorter distance from the respective disk from which they protrude than the distances of mounting rods 372*a* and 372*b* of jewelry bar 370, wherein the shorter distances, at least in part, may reflect the depth recessed slots 342*a* and 342*b* are recessed into the sides of slotted walls 332 and 334. FIG. 3F depicts a perspective view of the example implementation of jewelry bar 371 removed from slotted walls 332 and 334.

Figure 3G:
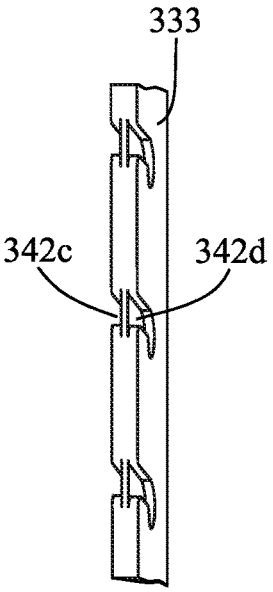
FIG. 3G depicts a perspective front view of an example implementation of a slotted wall comprising recessed slots on both sides thereof.
Figure 3H:
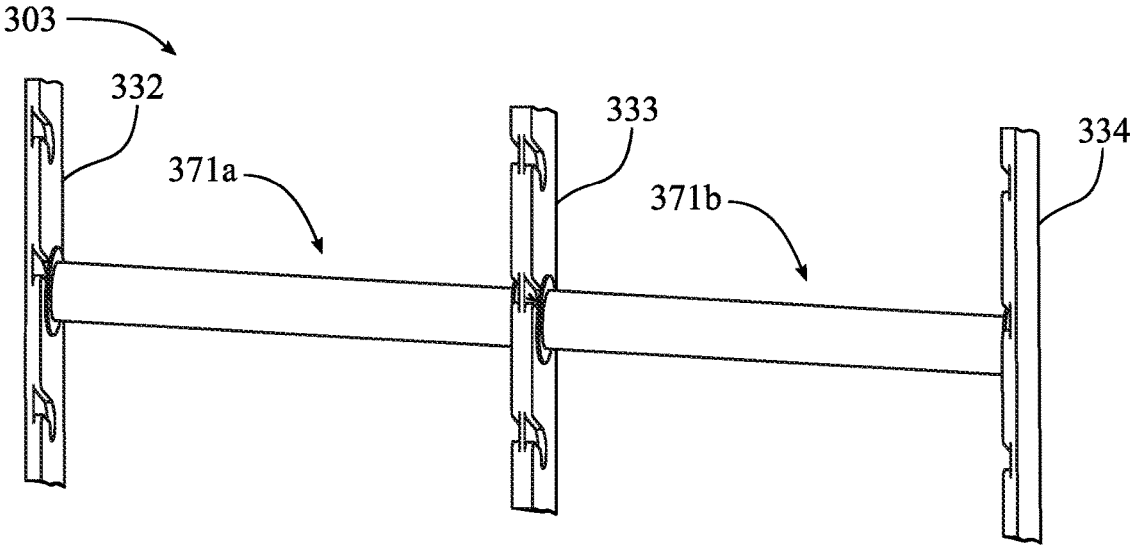
FIG. 3H depicts a perspective front view of an example implementation of slotted walls having a left slotted wall, a center two-sided slotted wall and a right slotted wall.
Figure 3I:
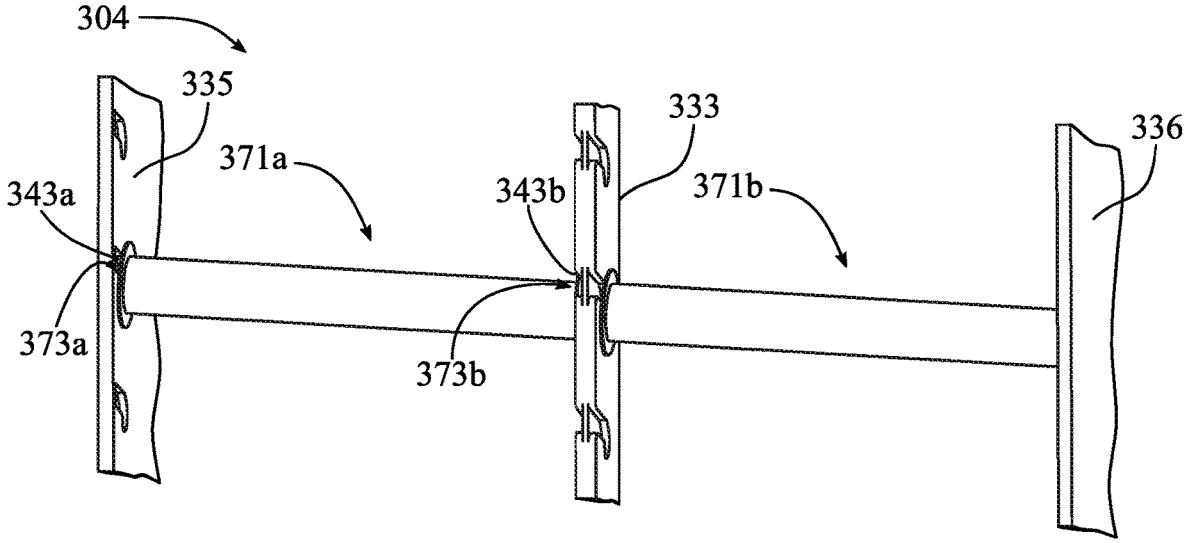
FIG. 3I depicts a perspective front view of an example implementation of side walls wherein the interior surfaces comprise recessed slots.

In some implementations, a slotted wall may comprise recessed slots on both sides, as depicted in the example implementation of FIG. 3G which depicts a perspective front view of an example implementation of a portion of a slotted wall 333 comprising three recessed slots on both sides thereof, such as slots 342*c* and 342*d*. In some implementations, slots of both sides may be horizontally aligned (as shown). In some implementations, slots of both sides may be staggered horizontally. In some implementations, slots may pass all the way through from one side to the other side of slotted wall 333. In such implementations, the minimum thickness of slotted wall 333 may be configured such that opposing mounting rods (resulting from storage modules being mounted on each side of a given slot) do not interfere with each other. Referring briefly to FIG. 2B, a reduction in overall width of main cabinet 210, without a reduction of storage module width or storage capacity, may be achieved where a two-sided slotted wall, such as slotted wall 333 is used in place of slotted walls 214 and 216. FIG. 3H depicts a perspective front view of an example implementation 303 which comprises a left slotted wall 332, a center two-sided slotted wall 333 and a right slotted wall 334. Also shown in FIG. 3H are a left mounted jewelry bar 371*a* and a right mounted jewelry bar 371*b*. In some implementations, a further reduction in overall width of main cabinet 210, without a reduction of storage module width or storage capacity, may be achieved where the interior surfaces of the side walls of main cabinet 210 of FIG. 2B comprise recessed slots (which may be referred to as "slotted side walls" herein) in place of separate slotted walls 212 and 218. An example implementation 304 where the interior surfaces of the side walls comprise recessed slots is depicted in a perspective front view in FIG. 3I, wherein shown are: a portion of a left slotted side wall 335 having a recessed slot 343*a*; a portion of a right slotted side wall 336, wherein recessed slots of slotted side wall 336 are not visible in FIG. 3I; a portion of a two-sided slotted wall 333 positioned between left slotted side wall 335 and right sotted side wall 336, wherein two-sided slotted wall 333 comprises recessed slot 343*b*; mounting rods 373*a* and 373*b* of jewelry bar 371*a* mounted in recessed slots 343*a* and 343*b*, respectively, thereby mounting jewelry bar 371*a* in left slotted side wall 335 and two-sided slotted wall 333; and, jewelry bar 371*b* mounted in two-sided slotted wall 333 and right slotted side wall 336. In some implementations, the front edge of recessed slots of slotted side walls may be closed, as is shown in FIG. 3I. A closed front edge may give a slotted side wall comprising recessed slots a more finished and aesthetically pleasing appearance and a more complete mating between a door side wall and a main cabinet side wall when the door is in a closed orientation. In some implementations having a slotted side wall having a closed front edge, a mounting rod may be first placed into the recessed slot of a slotted side wall followed by the opposing mounting rod being passed into the open front of the opposing recessed slot. In some implementations, a slotted side wall comprising recessed slots may have an open front edge in a similar configuration as the recessed slots in a slotted wall, such as for example, recessed slots 342*a* and 342*b* of FIG. 3E.

Figure 3J:
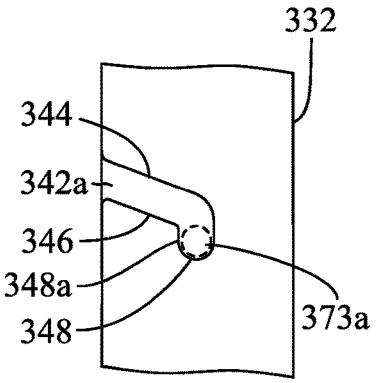
FIG. 3J depicts a side view illustration of an example implementation of recessed slot.

Various implementations of both recessed slots and cut-through slots are possible. FIGS. 3J-3M (and FIG. 3C, discussed above) depict various example slot implementations, each shown in a side view and depicted in a portion of a slotted wall or slotted side wall, the portion comprising one slot. FIG. 3J depicts a side view illustration of an example implementation of recessed slot 342*a*, of a portion of slotted wall 332. Recessed slot 342*a* may correspond to recessed slot 342*a* of slotted wall 332 of FIG. 3E, wherein recessed slot 342*a* has a downward sloping upper surface 344 and a downward sloping lower surface 346 terminating in a pocket 348, wherein a mounting rod (shown as a broken-lined circle), such as left mounting rod 373*a* of jewelry bar 371 may be mounted. In some implementations, the degree of slope of surfaces 344 and 346, and the depth of a pocket 348 may vary from those depicted, and those depicted are only one of many possible implementations. In some implementations, upper and lower surfaces 344 and 346, respectively, need not be parallel, such that a wider throat/opening may be provided to facilitate an easier entry of a mounting rod. In a mounting operation of a storage module to a pair of slotted walls, such as jewelry bar 371 to slotted walls 332 and 334, a user may align mounting rods, such as mounting rods 373*a* and 373*b* of jewelry bar 371, to pass into slots, such as left slot 342*a* and right slot 342*b* of left slotted wall 332 and right slotted wall 334, respectively, wherein left mounting rod 373*a* passes into recessed slot 342*a* in between upper slot surface 344 and lower slot surface 346 thereof (and similarly an opposing mounting rod, such as right mounting rod 373*b*, passes into an opposing recessed slot 342*b*), and slide the storage module and mounting rods to the back of the slots where they are received by pockets, such as pocket 348 of slot 342*a*, thereby enabling a user mounting and unmounting of the storage module to the pair of slotted walls. In a removal (or unmounting) operation, a user may apply a vertical upward force to lift a storage module and its mounting rods out of their corresponding pockets and slide the mounting rods out of the slots of the slotted walls which they occupy, such as in the case of jewelry bar 371, left mounting rod 373*a* out of pocket 348 and out of slot 342*a*, and right mounting rod 373*b* out of a corresponding pocket of slot 342*b* and out of slot 342*b*. In some implementations, such as depicted in FIG. 3J and FIG. 3E, should a user pull by applying a generally horizontal force directed outward on a mounted jewelry bar 371, or jewelry stored thereon, from slotted walls 332 and 334 on which jewelry bar 371 is mounted, without applying a vertical upward force sufficient to lift mounting rods of jewelry bar 371 out of corresponding pockets, such as left mounting rod 373*a* out of left pocket 348 (and right mounting rod 373*b* out of a corresponding right pocket of right slot 342*b*), a left front surface 348*a* of left pocket 348 of left slot 342*a* (and a corresponding right front surface of the right pocket of right slot 342*b*) will provide resistance (opposing force) to the horizontal outward force and prevent the outward movement of mounting rods 373*a* and 373*b*. As such, slots, such as left slot 342*a* and right slot 342*b* of left slotted wall 332 and right slotted wall 334, respectively, and left mounting rod 373*a* and right mounting rod 373*b* may be configured to prevent an inadvertent removal of a storage module due to an inadvertent horizontal outward force when there is not an accompanying upward force sufficient to lift mounting rods out of the corresponding pockets in which they are mounted.

Figure 3K:
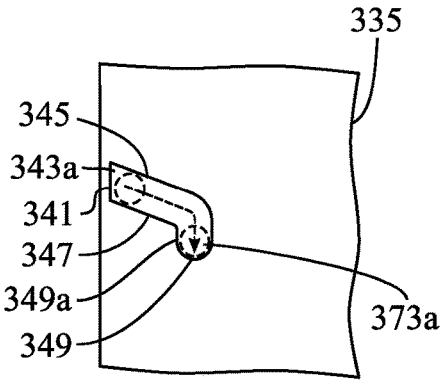
FIG. 3K depicts a side view illustration of an example implementation of a recessed slot.

FIG. 3K depicts a side view illustration of an example implementation of recessed slot 343*a* of a portion of a slotted side wall 335. Slot 343*a* may correspond to the recessed slot 343*a* of FIG. 3I, wherein recessed slot 343*a* has front edge 341, a downward sloping upper surface 345 and a downward sloping lower surface 347 terminating in a pocket 349, wherein a mounting rod (shown as a broken-lined circle), such as left mounting rod 373*a* of jewelry bar 371*a* may be mounted. Also referring to FIG. 3I, in a mounting operation, left mounting rod 373*a* may be placed into recessed left slot 343*a* behind front edge 341 and in between upper slot surface 345 and lower slot surface 347 thereof and an opposing mounting rod, such as right mounting rod 373*b*, may be passed into opposing recessed right slot 343*b*, and mounting rods 373*a* and 373*b* may be slid to the back of recessed slots 343*a* and 342*b*, respectively, where they may be received by pockets, such as left pocket 349 of recessed left slot 343*a* and a corresponding right pocket in recessed right slot 343*b*, respectively. In a removal (or unmounting) operation, a user may apply a vertical upward force to lift a storage module and its mounting rods out of their corresponding pockets and slide the mounting rods outward of the slots of the slotted walls which they occupy, such as in the case of jewelry bar 371*a*, applying a vertical upward force to lift left mounting rod 373*a* out of left pocket 349 and right mounting rod 373*b* out of a corresponding right pocket of recessed right slot 343*b*, and sliding mounting rods 373*a* and 373*b* outward, wherein left mounting rod 373*a* is slid to front edge 341 of recessed left slot 343*a* and right mounting rod 373*b* is slid out of recessed right slot 343*b*, and then remove, in a lateral motion, left mounting rod 373*a* out of recessed left slot 343*a*. In some implementations, such as depicted in FIG. 3I and FIG. 3K, should a user pull by applying a generally horizontal force directed outward on mounted jewelry bar 371*a*, or jewelry stored thereon, outward from slotted side wall 335 and two-sided slotted wall 333 on which jewelry bar 371*a* is mounted, without applying a vertical upward force sufficient to lift mounting rods of jewelry bar 371*a* out of corresponding pockets, such as left mounting rod 373*a* out of left pocket 349 (and right mounting rod 373*b* out of a corresponding right pocket of right slot 343*b*), a left front surface 349*a* of left pocket 349 of left slot 343*a* (and a corresponding right front surface of the right pocket of right slot 343*b*) will provide resistance (opposing force) to the horizontal outward force and prevent the outward movement of mounting rods 373*a* and 373*b*. As such, left slot 343*a* and right slot 343*b* of left slotted side wall 335 and two-sided slotted wall 333, respectively, and mounting rods 373*a* and 373*b* may be configured to prevent an inadvertent removal of a storage module due to an inadvertent horizontal outward force when there is not an accompanying upward force sufficient to lift mounting rods out of the corresponding pockets in which they are mounted.

Figure 3L:
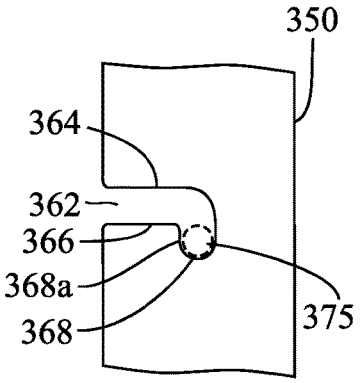
FIG. 3L depicts a side view of an example implementation of a cut-through slot.

FIG. 3L depicts a side view of an example implementation of a cut-through slot 362 in a portion of a slotted wall 350, wherein an upper slot surface 364 and a lower slot surface 366 terminate in a pocket 368 at the back of slot 362, in which a mounting rod may be engaged and mounted, such as mounting rod 375 (shown as a broken-lined circle). In the example implementation shown in FIG. 3L, upper slot surface 364 and lower slot surface 366 have a horizontal orientation and not a downward sloping orientation, as do the upper and lower surfaces of the previously disclosed cut-through slots and recessed slots. However, mounting and removal (unmounting) operations of storage modules with respect to slot 362 may be the same as in those previously described for the slots 322*b* and 342*a* depicted in FIG. 3C and FIG. 3J, respectively, which have downward sloping upper slot and lower slot surfaces. For example, a removal operation associated with slot 362 requires both an outward horizontal force and an upward vertical force of sufficient magnitude to lift mounting rod 375 out of pocket 368 such that a front surface 368*a* of pocket 368 does not restrict a horizontal outward movement of mounting rod 375. The horizontal orientation of upper surface 364 and lower slot surface 366 may require less vertical clearance be afforded between a mounted storage module and a storage module being mounted, than in implementations where there is a slope in the upper and lower surfaces, as there is no vertical movement as the mounting rods of the storage module are slid along the upper and lower horizontal surfaces until the mounting rods drop into pockets. In some implementations, a recessed slot may also have upper and lower surfaces configured in a horizontal orientation similar to upper and lower surfaces 364 and 366.

Figure 3M:
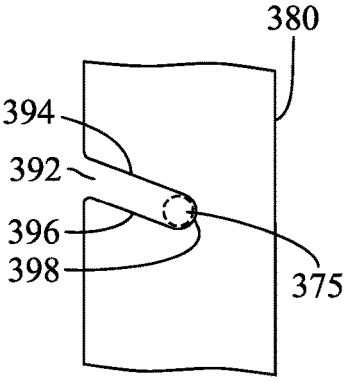
FIG. 3M depicts a side view of an example implementation of a cut-through slot.

FIG. 3M depicts a side view of an example implementation of a cut-through slot 392 in a portion of a slotted wall 380, wherein an upper slot surface 394 and a lower slot surface 396 terminate in a back surface 398 at the back of slot 392, where a mounting rod may be positioned (or mounted), such as mounting rod 375 (shown as a broken-lined circle). In the example implementation shown in FIG. 3M, upper slot surface 364 and lower slot surface 366 have a downward sloping orientation, but do not terminate in a pocket as do the upper and lower surfaces of the cut-through and recessed slots depicted in FIG. 3C and FIGS. 3J-3L. Removal (unmounting) operations of storage modules with respect to slot 362 differ from those previously described for slots 322*b*, 342*a*, 343*a* and 362 of FIG. 3C and FIGS. 3J-3L, respectively, in that slot 392 does not comprise a pocket from which a mounted mounting rod, such as mounting rod 375, must be lifted prior to applying a generally horizontal outward force. A mounting operation corresponding to slot 392 may be similar to those previously described for the slots 322*b*, 342*a*, 343*a* and 362 of FIG. 3C and FIGS. 3J-3L, respectively, however mounting rods, such as mounting rod 375, are engaged in the back 398 of slot 392 by gravity acting on the downward slope of lower surface 396 and transferring a component of the gravitational force against back surface 398, rather than being engaged in a pocket having a front surface. As such, in some implementations where a slot is configured without a pocket, such as slot 392, a generally horizontal outward force of sufficient magnitude to counter the gravitational force transferred in the inward horizontal direction by the degree of slope of lower surface 396 and to additionally overcome frictional forces between slot 392 and mounting rod 375, will allow removal without a vertical upward force as is needed in the case of slots 322*b*, 342*a*, 343*a* and 362 in order to lift the mounting rod out of a pocket having a front surface. In some implementations, a recessed slot may also be configured similar to cut-through slot 392 and not comprise a pocket, wherein upper and lower surfaces 394 and 396 terminate at back 398 and not at a pocket.

Figure 4A:
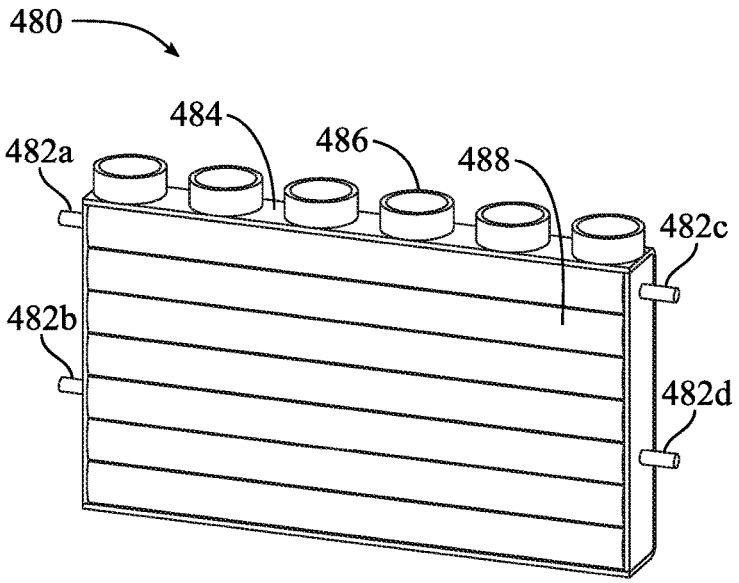
FIG. 4A depicts a perspective front view of an example implementation of a ring holder.

FIG. 4A depicts a perspective front view of an example implementation of a ring holder 480. Ring holder 480 may comprise a frame 484, which in some implementations may be constructed of cut, formed and welded sheet metal, cut and glued or otherwise fastened together pressed board, wood or wood composite, or cut or molded plastic and assembled plastic, or the like, wherein frame 484 comprises four walls, a back and an open front configured to receive a plurality of inserts 488. In some implementations, inserts 488 may be a compressible foam material wrapped in a velvet material, such that when inserts 488 are installed in frame 484, a ring band may be inserted between two of the plurality of inserts 488, and be retained by the compressed foam and be engaged by a nonabrasive surface of the velvet material wrapping the foam inserts 488. In example implementation 480, a plurality of cylindrical holders 486 may be attached to the top of frame 484, and provide for additional ring storage and display, wherein, in some implementations, cylindrical holders 486 may be tubular, cut from metal tube or pipe, welded to the top of frame 484 and have a suitable diameter to receive a ring positioned to surround a cylindrical holder 486 and retain a ring situated on top of frame 484. Such a storage option may be desirable for wide-band rings where the wide band is not conducive for securing between the slots formed between the aforementioned inserts. In some implementations, cylindrical holders 486 may be configured with a screw-in base which screws into the top of frame 484. In some implementations, cylindrical holders or various diameters may be implemented such that a diameter relating to a ring size (finger or toe) of a user may be attached (screwed into) frame 484. In some implementations, cylindrical holders 486 may be covered in velvet flocking, or other suitable material which may yield soft and nonabrasive surfaces with which jewelry, such as a ring, stored and displayed thereon may interact. In some implementations, frame 484 may be covered in velvet flocking, or other suitable material which may yield soft and nonabrasive surfaces with which jewelry stored and displayed thereon may interact. In some implementations, ring holder 480 may be configured to not include cylindrical holders.

Figure 4B:
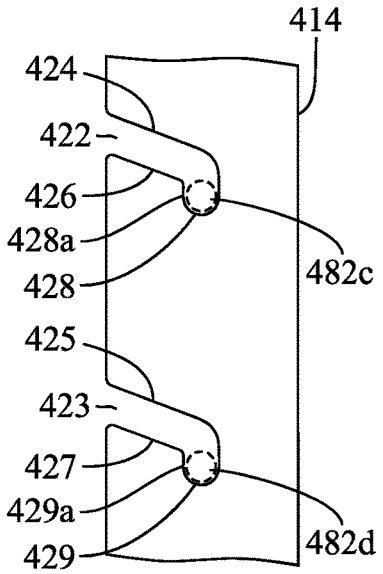
FIG. 4B depicts side view of an example implementation of a portion of a slotted wall.

In the implementation depicted in FIG. 4A, ring holder 480 has mounting rods 482*a*, 482*b*, 482*c* and 482*d*, wherein left upper mounting rod 482*a* and left lower mounting rod 482*b* are disposed on, and projecting outward from the left side of frame 484, and right upper mounting rod 482*c* and right lower mounting rod 482*d* are disposed on, and projecting outward from the right side of frame 484. Mounting rods 482*a*, 482*b*, 482*c* and 482*d* may be cut from material such as ¼ inch metal rod, or other suitable material and may be welded to frame 484, or attached by other suitable method. FIG. 4B depicts a side view of an example implementation of a portion of a right slotted wall 414, the portion comprising two slots, a right upper slot 422 and a right lower slot 423. Right slotted wall 414 may correspond to a portion of a right slotted wall of a pair of slotted walls in which ring holder 480 may be removably attached (i.e. mounted). Right upper slot 422 and right lower slot 423 may be configured to receive right upper mounting rod 482*c* and right lower mounting 482*d*, respectively, wherein mounting rods 482*c* and 482*d* (shown as broken-lined circles) disposed on frame 484 are configured to have a distance therebetween consistent with the distance (or spacing) between slots 422 and 423. Slots 422 and 423 have upper surfaces 424 and 425, lower surfaces 426 and 427, pockets 428 and 429 and front surfaces 428*a* and 429*a*, respectively. In a mounting operation of storage module 480 to a pair of slotted walls comprising right slotted wall 414 and an upper pair of slots and a lower pair of slots, right upper mounting rod 482*c* and right lower mounting rod 482*d* pass into right upper slot 422 and right lower slot 423 of right slotted wall 414 in between upper slot surfaces 424 and 425 and a lower slot surfaces 426 and 427, respectively thereof, (and similarly left upper mounting rod 482*a* and left lower mounting rod 482*b* may pass into a corresponding left upper slot and a corresponding left lower slot, respectively, of a left slotted wall of the pair of slotted walls) to a mounted position of right upper mounting rod 482*c* and right lower mounting rod 482*d* in right upper pocket 428 and right lower pocket 429 at the back of right upper slot 422 and right lower slot 423, respectively, (and similarly left upper mounting rod 482*a* and left lower mounting rod 482*b* to mounted positions in a corresponding left upper pocket and a corresponding left lower pocket of a corresponding left upper slot and left lower slot of a left slotted wall), wherein the slots are configured to receive the mounting rods, thereby enabling a user mounting and unmounting of the storage module to the pair of slotted walls. When mounted, each upper slot (e.g.

upper slot 422 of right slotted wall 414) of the upper pair of slots and each lower slot (e.g. lower slot 423 of right slotted wall 414) of the lower pair of slots engages a mounting rod (of mounting rods 482*a*, 482*b*, 482*c* and 482*d*) of the ring holder storage module 480, and a rotation of the ring holder storage module 480 about an axis normal to both faces of a pair of slotted walls (comprising right slotted wall 414) is limited, at least by an upper slot and a lower slot of a slotted wall having so engaged both an upper mounting rod and a lower mounting rod. In a removal (or unmounting) operation, a user may apply a vertical upward force to lift a storage module and its mounting rods out of their corresponding pockets and slide the mounting rods out of the slots of the slotted walls which they occupy, such as in the case of ring holder 480, a user may apply a vertical upward force to lift mounting rods 482*c* and 482*d* out of pockets 428 and 429, and slide mounting rods 482*c* and 482*d* out of slots 422 and 423, while doing the same of mounting rods 482*a* and 482*b* (i.e., lifting them out of a corresponding pockets of slots of a left slotted wall and sliding them out thereof). In some implementations, such as depicted in FIG. 4A and FIG. 4B, should a user pull by applying a generally horizontal force directed outward on a mounted ring holder 480, or jewelry stored thereon, outward from right slotted wall 414 and a left slotted wall on which ring holder 480 may be mounted, without applying a vertical upward force sufficient to lift mounting rods of ring holder 480 out of corresponding pockets, such as mounting rods 482*c* and 482*d* (and mounting rods 482*a* and 482*b* out of corresponding pockets of slots of a left slotted wall), front surfaces 428*a* and 429*a* of pockets 428 and 429 of slots 422 and 423, respectively (and corresponding front surfaces of corresponding pockets of slots of a left slotted wall) will provide resistance (opposing force) to the horizontal outward force and prevent the outward movement of mounting rods 482*c* and 482*d* (and mounting rods 482*a* and 482*b*). As such, slots, such as slots 422 and 423 of left slotted wall 414, and mounting rods 482*c* and 482*d*, and mounting rods 482*a* and 482*b* and corresponding slots of a left slotted wall may be configured to prevent an inadvertent removal of a storage module, such as a ring holder 480, due to an inadvertent horizontal outward force when there is not an accompanying upward force sufficient to lift mounting rods out of the corresponding pockets in which they are mounted.

In some implementations, a ring holder 480 may only comprise a single upper mounting rod per side, wherein, for example, only mounting rods 482*a* and 482*c* are attached to frame 484. In such an implementation, gravity may result in a generally vertical orientation of a mounted ring holder 480, however, a user attaching/removing a ring thereto/therefrom, may cause ring holder 480 to pivot (swing) about the axes of mounting rods 482*a* and 482*c*.

In the example implementation of FIG. 4B, slots 422 and 423 are cut-through slots, similar to cut-through slot 322*b* depicted in FIG. 3C. In some implementations, other slot configurations may be employed, such as the cut-through and recessed slots of FIGS. 3J-3M, and the like.

Figure 4C:
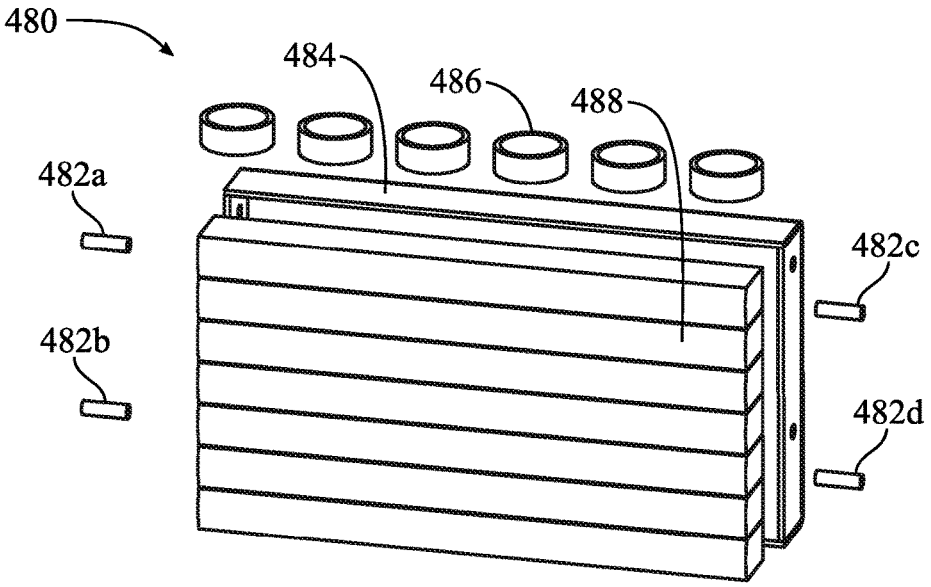
FIG. 4C depicts a perspective front view of an exploded view of the example ring holder of FIG. 4A.

FIG. 4C depicts a perspective front view of an exploded view of the example ring holder 480 of FIG. 4A.

Figure 5A:
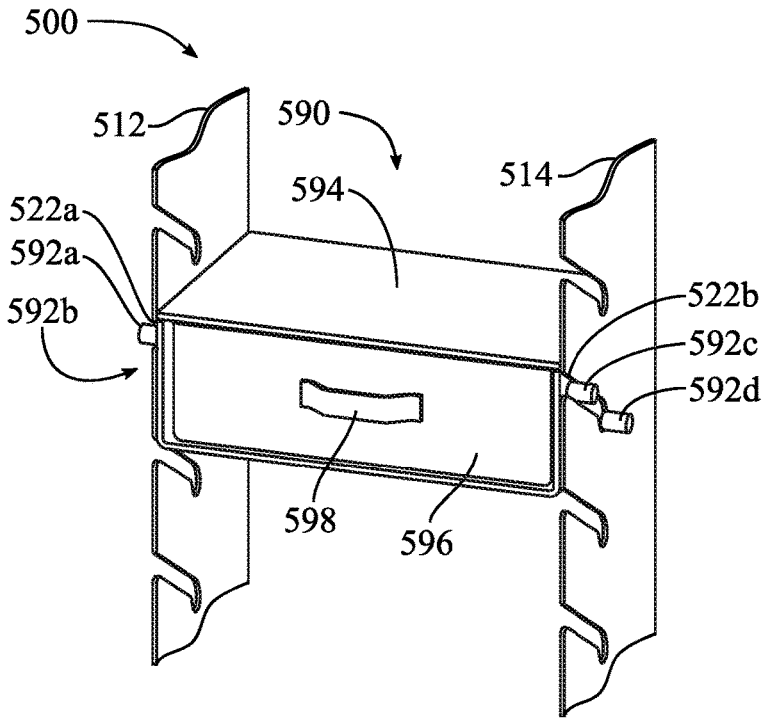
FIG. 5A depicts a perspective front view of an example implementation of a drawer assembly removably attached (mounted) to slots of slotted walls.

FIG. 5A depicts a perspective front view of an example implementation 500 of a drawer assembly 590 removably attached (mounted) to a pair of slots comprising left slot 522*a* and right slot 522*b* of a pair of slotted walls comprising left slotted wall 512 and right slotted wall 514, respectively, wherein portions of slotted walls 512 and 514 are shown and each of the shown portions comprise four slots. Drawer assembly 590 comprises a drawer housing 594 and a drawer 596 comprising a handle 598. In addition to the storage capacity attributed to drawer 596, the top of drawer housing 594 may be used as a shelf to store and display jewelry and other items. In some implementations, drawer housing 594 and drawer 596 may be constructed of cut, formed and welded sheet metal, cut and glued or otherwise fastened together pressed board, wood or wood composite, or cut or molded and assembled plastic, or the like, In some implementations, portions of drawer assembly 590 such as the interior of drawer 596 and the top of drawer housing 594 may be covered in velvet flocking, or other suitable material which may yield soft and nonabrasive surfaces with which jewelry stored therein and displayed thereon may interact. In example implementation 500, drawer assembly 590 comprises four mounting rods, wherein left forward mounting rod 592*a* and left rear mounting rod 592*b* (not visible and referenced by arrow 592*b*) project outward from the left side of drawer assembly 590 and are engaged in left slot 522*a* of left slotted wall 512, and right forward mounting rod 592*c* and right rear mounting rod 592*d* project outward from the right side of drawer assembly 590 and are engaged in right slot 522*b* of right slotted wall 514. Mounting rods 592*a*, 592*b*, 592*c* and 592*d* may be cut from material such as ¼ inch metal rod, or other suitable material and may be welded to drawer housing 594 or attached by other suitable methods. As can be seen in the example implementation of FIG. 5A, left forward mounting rod 592*a* and right forward mounting rod 592*c* are configured at locations on drawer assembly storage module 590 that are forward to the locations of left rear mounting rod 592*b* and right rear mounting rod 592*d* on drawer assembly storage module 590, and as such, mounting rods 592*a* and 592*c* may be called forward mounting rods 592*a* and 592*c* and mounting rods 592*b* and 592*d* may be called rear mounting rods 592*b* and 592*d*.

Figure 5B:
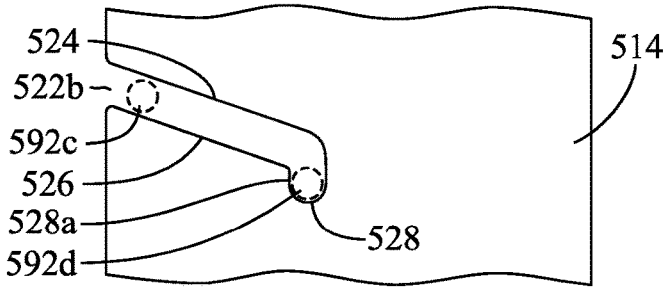
FIG. 5B depicts a right side view of an example implementation of a portion of a slotted wall.

FIG. 5B depicts a right side view of an example implementation of a portion of a right slotted wall 514, the portion comprising one slot, slot 522*b*. Slotted wall 514 may correspond to a portion of a right slotted wall 514 of a pair of slotted walls 512 and 514 in which drawer assembly 590 may be removably attached or mounted. Right slot 522*b* may be configured to receive right forward mounting rod 592*c* and right rear mounting rod 592*d*, wherein mounting rods 592*c* and 592*d* (shown as broken-lined circles) disposed on the right side of housing 594 are configured to yield a horizontal orientation front-to-back of drawer assembly 590 when right rear mounting rod 592*d* is engaged in a pocket 528, and right forward mounting rod 592*c* is engaged between an upper slot surface 524 and a lower slot surface 526. In a mounting operation, right rear mounting rod 592*d* and right forward mounting rod 592*c* pass into right slot 522*b* of right slotted wall 514 in between upper slot surface 524 and lower slot surface 526, (and similarly left rear mounting rod 592*b* and left forward mounting rod 592*a* may pass into left slot 522*a* of left slotted wall 512) to a mounted position of right rear mounting rod 592*d* in right pocket 528 at the back of right slot 522*b*, (and similarly left rear mounting rod 592*b* to a mounted position of left rear mounting rod 592*b* in a corresponding left pocket of left slot 522*a*), wherein the slots are configured to receive a forward mounting rod and a rear mounting rod, thereby enabling a user mounting and unmounting of the drawer assembly storage module to the pair of slotted walls. When mounted, each slot (i.e. left slot 522*a* and right slot 522*b*) of the pair of slots engages a forward mounting rod and a rear mounting rod of the storage module (i.e. 592*a* and 592*c*, and 592*b* and 592*d*, respectively), and a rotation of the drawer assembly storage module 590 about an axis normal to both faces of slotted walls 512 and 514 is limited, at least by one slot having so engaged both a forward mounting rod and a rear mounting rod. In a removal (or unmounting) operation, a user may apply a vertical upward force to lift drawer assembly 590 and its rear mounting rods, namely left rear mounting rod 592*b* and right rear mounting rod 592*d*, out of their corresponding pockets and slide mounting rods 592*a*, 592*b*, 592*c* and 592*d* out of slots 522*a* and 522*b*. In some implementations, such as depicted in FIG. 5A and FIG. 5B, should a user pull by applying a generally horizontal force directed outward on a mounted drawer assembly 590, outward from right slotted wall 514 and left slotted wall 512 on which drawer assembly 590 may be mounted, without applying a vertical upward force sufficient to lift rear mounting rods 592*b* and 592*d* of drawer assembly 590 out of corresponding pockets), a front surface 528*a* of pocket 528 slot 522*b* (and a corresponding front surface of corresponding pocket of slot 522*a*) will provide resistance (opposing force) to the horizontal outward force and prevent the outward movement of rear mounting rods 592*b* and 592*d*. As such, slots, such as slots 522*b* of right slotted wall 514 (and slot 522*a* of left slotted wall 512), and right rear mounting rod 592*d* (and left rear mounting rod 592*b*), may be configured to prevent an inadvertent removal of drawer assembly 590, due to a horizontal outward force, such as when opening drawer 596, when there is not an accompanying upward force sufficient to lift mounting rods out of the corresponding pockets in which they are mounted.

In some implementations, a drawer assembly 590 may be configured to be taller than that depicted in example implementation 500 and provide a taller drawer 596 and housing 594, or multiple drawers 596 vertically stacked in a taller drawer housing 594, or the sides of drawer housing 594 may extend upward beyond the top of drawer housing 594, such that a mounting rod may be disposed on each side of drawer housing 594 in a location consistent with slots above slots 522*a* and 522*b*, wherein, in some implementations, each of at least four mounting rods of drawer assembly 590 may be engaged in a slot (similar to the four mounting rods of ring holder 480 having two upper mounting rods and two lower mounting rods engaging two upper slots and two lower slots, respectively). In some implementations, a drawer assembly 590 may have four mounting rods, each configured to engage a slot when drawer assembly 590 is removably attached (or mounted), and forward mounting rods 592*a* and 592*c* depicted in FIG. 5A may not be present.

In the example implementation of FIG. 5B, slot 522*b* is a cut-through slot, similar to cut-through slot 322*b* depicted in FIG. 3C. In some implementations, other slot configurations may be employed, such as the cut-through and recessed slots of FIGS. 3J-3M, and the like.

Figure 5C:
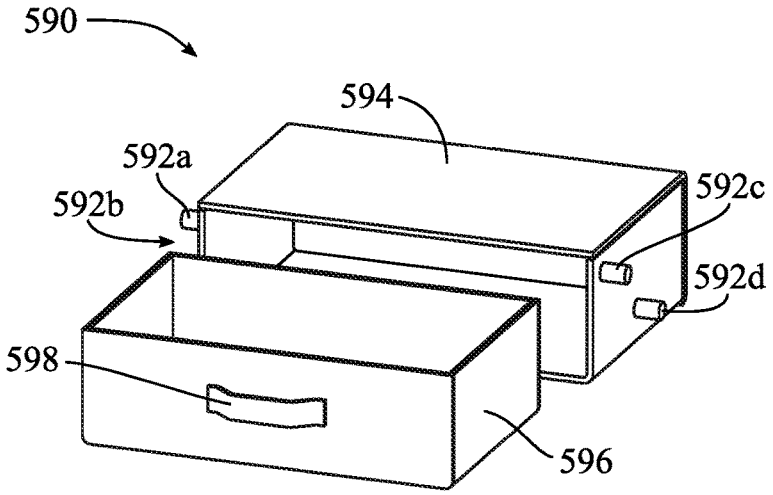
FIG. 5C depicts a perspective front view of the example drawer assembly of FIG. 5A unmounted and having a drawer removed from a drawer housing.

FIG. 5C depicts a perspective front view of the example drawer assembly 590 of FIG. unmounted and having drawer 596 removed from drawer housing 594.

Figure 6A:
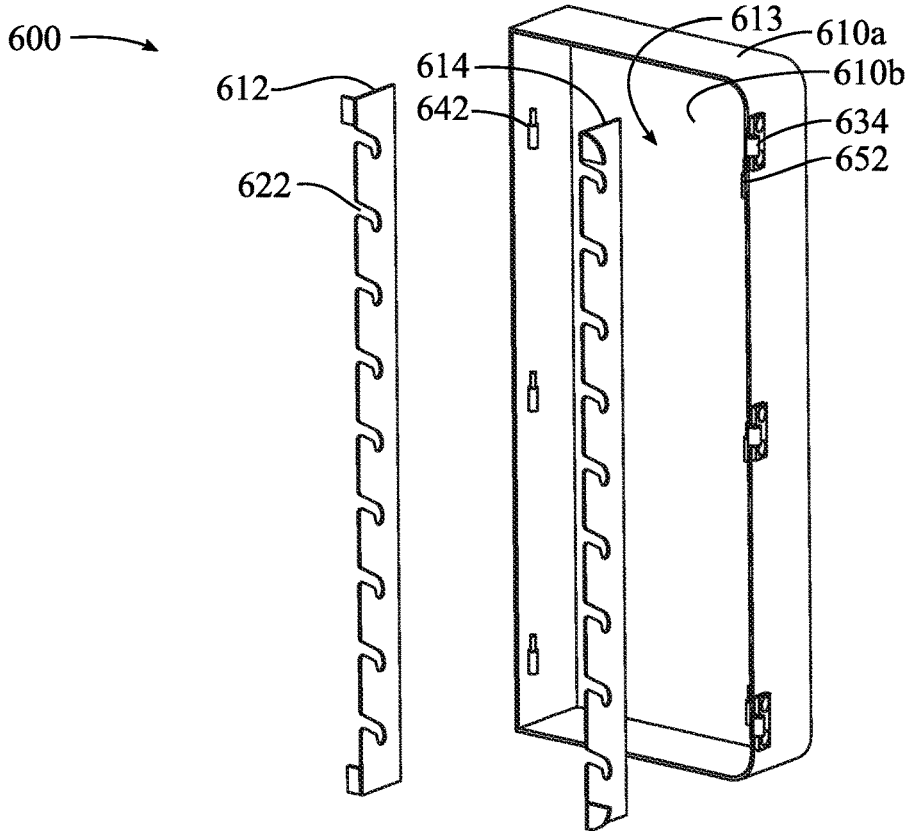
FIG. 6A depicts a perspective rear view (view of interior side) of an example implementation of a left door, wherein slotted walls are illustrated not assembled within a door interior.

FIG. 6A depicts a perspective rear view (view of interior side) of an example implementation of a left door 600, such as or similar to left door 130 of FIG. 1A, wherein left door 600 is shown with a pair of slotted walls comprising left and right (when viewed from the rear side of door 600 as shown) slotted walls 612 and 614, respectively, not assembled within a left door interior 613, wherein left door interior 613 is formed by left door side wall 610*a* and a left door back wall 610*b* (when viewed from the rear side of door 600 as shown). Slotted walls 612 and 614 each comprise a plurality of slots, such as slot 622. In some implementations, left door 600 comprises three left panel hinge mount components disposed of a left vertical portion of left door 600 side wall 610*a* (when viewed from the rear or interior 613 side of door 600 as shown), of which top left panel hinge mount component is referenced by reference number 642. In some implementations, left door 600 comprises three right panel hinge mount components disposed of a right vertical portion of left door 600 side wall 610*a* (when viewed from the rear or interior 613 side of door 600 as shown), of which top right panel hinge mount component is referenced by reference number 652. In some implementations, at least three panel hinge mount components may be disposed on a vertical portion of side wall 610*a*. In some implementations, at least two panel hinge mount components may be disposed on a vertical portion of side wall 610*a*. Left door 600 further comprises three door hinges, of which top door hinge is referenced by reference number 634. In some implementations, door 600 may be constructed of cut and formed sheet metal or stamped, drawn or extruded metal, wherein seams and attachment points may be secured using one or more methods such as welds, rivets, screws, nuts and bolts, snaps, clips and the like. In some implementations, door 600 may be constructed of cut and shaped wood, composite wood, plywood, and the like, wherein joints and attachment points may be secured using one or more methods such as butt joints, rabbet joints, miter joints, lap joints, dado joints, spline joints, mortise and tenon joints, tongue and groove joints, finger joints, dovetail joints and the like, wherein such joints may be secured using one or more of glue, nails, screws, dowels and the like. In some implementations, storage apparatus may be constructed of plastic cut and formed (such as thermoformed) from sheet stock, or injection molded or the like, wherein seams and attachment points may be secured using one or more methods such as sonic welds, solvent welds, glue, rivets, screws, nuts and bolts, snaps, clips and the like. In some implementations, more than one of the aforementioned construction materials of metal, wood and plastic, may be used in combination.

Figure 6B:
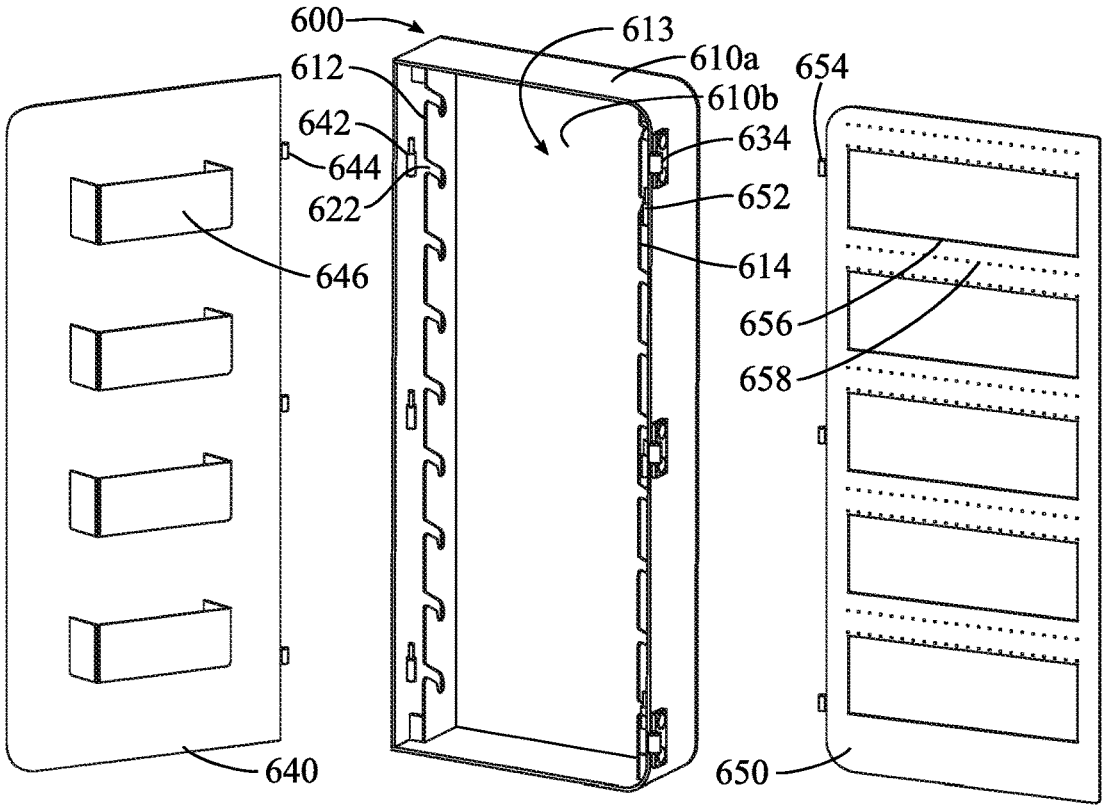
FIG. 6B depicts the example implementation of the left door of FIG. 6A having a left and right panel not assembled, wherein slotted walls are assembled within a door interior.

FIG. 6B depicts a perspective view of the example implementation of left door 600 of FIG. 6A, wherein slotted wall 612 and 614 are assembled, and panels 640 and 650 are shown not assembled to panel hinge mount components 642 and 652. In some implementations, panel 640 may be an eyeglasses panel 640 (configured to receive eyeglasses, sunglasses, reading eyeglasses and the like), wherein, in the implementation depicted, eyeglasses panel 640 comprises four eyeglasses holders, such as eyeglasses holder 646 in which a user may store a pair of eyeglasses. Eyeglasses panel 640 may further comprise three panel hinge components, such as panel hinge component 644, wherein eyeglasses panel 640 may be attached to left door 600 by attaching panel hinge components to left panel hinge mount components, such as panel hinge component 644 to left panel hinge mount component 642. In some implementations, panel hinge component 644 may comprise a vertically oriented hole through which a vertical pin of panel hinge mount component 642 may pass, and about which eyeglasses panel 640 may swing. In some implementations, panel 650 may be an earring panel 650, wherein, in the implementation depicted, earring panel 650 comprises five openings, such as opening 656, and a plurality of attachment holes 658. In some implementations, openings 656 may allow dangling styled earrings to hang freely. Such openings may also enable a user to potentially see what is stored behind panel 650 when in a closed position. Such openings may additionally provide locations around their periphery to clip clip-on earrings. A user may attach an earring (or piercing) by passing an earring post or loop through an attachment hole and attach an earring back to the earring post or secure the earring loop to the earring either by the access provided by an opening, such as opening 656, or reaching around the side of earring panel 650. Earring panel 650 may further comprise three panel hinge components, such as panel hinge component 654. In some implementations, panel hinge component 654 may comprise a vertically oriented hole through which a vertical pin of panel hinge mount component 652 may pass, and about which earring panel 650 may swing.

Figure 7A:
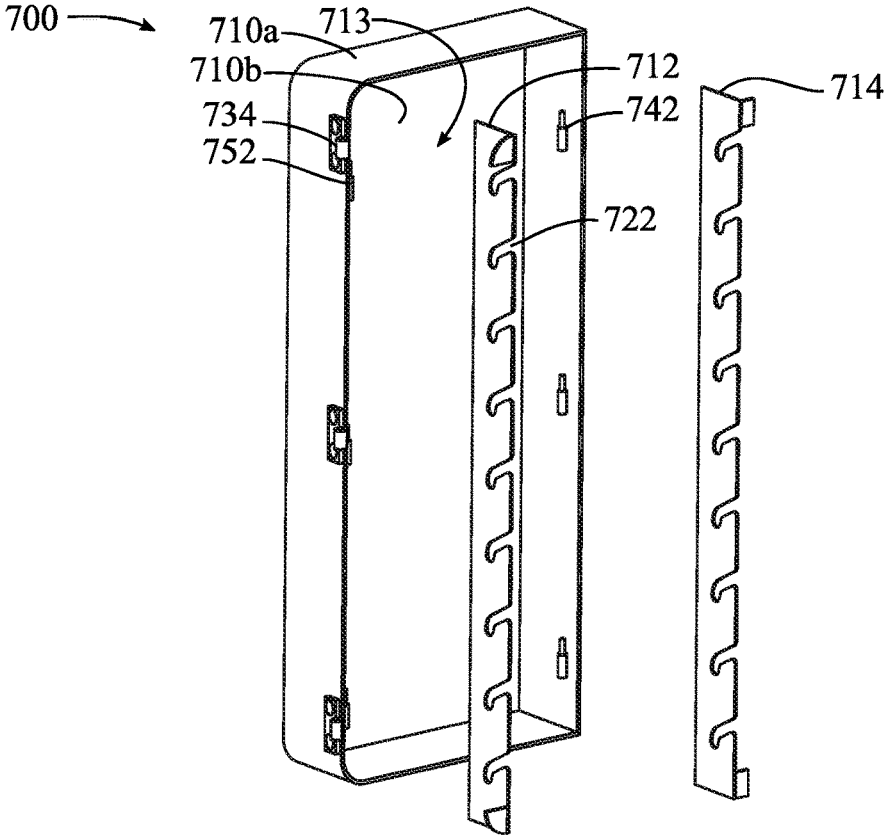
FIG. 7A depicts a rear perspective view (view of interior side) of an example implementation of a right door, wherein slotted walls are illustrated not assembled within a door interior.

FIG. 7A depicts a perspective rear view (view of interior side) of an example implementation of a right door 700, such as or similar to right door 150 of FIG. 1A, wherein right door 700 is shown with a pair of slotted walls comprising left and right (when viewed from the rear of door 700 as shown) slotted walls 712 and 714, respectively, not assembled within a right door interior 713, wherein right door interior 713 is formed by right door side wall 710*a* and a right door back wall 710*b* (when viewed from the rear side of door 600 as shown). Slotted walls 712 and 714 each comprise a plurality of slots, such as slot 722. In some implementations, right door 700 comprises three left panel hinge mount components disposed of a left vertical portion of right door 700 side wall 710*a* (when viewed from rear or interior 713 side of door 700 as shown), of which top left panel hinge mount component is referenced by reference number 742. In some implementations, right door 700 comprises three right panel hinge mount components disposed of a right vertical portion of right door 700 side wall 710*a* (when viewed from the rear or interior 713 side of door 700 as shown), of which top right panel hinge mount component is referenced by reference number 752. In some implementations, at least three panel hinge mount components may be disposed on a vertical portion of side wall 710*a*. In some implementations, at least two panel hinge mount components may be disposed on a vertical portion of side wall 710*a*. Right door 700 further comprises three door hinges, of which top door hinge is referenced by reference number 734. In some implementations, door 700 may be constructed of cut and formed sheet metal or stamped, drawn or extruded metal, wherein seams and attachment points may be secured using one or more methods such as welds, rivets, screws, nuts and bolts, snaps, clips and the like. In some implementations, door 700 may be constructed of cut and shaped wood, composite wood, plywood, and the like, wherein joints and attachment points may be secured using one or more methods such as butt joints, rabbet joints, miter joints, lap joints, dado joints, spline joints, mortise and tenon joints, tongue and groove joints, finger joints, dovetail joints and the like, wherein such joints may be secured using one or more of glue, nails, screws, dowels and the like. In some implementations, storage apparatus may be constructed of plastic cut and formed (such as thermoformed) from sheet stock, or injection molded or the like, wherein seams and attachment points may be secured using one or more methods such as sonic welds, solvent welds, glue, rivets, screws, nuts and bolts, snaps, clips and the like. In some implementations, more than one of the aforementioned construction materials of metal, wood and plastic, may be used in combination.

Figure 7B:
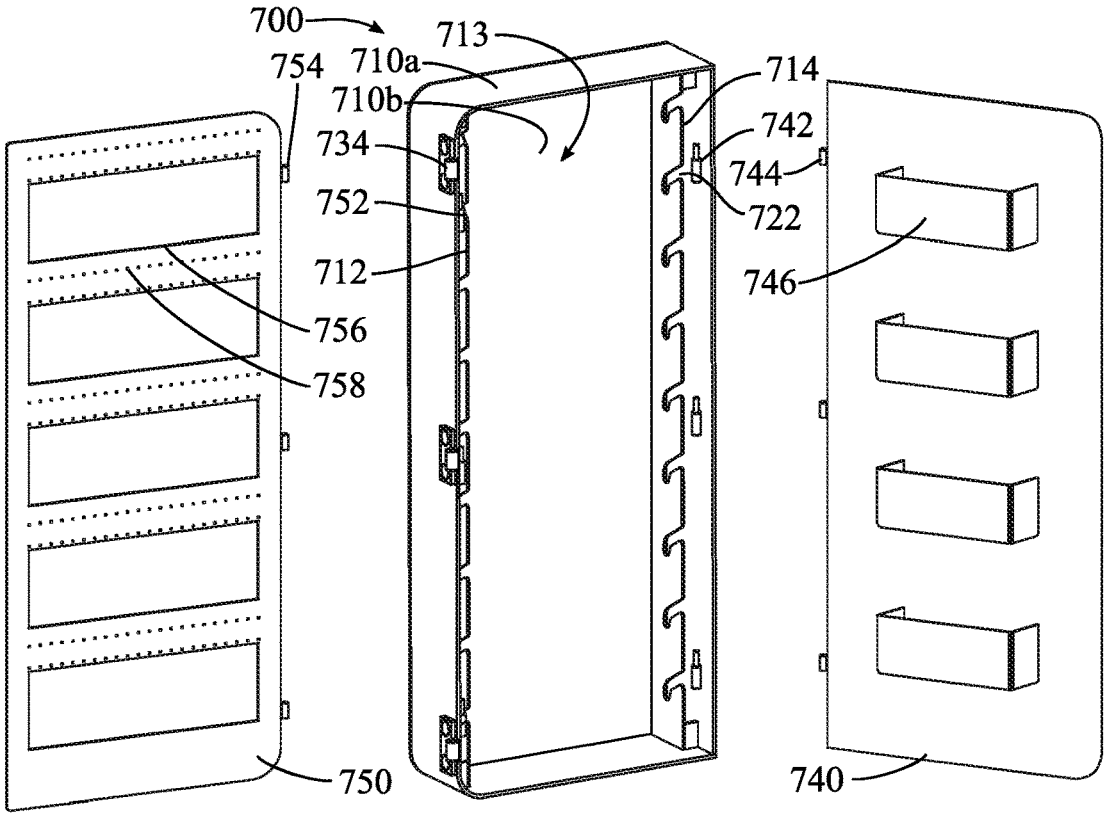
FIG. 7B depicts the example implementation of the left door of FIG. 7A having a left and right panel not assembled, wherein slotted walls are assembled within a door interior.

FIG. 7B depicts a perspective view of the example implementation of right door 700 of FIG. 7A, wherein slotted wall 712 and 714 are assembled, and panels 740 and 750 are shown not assembled to panel hinge mount components 742 and 752. In some implementations, panel 740 may be an eyeglasses panel 740 (configured to receive eyeglasses, sunglasses, reading eyeglasses and the like), wherein, in the implementation depicted, eyeglasses panel 740 comprises four eyeglasses holders, such as eyeglasses holder 746 in which a user may store a pair of eyeglasses. Eyeglasses panel 740 may further comprise three panel hinge components, such as panel hinge component 744, wherein eyeglasses panel 740 may be attached to right door 700 by attaching panel hinge components to left panel hinge mount components, such as panel hinge component 744 to left panel hinge mount component 742. In some implementations, panel hinge component 744 may comprise a vertically oriented hole through which a vertical pin of panel hinge mount component 742 may pass, and about which eyeglasses panel 740 may swing. In some implementations, panel 750 may be an earring panel 750, wherein, in the implementation depicted, earring panel 750 comprises five openings, such as opening 756, and a plurality of attachment holes 758. In some implementations, openings 756 may allow dangling styled earrings to hang freely. Such openings may also enable a user to potentially see what is stored behind panel 750 when in a closed position. Such openings may additionally provide locations around their periphery to clip clip-on earrings. A user may attach an earring (or piercing) by passing an earring post or loop through an attachment hole and attach an earring back to the earring post or secure the earring loop to the earring either by the access provided by an opening, such as opening 756, or reaching around the side of earring panel 750. Earring panel 750 may further comprise three panel hinge components, such as panel hinge component 754. In some implementations, panel hinge component 754 may comprise a vertically oriented hole through which a vertical pin of panel hinge mount component 752 may pass, and about which earring panel 750 may swing.

Figure 8A:
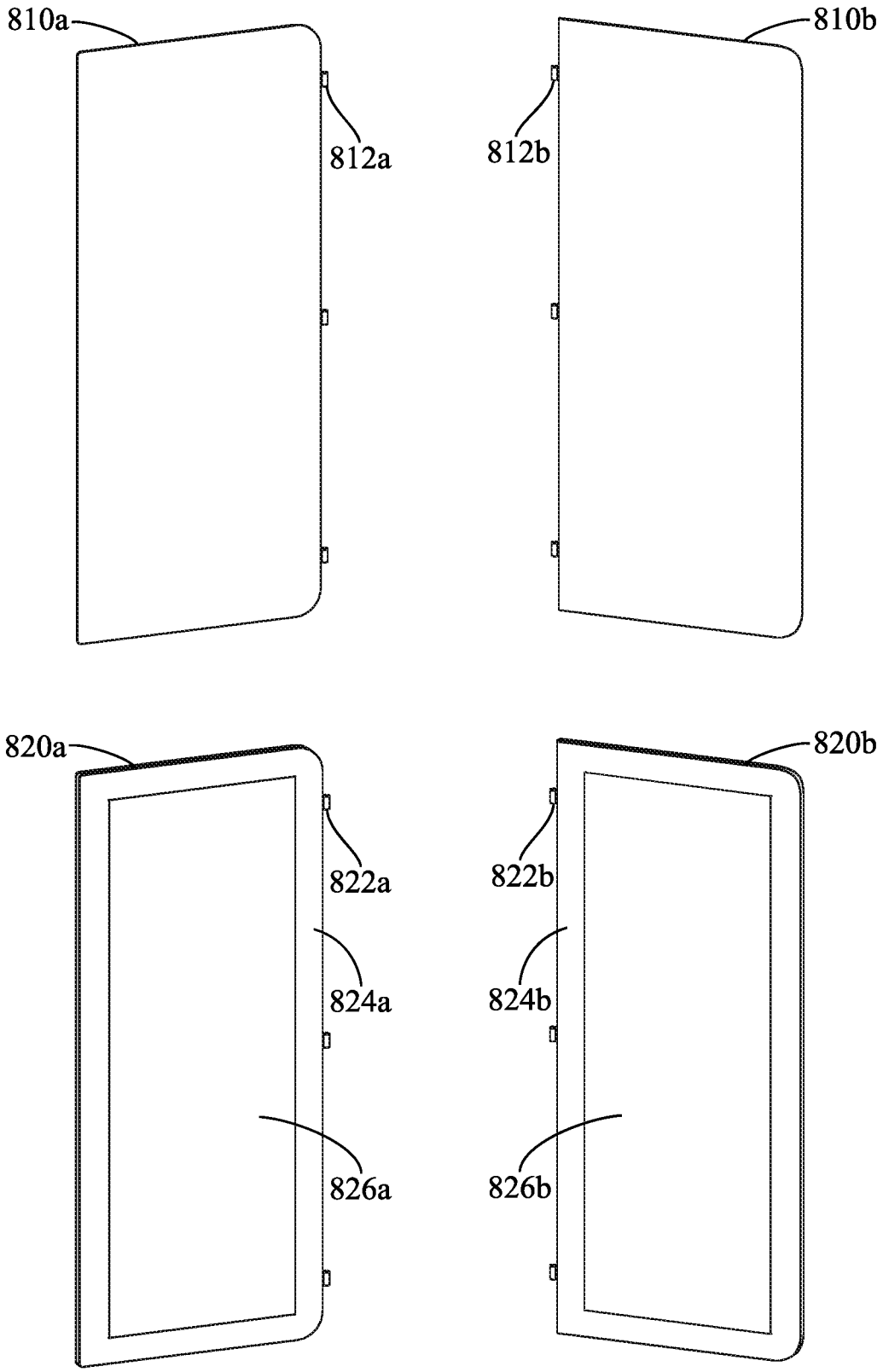
FIG. 8A depicts perspective front views of four example implementations of panels.

Referring now to FIG. 8A, four perspective front views of example implementations of panels are depicted, namely, right-hinged plain panel 810*a*, left-hinged plain panel 810*b*, right-hinged mirror panel 820*a* and left-hinged mirror panel 820*b*. In some implementations, a right-hinged plain panel 810*a* may be constructed of sheet metal, sheet plastic, molded plastic and the like, wherein in some implementations, panel 810*a* may be covered in a velvet flocking, or other suitable material which may yield soft and nonabrasive surfaces with which jewelry may interact. In some implementations, a layer of compressible foam material, such as a one-quarter inch thick foam sheet material, may be first applied to a front and/or rear side of panel 810*a* followed by velvet flocking covering, or other suitable material, such that jewelry and other items may be pinned to the material and foam coverings of panel 810*a*. In some implementations, right-hinged plain panel 810*a* may comprise at least three panel hinge components (or at least two panel hinge components), such as panel hinge component 812*a*, wherein panel 810*a* may be attached to panel hinge mount components, such as panel hinge mount component 652 of door 600 of FIGS. 6A and 6B or panel hinge mount components 262*a*-262*c* of main cabinet 210 of FIGS. 2A and 2B, respectively.

In some implementations, a left-hinged plain panel 810*b* may be constructed of sheet metal, sheet plastic, molded plastic and the like, wherein in some implementations, panel 810*b* may be covered in a velvet flocking, or other suitable material which may yield soft and nonabrasive surfaces with which jewelry may interact. In some implementations, a layer of compressible foam material, such as a one-quarter inch thick foam sheet material, may be first applied to a front and/or rear side of panel 810*b* followed by velvet flocking covering, or other suitable material, such that jewelry and other items may be pinned to the material and foam coverings of panel 810*b*. In some implementations, left-hinged plain panel 810*b* may comprise at least three panel hinge components (or at least two panel hinge components), such as panel hinge component 812*b*, wherein panel 810*b* may be attached to panel hinge mount components, such as panel hinge mount component 642 of door 600 of FIGS. 6A and 6B or panel hinge mount components 242*a*-242*c* of main cabinet 210 of FIGS. 2A and 2B, respectively.

In some implementations, a right-hinged mirror panel 820*a* may comprise a mirror backing (not visible in FIG. 8A) which may be constructed of sheet metal, sheet plastic, molded plastic and the like, and a mirror 826*a*, which may be a transparent plastic or glass having a mirrored coating on the rear surface and may be adhesively attached to mirror backing (not visible). In some implementations, panel 820*a* may comprise a bezel 824*a*. In some implementations, bezel 824*a* may be adhesively attached to mirror. In some implementations, a rear side of mirror panel 820*a* may be covered in a velvet flocking, or other suitable material which may yield soft and nonabrasive surfaces with which jewelry may interact. In some implementations, a layer of compressible foam material, such as a one-quarter inch thick foam sheet material, may be first applied to the rear side of panel 820*a* followed by velvet flocking covering, or other suitable material, such that jewelry and other items may be pinned to the material and foam coverings of the rear of panel 820*a*. In some implementations, right-hinged mirror panel 820*a* may comprise three panel hinge components, such as panel hinge component 822*a*, wherein panel 820*a* may be attached to panel hinge mount components, such as panel hinge mount component 652 of door 600 of FIGS. 6A and 6B or panel hinge mount components 262*a*-262*c* of main cabinet 210 of FIGS. 2A and 2B, respectively.

In some implementations, a left-hinged mirror panel 820*b* may comprise a mirror backing (not visible in FIG. 8A) which may be constructed of sheet metal, rigid sheet plastic, molded plastic and the like, and a mirror 826*b*, which may be a transparent plastic or glass having a mirrored coating on the rear surface and may be adhesively attached to mirror backing (not visible). In some implementations, panel 820*b* may comprise a bezel 824*b*. In some implementations, bezel 824*b* may be adhesively attached to mirror. In some implementations, a rear side of mirror panel 820*b* may be covered in a velvet flocking, or other suitable material which may yield soft and nonabrasive surfaces with which jewelry may interact. In some implementations, a layer of compressible foam material, such as a one-quarter inch thick foam sheet material, may be first applied to the rear side of panel 820*b* followed by velvet flocking covering, or other suitable material, such that jewelry and other items may be pinned to the material and foam coverings of the rear of panel 820*b*. In some implementations, left-hinged mirror panel 820*b* may comprise three panel hinge components, such as panel hinge component 822*b*, wherein panel 820*b* may be attached to panel hinge mount components, such as panel hinge mount component 642 of door 600 of FIGS. 6A and 6B or panel hinge mount components 242*a*-242*c* of main cabinet 210 of FIGS. 2A and 2B, respectively.

Figure 8B:
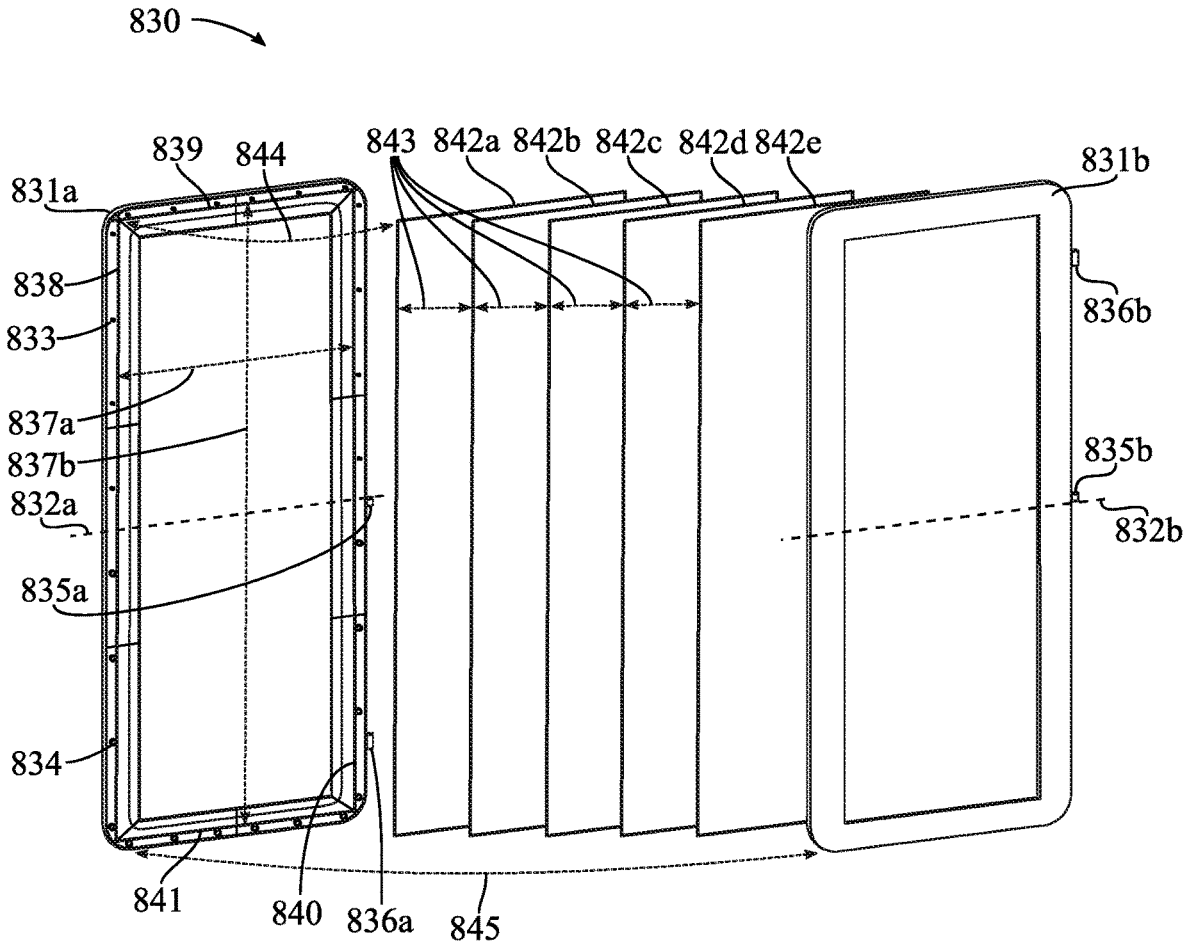
FIG. 8B depicts a perspective front view of an example implementation of a panel assembly in an exploded view, wherein the panel assembly comprises a two-component bezel.

FIG. 8B depicts a perspective front view of an example implementation of a panel assembly 830 in an exploded view, wherein the panel assembly comprises a two-component bezel having a rear bezel component 831*a* (wherein a mating side, or an interior side, is visible in FIG. 8B) and a front bezel component 831*b* (wherein an exterior side is visible in FIG. 8B). Panel assembly 830 may comprise a stack-up of components or component layers, such as components 842*a*-842*e*, shown with a spacing 843 between adjacent components such that each of components 842*a*-842*e* may be partially seen in FIG. 8B. When panel assembly 830 is assembled, such spacing may be eliminated and adjacent components may be stacked against each other. In some implementations, a stack-up of components 842*a*-842*e* may be secured between the two bezel components, 831*a* and 831*b*. In some implementations, bezel components 831*a* and 831*b* may be molded bezel components, injection molded in a plastic or wood-plastic composite material. In some implementations, bezel components 831*a* and 831*b* may be milled and/or cut bezel components, such as milled and/or cut metal, wood or plastic bezel components. In some implementations, bezel components 831*a* and 831*b* may be substantially similar or identical and may be configured to mate and/or be assembled together when one, such as bezel component 831*a*, is rotated 180 degrees about horizontal line 832*a* (as is shown is FIG. 8B) such that mating sides, or interior sides, of bezel components 831*a* and 831*b* are directed towards each other (as is shown is FIG. 8B). As is visible in FIG. 8B, rear bezel component 831*a* comprises mating features, such as post(s) 833, and as boss(es) 834, above and below line 832*a*, respectively. Front bezel, if rotated about 180 degrees about line 832*b*, may appear the same as bezel component 831*a*, and when not rotated (as shown), mating features such as posts of rear bezel 831*a* (such as post 833) are presented with corresponding mating features (bosses) of front bezel component 831*b*, and mating feature such as bosses (such as boss 834) of rear bezel 831*a* are presented with corresponding mating features (posts) of front bezel component 831*b*; and when bezel components 831*a* and 831*b* are brought together (as may be indicated by arrow 845), mating features such as posts and bosses may be mated and may be secured together, by various methods, such as an interference press fit, a sonic welding, a solvent based fusion, or the like. In some implementations, when two bezel components 831*a* and 831*b* are mated together, at least two or at least three (as shown) whole panel hinge components along an assembled bezel side may be formed, and may appear similar to the three panel hinge components shown in panel 820*a* of FIG. 8A, wherein panel hinge component 836*a* of rear bezel component 831*a* may correspond to a lower panel hinge component, panel hinge component 836*b* of front bezel component 831*b* may correspond to an upper panel hinge component (similar to upper panel hinge component 822*a* of FIG. 8A), and half panel hinge component 835*a* of rear bezel component 831*a* and half panel hinge component 835*b* of front bezel component 831*b* may form a corresponding center panel hinge component.

Bezel components 831*a* and 831*b* may comprise features on their interior sides, as may be visible in rear bezel component 831*a* of FIG. 8B, which assist in the assembly of a panel comprising bezel components 831*a* and 831*b*. For example, in some implementations, bezel component 831*a* may comprise ribs 838, 839, 840 and 841 which define a panel component area having a width indicated by arrow 837*a* and a height indicated by arrow 837*b* (as may bezel component 831*b* have corresponding ribs—not visible in FIG. 8B), which facilitate a proper placement of panel components 842*a*-842*e*, such that panel components 842*a*-842*e* may be positioned within a predetermined location (as indicated by arrow 844 depicting an alignment of upper left corners of panel components 842*a*-842*e* to the upper left corner of panel component area defined by ribs 838, 839, 840 and 841) wherein panel components 842*a*-842*e* do not interfere with a mating between corresponding pins and bosses. Ribs 838, 839, 840 and 841 may also increase the rigidity of bezel components 831*a* and 831*b*, and in some implementations, additional ribbing (such as the additional ribbing shown but not referenced) may be implemented to further increase rigidity.

Figure 8C:
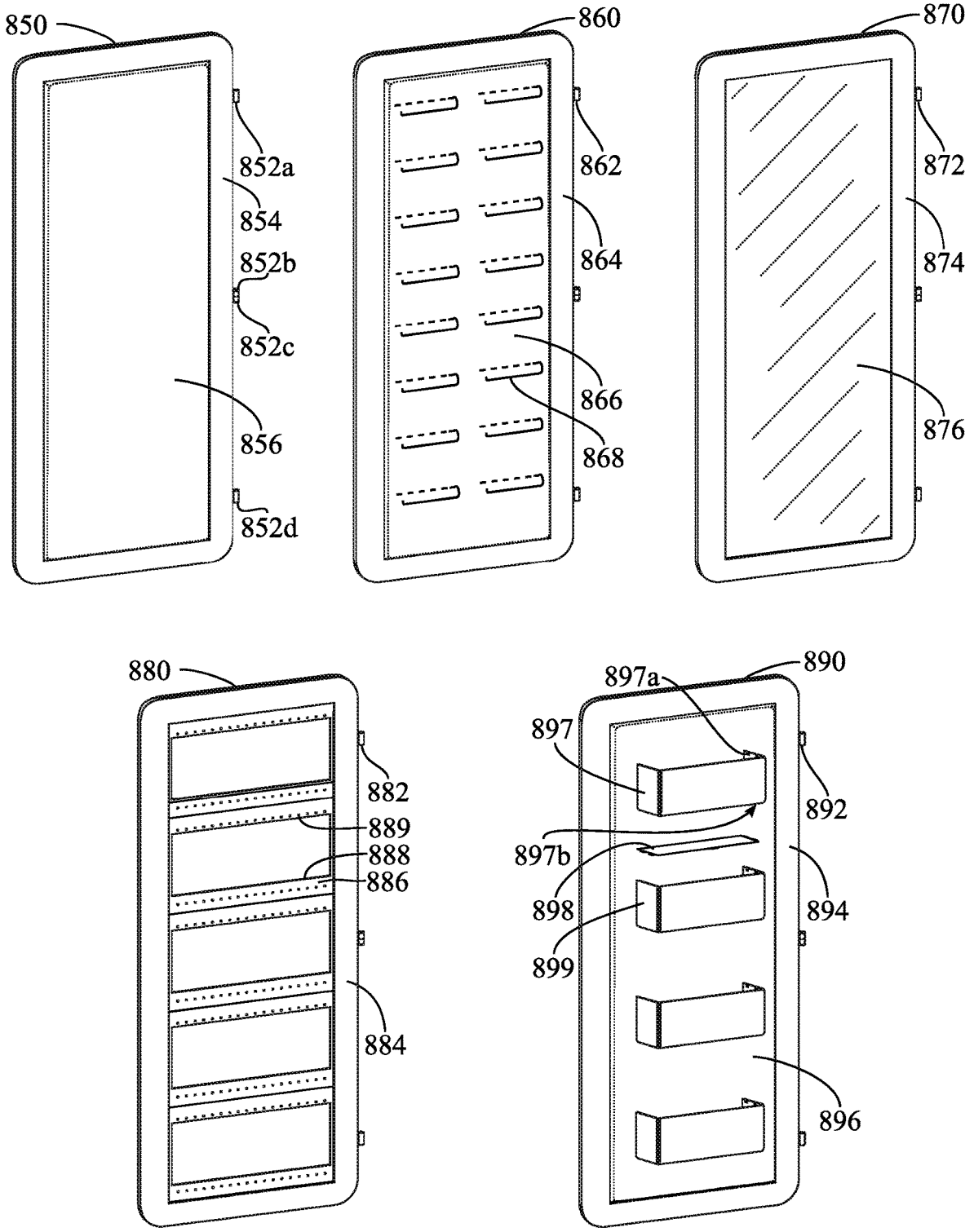
FIG. 8C depicts perspective front views of five example implementations of panel assemblies comprising a two-component bezel.

FIG. 8C depicts five perspective front views of example implementations of panel assemblies 850, 860, 870, 880 and 890, wherein bezels 854, 864, 874, 884 and 894 thereof, respectively, may comprise a front and rear bezel component as discussed above in conjunction with panel assembly 830 of FIG. 8B. In some implementations, the front and rear bezel component of panel assembly 830, and panel assemblies 850, 860, 870, 880 and 890 may be configured to allow a panel to mount to either a left or right hinge configuration by rotating vertically 180 degrees, wherein the same panel side may be directed outward for either a left or right hinge configuration. In some implementations, the front and rear bezel component of panel assembly 830, and panel assemblies 850, 860, 870, 880 and 890 may be configured to allow a particular panel side to be directed outward by rotating horizontally 180 degrees, wherein a different panel side may be directed outward depending on a left or right hinge configuration. In some implementations, the front and rear bezel component of panel assembly 830, and panel assemblies 850, 860, 870, 880 and 890 may be configured to allow a panel to mount to either a left or right hinge configuration and/or either side to be directed outward by rotating vertically 180 degrees and/or horizontally 180 degrees, thereby allowing a given panel assembly to be mounted in either a left or right hinge mount configuration and either side to be used as the front side when the panel is In a closed position.

Panel 850 may be a plain panel, and in some implementations, may have panel components 842*a*-842*e*, such as shown in FIG. 8B, wherein there may be a stack-up of a velvet (or other suitable nonabrasive material) component layer, a foam component layer, a rigid component layer (such as may be constructed of sheet metal, plastic or the like) a foam component layer and a velvet (or other suitable nonabrasive material) component layer, respectively, and wherein the stack-up of panel components may be sandwiched and secured between a rear bezel component and a front bezel component of bezel 854 (as discussed in conjunction with panel assembly 830 of FIG. 8B), and wherein the latter component, velvet (or other suitable nonabrasive material) component layer 856 (corresponding to 842*e* of assembly 830 of FIG. 8B), is visible in FIG. 8C. As such, both a front side and a rear side of plain panel 850 have an outer layer of velvet (or other suitable nonabrasive) material covering a layer of foam, which may facilitate receiving jewelry and other items pinned to either the front side or rear side of plain panel 850. In some implementations, plain panel 850 may comprise panel hinge components formed by the assembly of a front bezel component and a rear bezel component, wherein a whole panel hinge component and a half panel hinge component may be contributed by the rear bezel component and a whole panel hinge component and a half panel hinge component may be contributed by the front bezel component to yield three panel hinge components. Upper panel hinge component 852*a* and half panel hinge component 852*b* of bezel 854 may be comprised by a front bezel component similar to panel assembly 830 of FIG. 8B, wherein upper panel hinge component 836*b* and half panel hinge component 835*b* are comprised by front bezel component 831*b*. Lower panel hinge component 852*d* and half panel hinge component 852*c* of bezel 854 may be comprised by a rear bezel component similar to panel assembly 830 of FIG. 8B, wherein lower panel hinge component 836*a* and half panel hinge component 835*a* are comprised by rear bezel component 831*a*. In some implementations, panels 860, 870, 880 and 890 may comprise panel hinge components formed by the assembly of a front bezel component and a rear bezel component, wherein a whole panel hinge component and a half panel hinge component may be contributed by the rear bezel component and a whole panel hinge component and a half panel hinge component may be contributed by the front bezel component to yield three panel hinge components as was discussed above in conjunction with panel assembly 830 and plain panel 850. In some implementations, panels 850, 860, 870, 880 and 890 (and panel assembly 830) may comprise at least three panel hinge components. In some implementations, panels 850, 860, 870, 880 and 890 (and panel assembly 830) may comprise at least two panel hinge components. Panel hinge components 836*b*, 852*a*, 862, 872, 882, and 892 may be attached to panel hinge mount components, such as panel hinge mount component 652 of door 600 of FIGS. 6A and 6B or panel hinge mount component 262*a* of main cabinet 210 of FIGS. 2A and 2B. When panel assembly 830 and panels 850, 860, 870, 880 and 890 are rotated vertically 180 degrees, lower panel hinge components of panel assembly 830 and panels 850, 860, 870, 880 and 890 (as depicted in FIG. 8B and FIG. 8C), such as lower panel hinge component 852*d* of panel 850, may be attached to panel hinge mount components, such as panel hinge mount component 642 of door 600 of FIGS. 6A and 6B or panel hinge mount components 242*a*-242*c* of main cabinet 210 of FIGS. 2A and 2B, respectively.

Panel 860 may be a pendant panel, and in some implementations, may have panel components 842*a*-842*e*, such as shown in FIG. 8B, wherein there may be a stack-up of a velvet (or other suitable nonabrasive material) component layer, a foam component layer, a rigid component layer (such as may be constructed of sheet metal, plastic or the like) a foam component layer and a velvet (or other suitable nonabrasive material) component layer, respectively, and wherein the stack-up of panel components may be sandwiched and secured between a rear bezel component and a front bezel component of bezel 864 (as discussed in conjunction with panel assembly 830 of FIG. 8B), and wherein the latter component, velvet (or other suitable nonabrasive material) component layer 866 (corresponding to 842*e* of assembly 830 of FIG. 8B), is visible in FIG. 8C. As such, both a front side and a rear side of pendant panel 860 have an outer layer of velvet material (or other suitable nonabrasive material) covering a layer of foam, which may facilitate receiving jewelry and other items pinned to either the front side or rear side of plain panel 850. Pendant panel 860 may be similar to plain panel 850, with the addition of a plurality of pendant hangers, such as pendant hanger 868. In some implementations, pendant hanger 868 may be constructed of a heavy rigid wire, such as a stainless steel wire, and may be formed to have an elongated "U" shape (rotated 90 degree counter clockwise in FIG. 8C), and have one open end sharped to be inserted into and out of velvet layer panel component 866 (and in some implementations, as into and out of a foam layer panel component situated behind) a plurality of times to fasten a pendant hanger during manufacture and/or during a user configuration or reconfiguration of pendant panel 860. In some implementations, the other open end of pendant hanger 868 may be bent inward to facilitate a retention of a pendant hung thereon.

Panel 870 may be a mirror panel, and in some implementations, may have panel components 842*a*-842*d*, such as shown in FIG. 8B with the exclusion of a panel component 842*e*, wherein there may be a stack-up of a velvet (or other suitable nonabrasive material) component layer, a foam component layer, a rigid layer mirror backing component (such as may be constructed of sheet metal, plastic or the like) and a mirror component, respectively, and wherein the stack-up of panel components may be sandwiched and secured between a rear bezel component and a front bezel component of bezel 874 (as discussed in conjunction with panel assembly 830 of FIG. 8B), and wherein the latter component, mirror component 876 (corresponding to 842*d*-panel component 842*e* is excluded—of assembly 830 of FIG. 8B) is visible in FIG. 8C. As such, a rear side of mirror panel 870 has an outer layer of velvet material (or other suitable nonabrasive material) covering a layer of foam, which may facilitate receiving jewelry and other items pinned to the rear side of mirror panel 870, and mirror panel 870 comprises a mirror 876 framed in bezel 874 as a front side.

Panel 880 may be an earring panel, and in some implementations, may have panel component 842*a* as shown in FIG. 8B with the exclusion of a panel components 842*b*-842*e*, wherein panel component 842*a* may comprise at least one earring holder panel component 886, wherein earring holder panel component 886 may be sandwiched and secured between a rear bezel component and a front bezel component of bezel 884 (as discussed in conjunction with panel assembly 830 of FIG. 8B. In the example implementation depicted in FIG. 8C, earring panel 880 comprises five panel components, such as earring holder panel component 886 stacked vertically, each comprising an opening, such as opening 888, and a plurality of attachment holes, such as attachment hole 889. In some implementations, openings 888 may allow dangling styled earrings to hang freely. Such opening may also enable a user to potentially see what is stored behind panel 880 when in a closed position. Such openings may additionally provide locations around their periphery to clip clip-on earrings. A user may attach an earring (or piercing) by passing an earring post or loop through an attachment hole and attach an earring back to the earring post or secure the earring loop to the earring either by the access provided by an opening, such as opening 888, or reaching around the side of earring panel 880. In some implementations, earring panel component 886 may be constructed of injection molded plastic, cut and drilled rigid plastic sheet, cut and drilled sheet metal, or other suitable material. In some implementations, such as is depicted in FIG. 8C, a plurality of identical panel components, such as five (as shown) or fewer or more of earring holder components 886 may be configured. In some implementations, a single earring panel component having a plurality of openings may be configured. In some implementations, more than one earring holder panel component, wherein at least one panel component comprises more than one opening, may be configured. In the example implementation depicted, and in the case of an injection molded plastic earring holder panel component, tooling and parts costs may be minimized by having smaller and identical panel components, rather than fewer larger parts, which may result in larger and more costly injection molding tooling and possibly non-identical parts which require different tooling and/or tooling inserts, which may result in multiple tools or more costly injection molding tooling for producing different parts. Earring panel 880 may facilitate receiving earring and other items secured to attachment holes 889 to the front or rear side of earring panel 880.

Panel 890 may be an eyeglasses panel, and in some implementations, may have panel components 842*a*-842*e*, such as shown in FIG. 8B, wherein there may be a stack-up of a velvet (or other suitable nonabrasive material) component layer, a foam component layer and a rigid component layer (such as may be constructed of sheet metal, plastic or the like) to which a plurality of eyeglasses holders 899 may be attached (wherein such attachment may be a welded attachment, sonic welded attachment, solvent fusion attachment, mating clips therebetween, fasteners or the like) a foam component layer and a velvet (or other suitable nonabrasive material) component layer, respectively, wherein: the latter two component layers may be cut to fit around eyeglasses holders; the stack-up of panel components may be sandwiched and secured between a rear bezel component and a front bezel component of bezel 894 (as discussed in conjunction with panel assembly 830 of FIG. 8B); and, the latter component, velvet (or other suitable nonabrasive material) component layer 896 (corresponding to 842*e* of assembly 830 of FIG. 8B), is visible in FIG. 8C. As such, a rear side of eyeglasses panel 890 has an outer layer of velvet material covering a layer of foam, which may facilitate receiving jewelry and other items pinned to the rear side of eyeglasses panel 890 and comprises eyeglasses trays accessible from the front side.

Panels 850, 870, and 880 are shown with panel hinge components, such as panel hinge components 852*a*, 852*b*, 852*c*, 872 and 882, on respective right sides and may be hung on panel hinge mount components situated on cabinet or door right side walls. In some implementations, panels 850, 870, and 880 (wherein hinges are depicted in FIG. 8C configured on the right) may have panel hinge components configured symmetrically about a center horizontal plane such that panels 850, 870, and 880 may be rotated vertically 180 degrees (as discussed above) and be hung on panel hinge mount components situated on cabinet or door left side walls, thereby adding flexibility in user configurability of a storage apparatus, and minimizing the number of unique panel assemblies required to address left and right hinged panel orientations. In some implementations, panel 860 may have panel hinge components, such as panel hinge component 862, configured symmetrically about a center horizontal plane and may be manufactured to have pendant hangers 868 rotated 180 degrees, or a user may remove and reorient them rotated 180 degrees, such that panel 860 is configured for a left hinge orientation. In some implementations, eyeglasses panel 890 may have panel hinge components, such as panel hinge component 892, configured symmetrically about a center horizontal plane and have eyeglasses trays, such as tray 899, with reversible bottoms, as depicted in FIG. 8C, wherein tray 897 is shown with tray bottom 898 removed and snap receptacles, such as snap receptacles 897*a* and 897*b* (not visible and indicated by arrow 897*b*) in the top and bottom portions of tray side walls, respectively, such that tray bottoms may be repositioned to allow for either a right or left hinge mounting. Panels 850, 860, 870, 880 and 890 may have panel hinge components configured to allow both a horizontal rotation of 180 degrees and a vertical rotation of 180 degrees, and yield a consistent mounting configuration to either a left or right hinged orientation or present either panel side as the outward facing side when closed.

In some implementations, other combinations of component layers are possible such that, for example, a panel may have a mirror surface on both sides, or a panel may have pendant hanger features on both sides, or a panel may have a mirror on one side and a pendant hanger on the other side, or a panel may have a mirror on one side and an eyeglasses holder on the other side, or other such possible combinations of features on two sides of a panel. As discussed above, a panel may be configured to be rotated 180 degrees vertically and/or horizontally such that a user may mount either panel side facing outward on either hinge side.

Figure 9A:
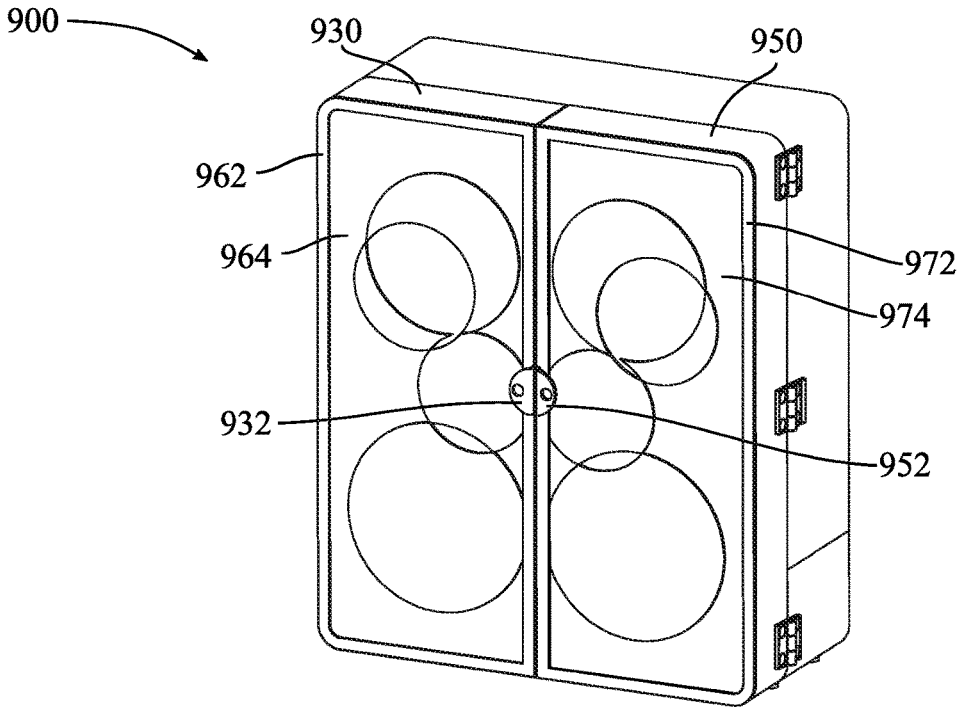
FIG. 9A depicts a perspective front view of an example implementation of storage apparatus comprising user configurable door coverings.
Figure 9B:
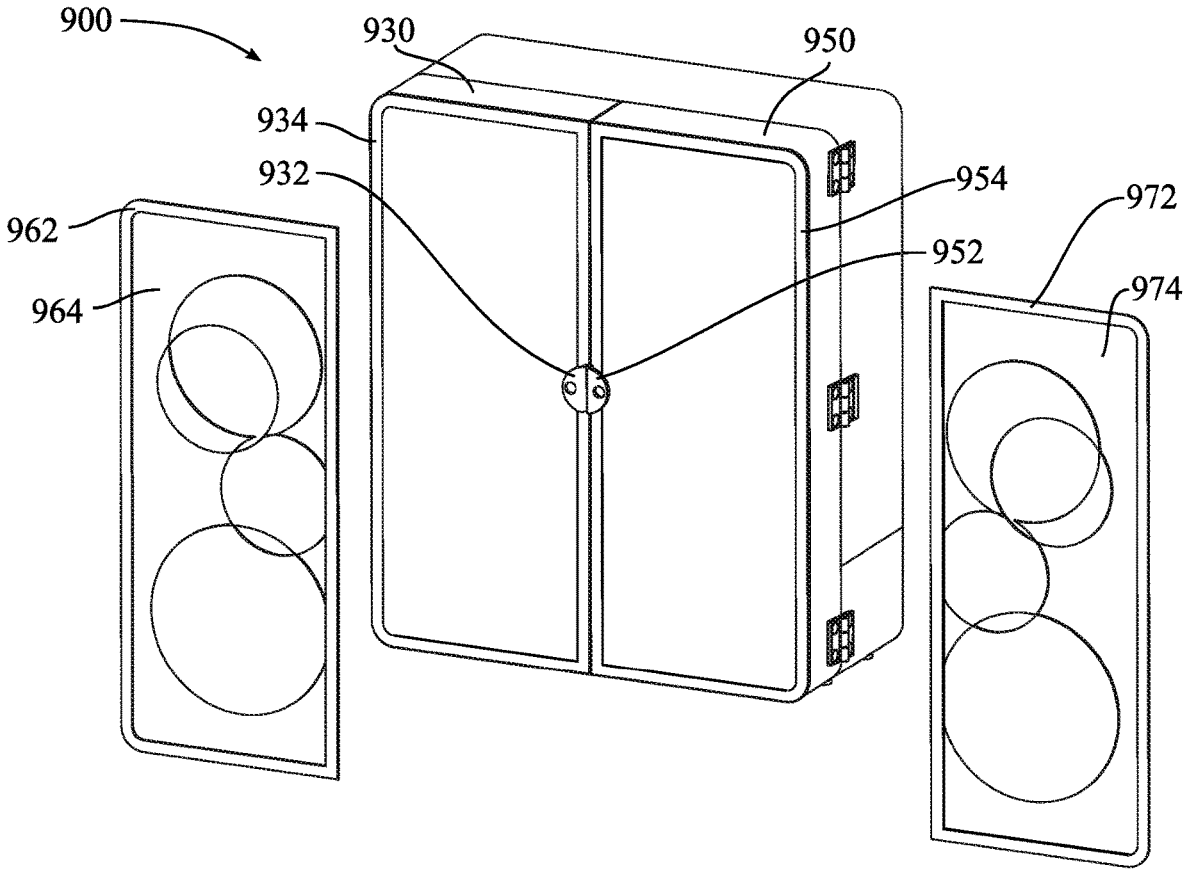
FIG. 9B depicts a perspective front view of the example implementation of the storage apparatus of FIG. 9A, wherein a left door covering of a left door and a right door covering of a right door are removed therefrom.

FIG. 9A depicts a perspective front view of an example implementation of storage apparatus 900 comprising user configurable door coverings. In some implementations, storage apparatus 900 may be similar to storage apparatus 100 of FIG. 1A, in an orientation where doors 130 and 150 are closed and comprising door coverings which may be user configurable. FIG. 9B depicts a perspective front view of the example implementation of the storage apparatus 900 of FIG. 9A, wherein a left door covering 964 of a left door 930 and a right door covering 974 of a right door 950 are removed therefrom. In some implementations, storage apparatus 900 may comprise attachment features 934 and 954 on left door 930 and right door 950, respectively. In some implementations, attachment features 934 and 954 may be adhesive backed magnetic strip material adhesively attached to left door 930 and right door 950, respectively. In some implementations, door coverings 964 and 974 may be a patterned or otherwise decoratively adorned material, painted canvas or other decorative sheet material affixed to ferromagnetic frames 962 and 972, respectively, which may be magnetically attached to magnetic strip material 934 and 954. In some implementations, doors 930 and 950 may be constructed of ferromagnetic material and not have magnetic strips 934 and 954, and frames 962 and 972 of decorative coverings 964 and 974 may be magnetic, such that decorative coverings 964 and 974 may be magnetically attached to doors 930 and 950, respectively. In some implementations, frames may be configured to facilitate attachment of decorative materials or decorations to frames 962 and 972 by a user or an agent thereof (e.g., an interior decorator). For example, in some implementations, frames 962 and 972 may be of a two-piece construction, wherein a decoration may be placed and/or stretched over a first piece and a second piece may be snapped or otherwise attached to the first piece. In some implementations, decorations may be adhesively attached to frames 962 and 972. In some implementations, attachment features 934 and 954 may comprise a fastener, such as a loop fastener, and frames 962 may comprise a hook fastener (or vice versa) of a hook and loop fastener. In some implementations, other suitable fastener mechanisms may be used. In some implementations, storage apparatus 900 may comprise a left door handle 932 and a right door handle 952, attached to left door 930 and right door 950, respectively, wherein door handles 932 and 952 are configured to have attachment features 934 and 954 and coverings 964 and 974 disposed on doors 930 and 950 and situated behind door handles 932 and 952.

Figure 10A:
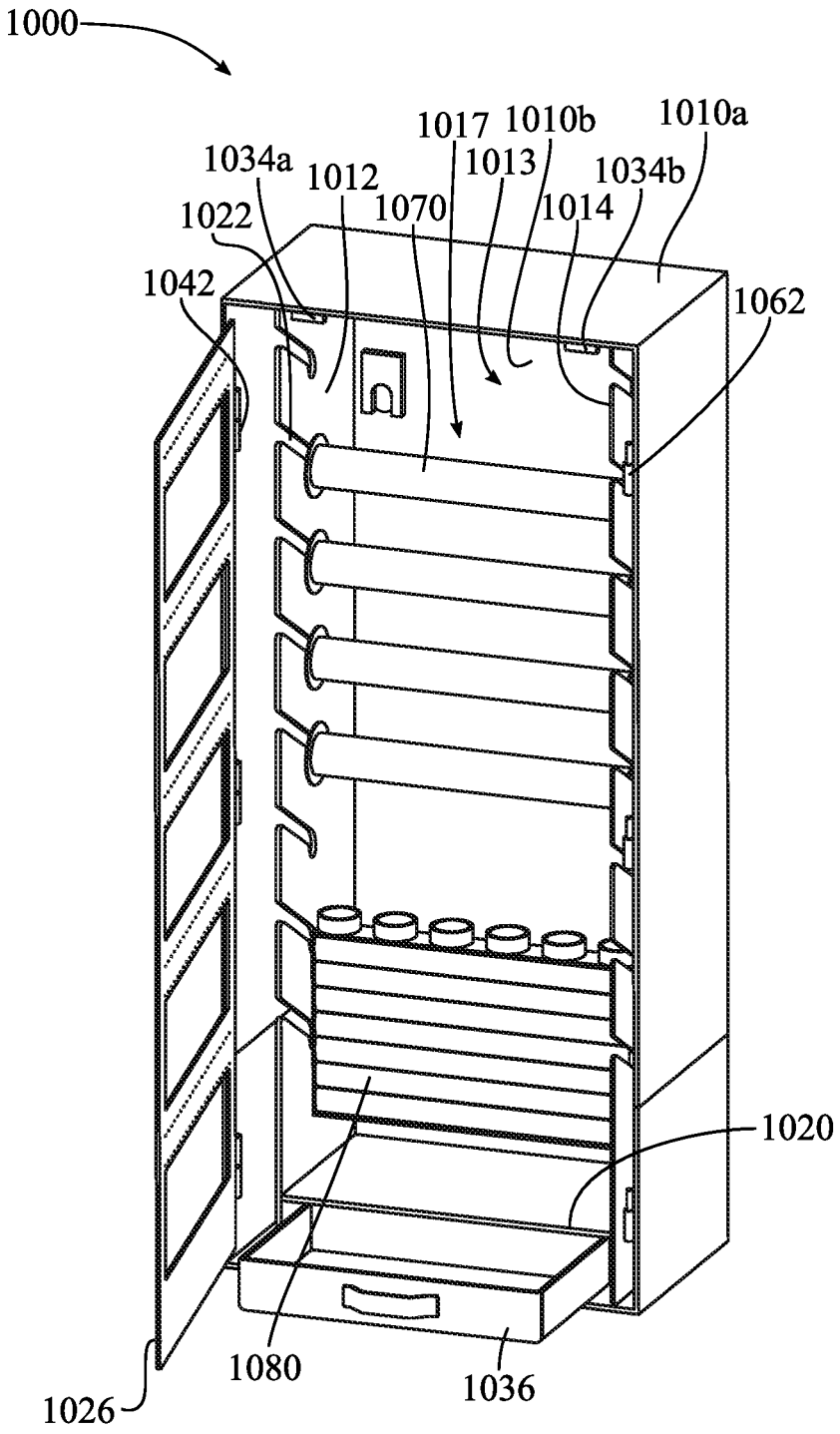
FIG. 10A depicts a perspective front view of an example implementation of a storage base unit.

FIG. 10A depicts a perspective front view of an example implementation of a storage base unit 1000, wherein in some implementations, one or more base units 1000 may be configured together to provide an associated amount of storage capacity and mounting capacity for storage modules and panels, such as those described earlier herein. In some implementations, base unit 1000 may comprise a side wall 1010*a* and a back wall 1010*b*, wherein side wall 1010*a* may form an opening in the front of base unit 1000 and may be generally rectangular in shape as shown in FIG. 10A, and may have a top horizontal portion, bottom horizontal portion, left vertical portion and right vertical portion of side wall 1010*a*. Back wall 1010*b* may terminate along its periphery at side wall 1010*a* and inner surfaces, i.e. wall surfaces within base unit 1000, of side wall 1010*a* and back wall 1010*b* may define an interior 1013 of base unit 1000. Left panel hinge mount components, such as upper left panel hinge mount component 1042 and right panel hinge mount components, such as upper right panel hinge mount component 1062 may be welded, or otherwise attached, to a left vertical portion or a right vertical portion, respectively, of side wall 1010*a* of base unit 1000 to provision for a mounting of panels thereto. In some implementations, at least three panel hinge mount components may be disposed on a vertical portion of side wall 1010*a*. In some implementations, at least two panel hinge mount components may be disposed on a vertical portion of side wall 1010*a*. Base unit 1000 as depicted comprises and is populated (or configured) with a plurality of storage modules mounted therein and a left earring panel 1026, wherein earring panel 1026 is shown in an open position, hung from left panel hinge mount components, such as panel hinge mount component 1042. In the example implementation of FIG. 10A, earring panel 1026, when closed, may be closed against panel stop 1034*b*. In some implementations, a panel (not shown) may be hung from right panel hinge mount components, such as panel hinge mount component 1062, and when closed, may be closed against panel stop 1034*a*. In some implementations, panel stops may be constructed of or comprise magnetic material which may magnetically engage a panel to maintain a closed position until an opening force overcomes the magnetic force. Populated within storage area 1017 between a pair of slotted walls comprising left slotted wall 1012 and right slotted wall 1014 are four jewelry bars, such as jewelry bar 1070, and a ring holder 1080, wherein such populated storage modules are engaged in pairs of slots of slotted walls 1012 and 1014, such as jewelry bar 1070 in left slot 1022 of left slotted wall 1012 and a corresponding right slot of right slotted wall 1014. In the example implementation of base unit 1000, below bottom inner wall 1020 is drawer 1036.

Figure 10B:
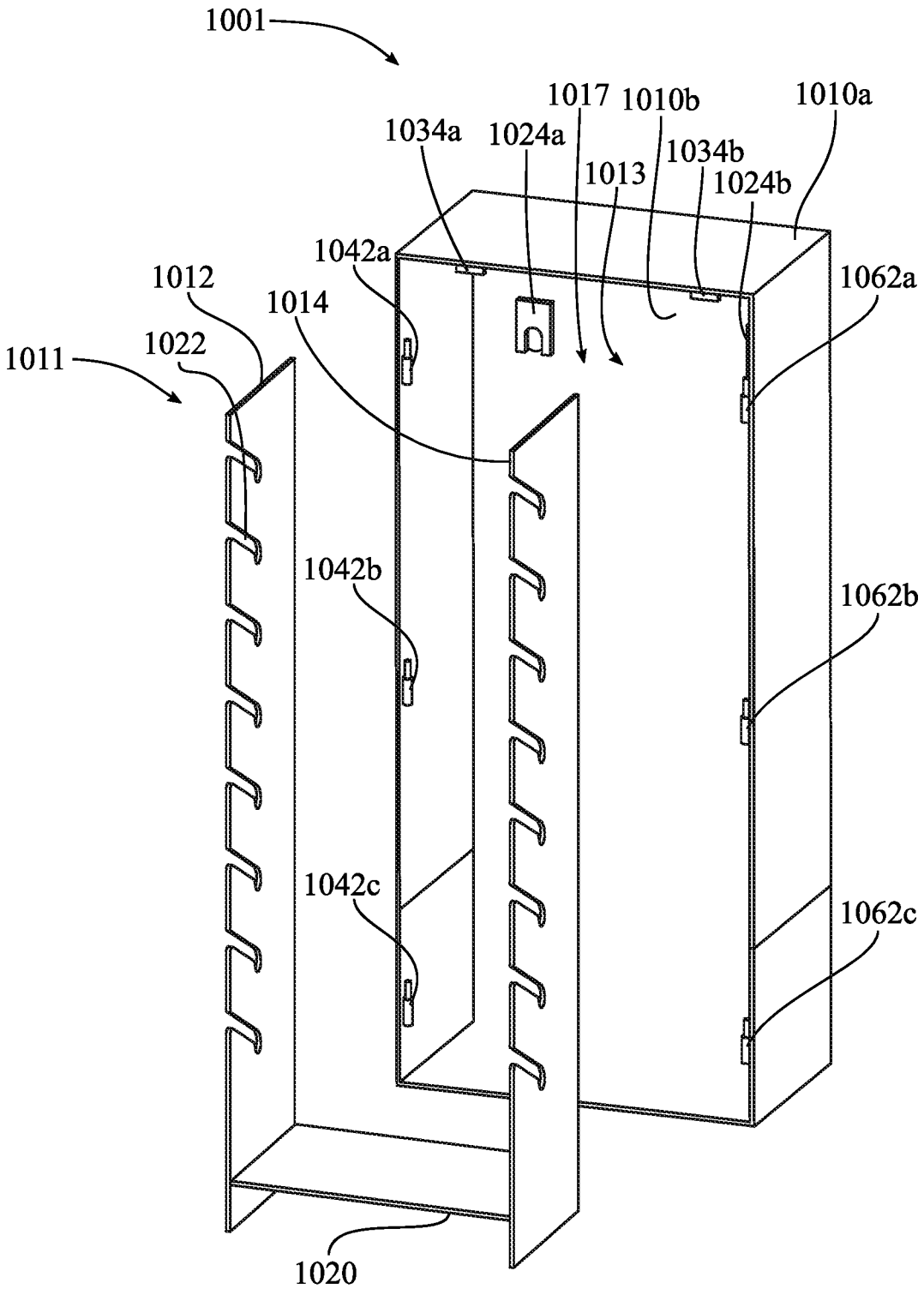
FIG. 10B depicts a perspective front view of an example storage base unit, wherein a slotted wall assembly is removed.

FIG. 10B depicts a perspective front view of an example storage base unit 1001, wherein, slotted wall assembly 1011 may be removed from interior 1013 for illustration purposes and comprises left slotted wall 1012 and right slotted wall 1014, and a bottom inner wall 1020. Left panel hinge components 1042*a*, 1042*b* and 1042*c*, and right panel hinge components 1062*a*, 1062*b* and 1062*c* may be welded, or otherwise attached, to left and right vertical portions of side all 1010*a* of base unit 1001, respectively, to provision for a mounting of panels thereto. Base unit 1001 may comprise panel stops 1034*a* and 1034*b* which may establish a stopping point for mounted panels when closed. Panel stops 1034*a* and 1034*b* may be constructed of or comprise magnetic material which may magnetically engage a panel to maintain a closed position until an opening force overcomes the magnetic force. Also shown in FIG. 10A are mounting holes 1024*a* and 1024*b*. The pair of slotted walls comprising left slotted wall 1012 and right slotted wall 1014 may comprise a plurality of pairs of slots, such as left slot 1022 of left slotted wall 1012 and a corresponding right slot of right slotted wall 1014, wherein, a pair of slots comprising a left slot and a right slot of a pair of slotted walls comprising a left slotted wall and a right slotted wall, may receive a storage module as generally shown in FIG. 10A, and as discussed in detail at least in conjunction with FIGS. 3A, 3C, 4A, 4C, 5A, and 5B. Both slotted walls of a pair of slotted walls may be substantially parallel to each other, thereby providing a uniform spacing between pairs of slots comprised by the pair of slotted walls, wherein a spacing between slotted walls may be of a predetermined dimension. Slots on each slotted wall of a pair of slotted walls may be configured to provide a horizontal and level orientation between corresponding pairs of slots comprised by the pair of slotted walls (e.g. the top slot on a left slotted wall of a pair of slotted walls is at an equal height as its corresponding top slot on a right slotted wall of the pair of slotted walls, thereby making the top pair of slots level), such that storage modules mounted therein will have a horizontal and level mounting.

Figure 11A:
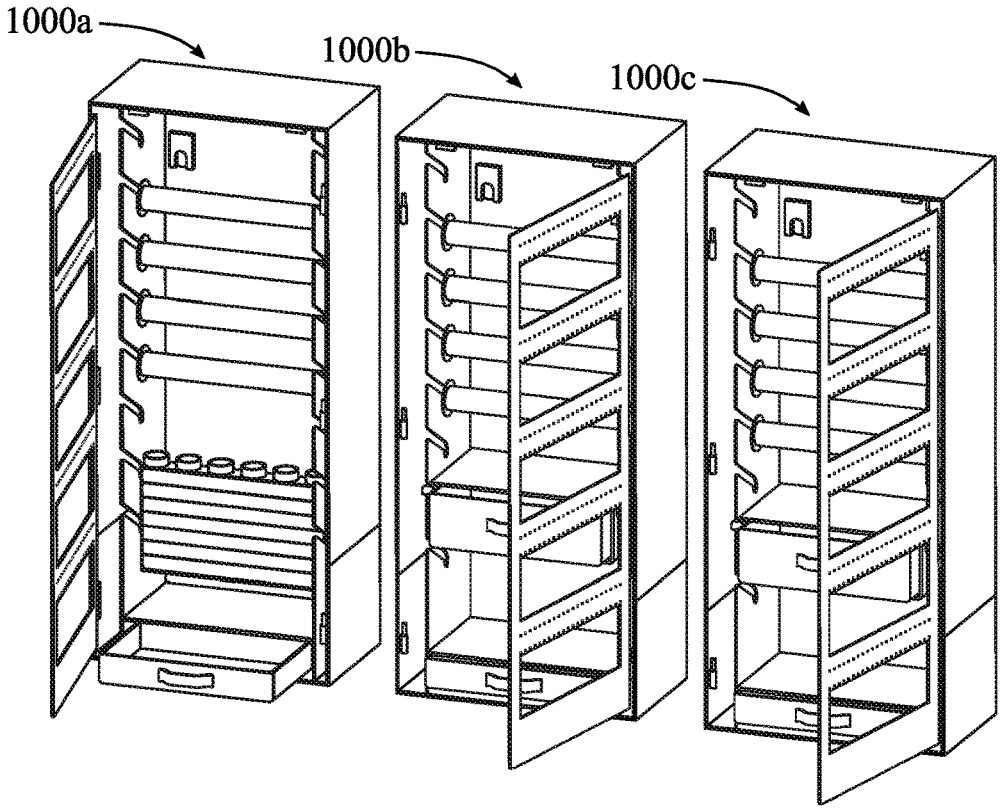
FIG. 11A depicts a perspective front view of three example storage base units positioned in a horizontal arrangement and separated from each other.
Figure 11B:
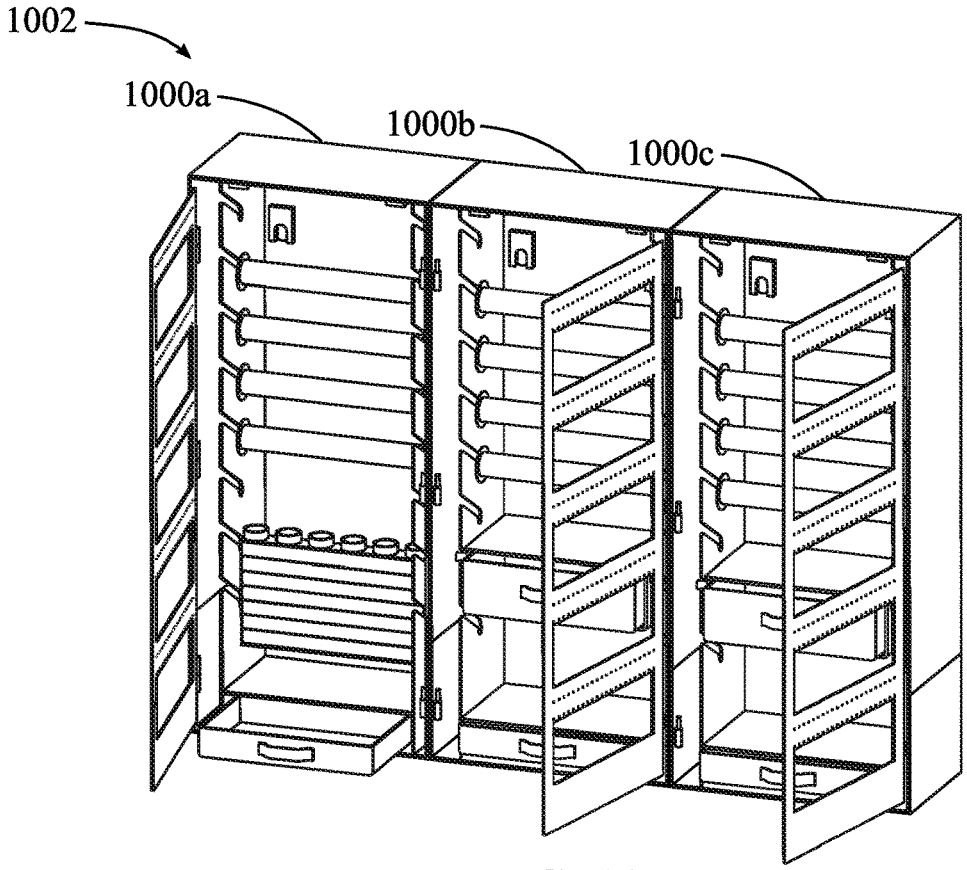
FIG. 11B depicts a perspective front view of the three example storage base units of FIG. 11A abutted against each other.

FIG. 11A depicts a perspective front view of three example storage base units 1000*a*, 1000*b* and 1000*c* positioned in a horizontal arrangement (or a one-by-three, width×height arrangement) wherein for illustration purposes base units 1000*a*, 1000*b* and 1000*c* are separated from each other. FIG. 11B depicts a perspective front view of the three example storage base units 1000*a*, 1000*b* and 1000*c* of FIG. 11A positioned in a one-by-three, width×height arrangement, wherein base units 1000*a*, 1000*b* and 1000*c* are abutted against each other, as they may be arranged in an installation of a storage apparatus 1002 comprising three base units arranged in a horizontal orientation.

Figure 11C:
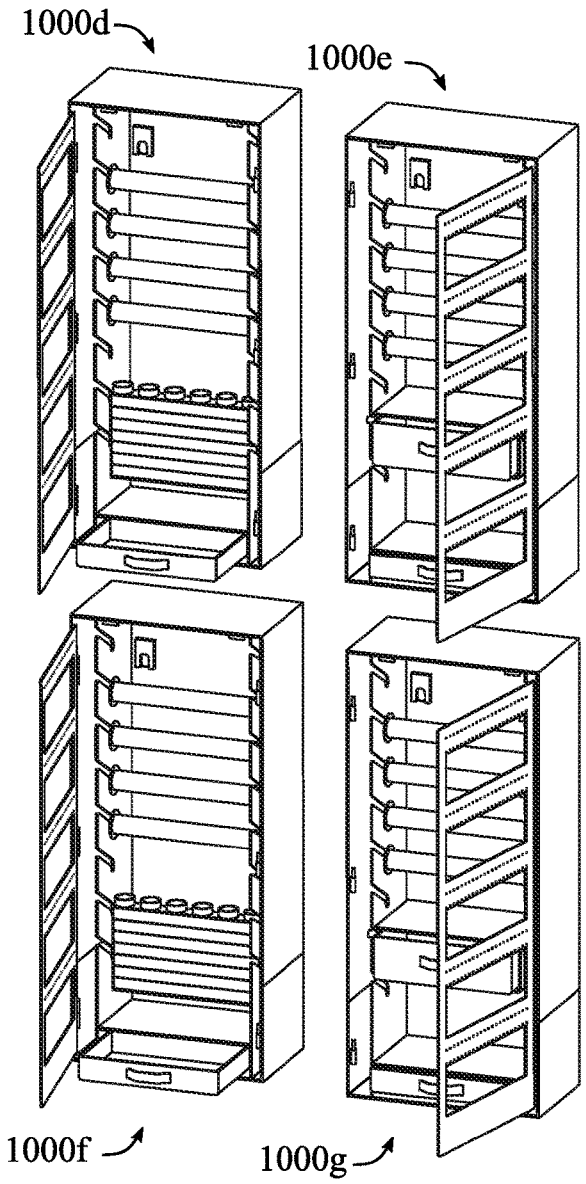
FIG. 11C depicts a perspective front view of four example storage base units positioned in a two-by-two arrangement and separated from each other.
Figure 11D:
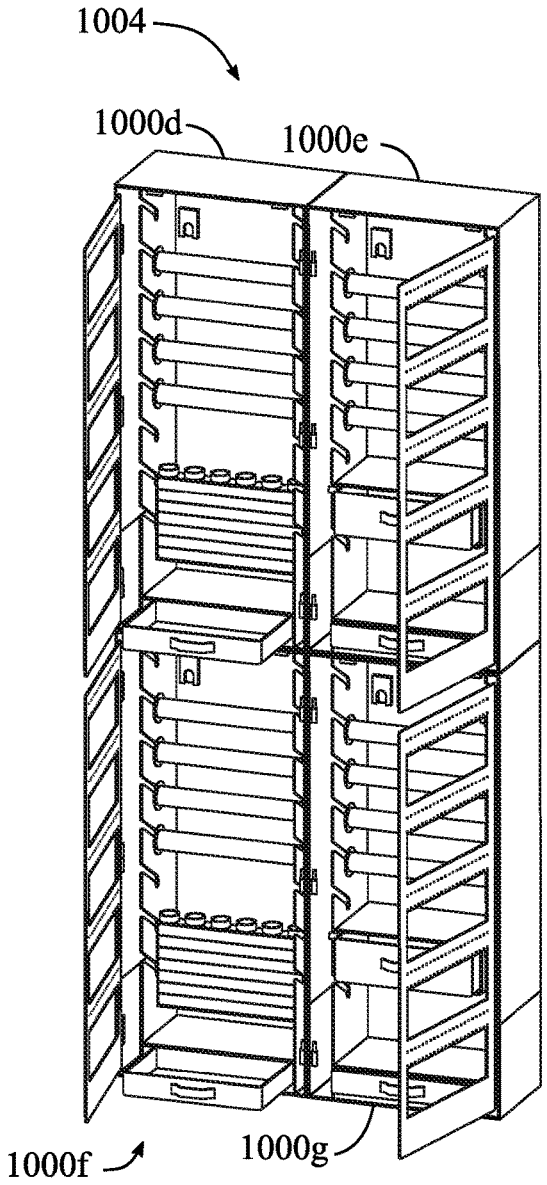
FIG. 11D depicts a perspective front view of the four example storage base units of FIG. 11C abutted against each other.

FIG. 11C depicts a perspective front view of four example storage base units 1000*d*, 1000*e*, 1000*f* and 1000*g* positioned in a two-by-two, width×height arrangement, wherein for illustration purposes base units 1000*d*, 1000*e*, 1000*f* and 1000*g* are separated from each other. FIG. 11D depicts a perspective front view of the four example storage base units 1000*d*, 1000*e*, 1000*f* and 1000*g* of FIG. 11C positioned in a two-by-two, width×height arrangement, wherein base units 1000*d*, 1000*e*, 1000*f* and 1000*g* are abutted against each other, as they may be arranged in an installation of a storage apparatus 1004 comprising four base units arranged in a two-by-two orientation.

Figure 12:
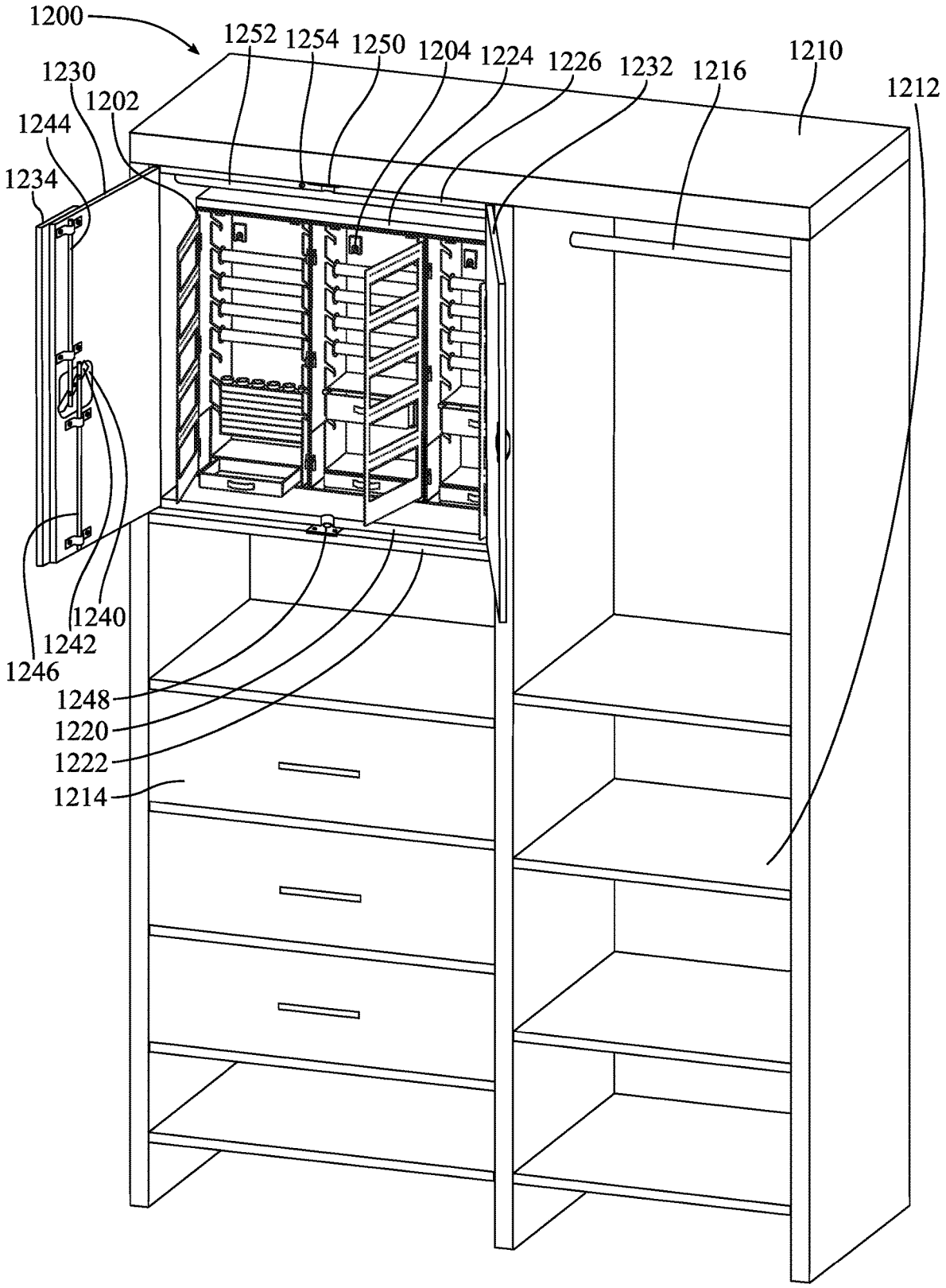
FIG. 12 depicts a perspective front view of an example implementation of furniture comprising a storage apparatus.

FIG. 12 depicts a perspective front view of an example implementation of furniture 1200 comprising a storage apparatus 1202. Furniture 1200 may be closet furniture, bedroom furniture and the like. In the example implementation of FIG. 12, furniture 1200 may comprise a frame 1210, shelves, such as shelf 1212, drawers, such as drawer 1214, one or more clothes rod hangers 1216, and the like, in addition to a storage apparatus 1202 feature mounted therein, such as a three base unit storage apparatus 1202, such as may be the same or similar to the storage apparatus 1002 of FIG. 11B. In some implementations, storage apparatus 1202 may be secured within furniture 1200 with fasteners, such as screw fastener 1204 passing through a mounting hole of storage apparatus 1202 and into furniture frame 1210, and may be situated within frame 1210 comprising a back wall, a left sidewall and a center wall and lower support wall 1220 and upper support wall 1224, wherein doors 1230 and 1232 comprised by furniture 1200 may be closed and, in some implementations be locked to restrict access to storage apparatus 1202. In some implementations, a lock unit 1240 may comprise a rotating arm, which when unlocked may rotate to extend or retract an upper bolt 1244 and a lower bolt 1246, such that upper bolt 1244 and lower bolt 1246 may pass into and out of an upper bolt plate 1250 and a lower bolt plate 1248, respectively. In some implementations, upper bolt plate 1250 may be secured to the top of frame 1210 and lower bolt plate 1248 may be secured to bottom support wall 1222. In operation, in some implementations, right door 1232 may be closed against upper support wall 1224 and lower support wall 1220, and left door 1230 may be closed against upper support wall 1224 and lower support wall 1220, wherein left door 1230 comprises a lapping member 1234 which laps right door 1232, and when closed against right door 1232 prevents an opening thereof. Thus, when furniture 1200 is in a state where doors 1230 and 1232 are so closed, and arm 1242 of lock 1240 is rotated such that bolts 1244 and 1246 are extended into plate 1250 secured to frame 1210 and plate 1248 secured to bottom support wall 1222, respectively, and lock 1240 is locked, both doors 1230 and 1232 are secured in a closed orientation against support walls 1220 and 1224 and as such, access to storage apparatus 1202 is dependent on the state of lock 1240. In some implementations, furniture 1200 may comprise a light 1252 and door jamb switch 1254, which may activate light 1252 when doors 1230 and 1232 are opened and deactivate light 1252 when doors 1230 and 1232 are closed. Many other implementations of furniture comprising a storage apparatus of the present disclosure are possible, including various types of locking and securing arrangements (types of locks, doors, etc.), lighting arrangements (light configured inside storage apparatus, outside of storage apparatus, etc.), numbers of base units, types of furniture, furniture configurations, etc.

Many other implementations of storage modules are possible that fall within the scope of the appended claims. For example, an extended length/height ring holder comprising additional slots for ring bands than that disclosed earlier herein may be implemented and thereby provide storage for larger ring collections than may be storable on the earlier disclosed example ring holders. Or a watch holder may be implemented, wherein an example implementation of a watch holder may be similar to a jewelry bar that further comprises a foam wrapping of the elongated cylinder, wherein the foam may be covered in velvet, such that the overall diameter is suitable for attaching a watch band. Or a dowel of a diameter of a mounting rod and a length to mount in both slots of a pair of slots may be implemented to provide another form of storage module. Or a padded panel having upper and lower mounting rods similar to a ring holder may be implemented to provide another form of storage module. In some implementations, a specification for storage modules may be published, such that various third party designers and third party manufacturers may design and manufacture storage modules of various capabilities and features that are compatible with a storage apparatus of the present disclosure.

Many other implementations of storage apparatus are possible that fall within the scope of the appended claims. In some implementations, a cabinet may be configured to serve as a safe, and such a storage apparatus may comprise a lockable door to secure items stored therein. In some implementations, one or more base storage units may be installed in a commercially available safe having a lockable door. In some implementations, storage apparatus as disclosed herein may be embellished with additional storage features. For example, a back wall of a cabinet may be configured with one or more hooks or rows of hooks for hanging items thereon. Such an arrangement may provide additional ways to store items within a storage apparatus and make more complete use of available space therein.

In some implementations, pairs of slotted walls may be free standing (separate from a cabinet) such that they may be mounted within furniture, hung from a closet door and the like. This may allow for alternative locations for storage modules and may allow for other types of items to be stored than may not be conducive to storage in a cabinet. For example, a pair of slotted walls joined by a top member and a bottom member establishing a predetermined and parallel spacing between the slotted walls, may be hangable from a closet door, and scarf holder storage modules (which may be similar to or the same as jewelry bars) may be user configured therein from which to drape and hang scarfs.

As noted earlier herein, in the present disclosure, example implementations which may be directed towards storage of items of jewelry are disclosed, however a disclosure of a particular type of item, such a jewelry, is not intended to be restrictive or limiting, but is intended to be illustrative of the novel user configurable modular storage apparatus of the present disclosure from which those skilled in the art shall appreciate various novel approaches and features developed by the inventor. As such, those having skill in the art and having the benefit of the present disclosure will appreciate utility of the present disclosure in applications other than storage of items of jewelry.

A number of implementations of a user configurable modular storage apparatus have been described. Various modifications may be made without departing from the spirit and scope of the disclosed user configurable modular storage apparatus.

The present disclosure is not to be limited in terms of the particular implementations described in this application, which are intended as illustrations of various aspects. Moreover, the various disclosed implementations can be interchangeably used with each other, unless otherwise noted. Many modifications and variations can be made without departing from its spirit and scope, as will be apparent to those skilled in the art. Functionally equivalent methods and apparatuses within the scope of the disclosure, in addition to those enumerated herein will be apparent to those skilled in the art from the foregoing descriptions. Such modifications and variations are intended to fall within the scope of the appended claims. It is also to be understood that the terminology used herein is for the purpose of describing particular implementations only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

A number of implementations of the user configurable modular storage apparatus have been described. Various modifications may be made without departing from the spirit and scope of the following claims.

What is claimed is:

1. A storage apparatus, comprising:

a cabinet comprising a side wall and a back wall, wherein the side wall and the back wall form an interior portion of the cabinet, and the side wall forms an opening through which the interior portion is accessible;

a storage module comprising a left mounting rod and a right mounting rod, wherein the storage module is insertable into the interior portion through the opening;

a pair of slotted walls comprising a left slotted wall and a right slotted wall, wherein:

both said slotted walls are vertically oriented and comprise a slotted wall face having a plurality of slots, wherein each slot of the plurality of slots extends from a location at or near a front of its respective slotted wall and towards a back of its respective slotted wall, and each said slot has at least one said slot above it on its respective slotted wall face or at least one said slot below it on its respective slotted wall face;

both said slotted wall faces of the pair of slotted walls are directed towards each other within the interior portion;

one said slot of the left slotted wall and one said slot of the right slotted wall are directed towards each other and form a pair of slots comprising a left slot and a right slot; and the left slot is configured to receive the left mounting rod and the right slot is configured to receive the right mounting rod, thereby enabling a user mounting and unmounting of the storage module to the pair of slots of the pair of slotted walls;

two panel hinge mount components disposed on a vertical portion of the side wall proximate to the opening; and a panel comprising two panel hinge components, wherein:

the two panel hinge mount components are configured to receive the two panel hinge components, thereby enabling a user mounting and unmounting of the panel to the storage apparatus; and the panel further comprises a bezel having a first bezel component and a second bezel component configured to be mated together, wherein:

the first bezel component and the second bezel component are substantially similar or identical;

the first bezel component comprises a first mating side comprising first mating features of the first bezel component and second mating features of the first bezel component; and the second bezel component comprises a second mating side comprising first mating features of the second bezel component and second mating features of the second bezel component, wherein when the first mating side and second mating side are directed towards each other, and the first bezel component and the second bezel component are rotated 180 degrees respective to each other, the first mating features of the first bezel component align with the second mating features of the second bezel component, and the first mating features of the second bezel component align with the second mating features of the first bezel component, thereby enabling a mating of the first bezel component to the second bezel component.

2. The storage apparatus of claim 1, wherein the storage module is a jewelry bar.

3. The storage apparatus of claim 1, wherein:

the storage module is a first storage module, wherein the left mounting rod is a first left mounting rod and the right mounting rod is a first right mounting rod;

the left slot is a first left slot;

the right slot is a first right slot; and the pair of slots is a first pair of slots, the storage apparatus further comprising:

a second storage module comprising a second left mounting rod and a second right mounting rod, wherein the second storage module is insertable into the interior portion through the opening;

a second left slot of the left slotted wall;

a second right slot of the right slotted wall, wherein the second left slot and the second right slot are directed towards each other and form a second pair of slots; and the second left slot is configured to receive the second left mounting rod and the second right slot is configured to receive the second right mounting rod, thereby enabling a user mounting and unmounting of the second storage module to the pair of slotted walls.

4. The storage apparatus of claim 1, wherein:

the left mounting rod is a left rear mounting rod;

the right mounting rod is a right rear mounting rod;

the storage module further comprises a left forward mounting rod and a right forward mounting rod, wherein the left forward mounting rod and the right forward mounting rod are configured at locations on the storage module that are forward to the locations of the left rear mounting rod and the left rear mounting rod on the storage module; and the left slot is further configured to receive the left forward mounting rod and the left rear mounting rod, and the right slot is further configured to receive the right forward mounting rod and the right rear mounting rod, thereby enabling a user mounting and unmounting of the storage module to the pair of slots of the pair of slotted walls, wherein, when mounted, each slot of the pair of slots engages one said forward mounting rod and one said rear mounting rod of the storage module, and a rotation of the storage module about an axis normal to both slotted wall faces is limited.

5. The storage apparatus of claim 4, wherein the storage module is a drawer assembly.

6. The storage apparatus of claim 1, wherein:

the left mounting rod is a left upper mounting rod;

the right mounting rod is a right upper mounting rod;

the storage module further comprises a left lower mounting rod and a right lower mounting rod, wherein the left lower mounting rod and the right lower mounting rod are configured at locations on the storage module that are below the locations of the left upper mounting rod and the right upper mounting rod on the storage module;

the left slot is a left upper slot;

the right slot is a right upper slot; and the pair of slots is an upper pair of slots, wherein the pair of slotted walls further comprises:

a left lower slot of the left slotted wall;

a right lower slot of the right slotted wall, wherein the left lower slot and the right lower slot are directed towards each other and form a lower pair of slots; and the left lower slot is configured to receive the left lower mounting rod and the right lower slot is configured to receive the right lower mounting rod, thereby enabling a user mounting and unmounting of the storage module to the upper pair of slots and the lower pair of slots of the pair of slotted walls, wherein, when mounted, each slot of the upper pair of slots and each slot of the lower pair of slots engages a mounting rod of the storage module, and a rotation of the storage module about an axis normal to both slotted wall faces is limited.

7. The storage apparatus of claim 6, wherein the storage module is a ring holder.

8. The storage apparatus of claim 1, wherein the panel comprises foam configured to receive items pinned thereto.

9. The storage apparatus of claim 1, wherein the panel comprises a plurality of pendant hangers configured to receive pendants attached thereto.

10. The storage apparatus of claim 1, wherein the panel comprises a mirror.

11. The storage apparatus of claim 1, wherein the panel further comprises a plurality of holes configured to receive an attachment of an earring.

12. The storage apparatus of claim 1, wherein the panel comprises a plurality of eyeglasses holders configured to receive eyeglasses or sunglasses.

13. The storage apparatus of claim 1, wherein:

the first bezel component further comprises a first panel hinge component; and the second bezel component further comprises a second panel hinge component, wherein upon the mating of the first bezel component to the second bezel component the two panel hinge components receivable by the two panel hinge mount components comprise the first panel hinge component and the second panel hinge component.

14. The storage apparatus of claim 1, wherein:

the left slot comprises a left pocket configured to receive the left mounting rod, the left pocket having a left front surface; and the right slot comprises a right pocket configured to receive the right mounting rod, the right pocket having a right front surface, wherein when the left mounting rod is received in the left pocket and the right mounting rod is received in the right pocket, the left front surface and the right front surface prevent an unmounting of the storage module when a horizontal outward force is applied to the storage module, unless the horizontal outward force is accompanied by a vertical upward force sufficient to lift the storage module and the left mounting rod and the right mounting rod from the left pocket and the right pocket, respectively.

15. The storage apparatus of claim 1, wherein the left slotted wall is comprised by a left vertical portion of the side wall and the plurality of slots of the slotted wall face of the left slotted wall are formed by slots recessed into the side wall.

16. A storage apparatus, comprising:

a first base unit comprising:

a first cabinet comprising a first side wall and a first back wall, wherein the first side wall and the first back wall form a first interior portion of the first cabinet, and the first side wall forms a first opening through which the first interior portion is accessible;

a first storage module comprising a first left mounting rod and a first right mounting rod, wherein the first storage module is insertable into the first interior portion through the first opening; and a first pair of slotted walls comprising a first left slotted wall and a first right slotted wall, wherein:

both the first left slotted wall and first right slotted wall are vertically oriented and comprise a slotted wall face having a plurality of slots, wherein each slot of the plurality of slots extends from a location at or near a front of its respective slotted wall and towards a back of its respective slotted wall, and each said slot has at least one said slot above it on its respective slotted wall face or at least one said slot below it on its respective slotted wall face;

both said slotted wall faces of the first pair of slotted walls are directed towards each other within the first interior portion;

a first said slot of the first left slotted wall and a first said slot of the first right slotted wall are directed towards each other and form a first pair of slots comprising a first left slot and a first right slot; and the first left slot is configured to receive the first left mounting rod and the first right slot is configured to receive the first right mounting rod, thereby enabling a user mounting and unmounting of the first storage module to the first pair of slots of the first pair of slotted walls;

a second base unit comprising:

a second cabinet comprising a second side wall and a second back wall, wherein the second side wall and the second back wall form a second interior portion of the second cabinet, and the second side wall forms a second opening through which the second interior portion is accessible;

a second storage module comprising a second left mounting rod and a second right mounting rod, wherein the second storage module is insertable into the second interior portion through the second opening;

a second pair of slotted walls comprising a second left slotted wall and a second right slotted wall, wherein:

both the second left slotted wall and the second right slotted wall are vertically oriented and comprise a slotted wall face having a plurality of slots, wherein each slot of the plurality of slots extends from a location at or near the front of its respective slotted wall and towards the back of its respective slotted wall, and each said slot has at least one said slot above it on its respective slotted wall face or at least one said slot below it on its respective slotted wall face;

both said slotted wall faces of the second pair of slotted walls are directed towards each other within the second interior portion;

a second said slot of the second left slotted wall and a second said slot of the second right slotted wall are directed towards each other and form a second pair of slots comprising a second left slot and a second right slot; and the second left slot is configured to receive the second left mounting rod and the second right slot is configured to receive the second right mounting rod, thereby enabling a user mounting and unmounting of the second storage module to the second pair of slots of the second pair of slotted walls;

two panel hinge mount components disposed on a vertical portion of the first side wall proximate to the first opening; and a panel comprising two panel hinge components, wherein:

the two panel hinge mount components are configured to receive the two panel hinge components, thereby enabling a user mounting and unmounting of the panel to the storage apparatus; and the panel further comprises a bezel having a first bezel component and a second bezel component configured to be mated together, wherein:

the first bezel component and the second bezel component are substantially similar or identical;

the first bezel component comprises a first mating side comprising first mating features of the first bezel component and second mating features of the first bezel component; and the second bezel component comprises a second mating side comprising first mating features of the second bezel component and second mating features of the second bezel component, wherein when the first mating side and second mating side are directed towards each other, and the first bezel component and the second bezel component are rotated 180 degrees respective to each other, the first mating features of the first bezel component align with the second mating features of the second bezel component, and the first mating features of the second bezel component align with the second mating features of the first bezel component, thereby enabling a mating of the first bezel component to the second bezel component.

17. The storage apparatus of claim 16, wherein at least one of the first storage module or the second storage module is a jewelry bar.

18. The storage apparatus of claim 16, wherein:

the first left mounting rod is a left rear mounting rod;

the first right mounting rod is a right rear mounting rod;

the first storage module further comprises a left forward mounting rod and a right forward mounting rod, wherein the left forward mounting rod and the right forward mounting rod are configured at locations on the first storage module that are forward to the locations of the left rear mounting rod and the left rear mounting rod on the first storage module; and the first left slot is further configured to receive the left forward mounting rod and the left rear mounting rod, and the first right slot is further configured to receive the right forward mounting rod and the left rear mounting rod, thereby enabling a user mounting and unmounting of the first storage module to the first pair of slots of the first pair of slotted walls, wherein, when mounted, each slot of the first pair of slots engages one said forward mounting rod and one said rear mounting rod of the first storage module, and a rotation of the first storage module about an axis normal to both slotted wall faces of the first pair of slotted walls is limited.

19. The storage apparatus of claim 18, wherein the first storage module is a drawer assembly.

20. The storage apparatus of claim 16, wherein:

the first left mounting rod is a left upper mounting rod;

the first right mounting rod is a right upper mounting rod;

the first storage module further comprises a left lower mounting rod and a right lower mounting rod, wherein the left lower mounting rod and the right lower mounting rod are configured at locations on the first storage module that are below the locations of the left upper mounting rod and the right upper mounting rod on the first storage module;

the first left slot of the first left slotted wall is a left upper slot;

the first right slot of the first right slotted wall is a right upper slot; and the first pair of slots is an upper pair of slots, wherein the first pair of slotted walls further comprises:

a left lower slot of the first left slotted wall;

a right lower slot of first right slotted wall, wherein the left lower slot and the right lower slot are directed towards each other and form a lower pair of slots, wherein the lower pair of slots is configured at a location on the first pair of slotted walls below a location of the upper pair of slots on the first pair of slotted walls; and the left lower slot is configured to receive the left lower mounting rod and the right lower slot is configured to receive the right lower mounting rod, thereby enabling a user mounting and unmounting of the first storage module to the upper pair of slots and the lower pair of slots of the first pair of slotted walls, wherein, when mounted, each slot of the upper pair of slots and each slot of the lower pair of slots engages a mounting rod of the first storage module, and a rotation of the first storage module about an axis normal to both slotted wall faces of the first pair or slotted walls is limited.

21. The storage apparatus of claim 20, wherein the first storage module is a ring holder.

22. The storage apparatus of claim 16, wherein the storage apparatus is a storage feature mounted in furniture, and access to the storage apparatus is dependent on a state of a lock comprised by the furniture.

23. The storage apparatus of claim 16, wherein the first left slotted wall is comprised by a left vertical portion of the first side wall and the plurality of slots of the slotted wall face of the first left slotted wall are formed by slots recessed into the first side wall.

24. A storage apparatus adaptable to an article of furniture, wherein, the storage apparatus comprises:

a storage module comprising a left mounting rod and a right mounting rod;

a pair of slotted walls mountable to the article of furniture and comprising a left slotted wall and a right slotted wall, wherein:

both said slotted walls are vertically oriented and comprise a slotted wall face having a plurality of slots, wherein each slot of the plurality of slots extends from a location at or near a front of its respective slotted wall and towards a back of its respective slotted wall, and each said slot has at least one said slot above it on its respective slotted wall face or at least one said slot below it on its respective slotted wall face;

both said slotted wall faces of the pair of slotted walls are directed towards each other;

ones said slot of the left slotted wall and one said slot of the right slotted wall are directed towards each other and form a pair of slots comprising a left slot and a right slot; and the left slot is configured to receive the left mounting rod and the right slot is configured to receive the right mounting rod, thereby enabling a user mounting and unmounting of the storage module to the pair of slots of the pair of slotted walls;

a side wall proximate to said slotted walls;

two panel hinge mount components disposed on a vertical portion of the side wall proximate to the opening; and a panel comprising two panel hinge components, wherein:

the two panel hinge mount components are configured to receive the two panel hinge components, thereby enabling a user mounting and unmounting of the panel to the storage apparatus; and the panel further comprises a bezel having a first bezel component and a second bezel component configured to be mated together, wherein:

the first bezel component and the second bezel component are substantially similar or identical;

the first bezel component comprises a first mating side comprising first mating features of the first bezel component and second mating features of the first bezel component; and the second bezel component comprises a second mating side comprising first mating features of the second bezel component and second mating features of the second bezel component, wherein when the first mating side and second mating side are directed towards each other, and the first bezel component and the second bezel component are rotated 180 degrees respective to each other, the first mating features of the first bezel component align with the second mating features of the second bezel component, and the first mating features of the second bezel component align with the second mating features of the first bezel component, thereby enabling a mating of the first bezel component to the second bezel component.

25. The storage apparatus of claim 24, wherein the storage module is a jewelry bar.

26. The storage apparatus of claim 24, wherein:

the storage module is a first storage module, wherein the left mounting rod is a first left mounting rod and the right mounting rod is a first right mounting rod;

the left slot is a first left slot;

the right slot is a first right slot; and the pair of slots is a first pair of slots, the storage apparatus further comprising:

a second storage module comprising a second left mounting rod and a second right mounting rod;

a second left slot of the left slotted wall;

a second right slot of the right slotted wall, wherein the second left slot and the second right slot are directed towards each other and form a second pair of slots; and the second left slot is configured to receive the second left mounting rod and the second right slot is configured to receive the second right mounting rod, thereby enabling a user mounting and unmounting of the second storage module to the pair of slotted walls.

27. The storage apparatus of claim 24, wherein:

the left mounting rod is a left rear mounting rod;

the right mounting rod is a right rear mounting rod;

the storage module further comprises a left forward mounting rod and a right forward mounting rod, wherein the left forward mounting rod and the right forward mounting rod are configured at locations on the storage module that are forward to the locations of the left rear mounting rod and the left rear mounting rod on the storage module; and the left slot is further configured to receive the left forward mounting rod and the left rear mounting rod, and the right slot is further configured to receive the right forward mounting rod and the right rear mounting rod, thereby enabling a user mounting and unmounting of the storage module to the pair of slots of the pair of slotted walls, wherein, when mounted, each slot of the pair of slots engages one said forward mounting rod and one said rear mounting rod of the storage module, and a rotation of the storage module about an axis normal to both slotted wall faces is limited.

28. The storage apparatus of claim 27, wherein the storage module is a drawer assembly.

29. The storage apparatus of claim 24, wherein:

the left mounting rod is a left upper mounting rod;

the right mounting rod is a right upper mounting rod;

the storage module further comprises a left lower mounting rod and a right lower mounting rod, wherein the left lower mounting rod and the right lower mounting rod are configured at locations on the storage module that are below the locations of the left upper mounting rod and the right upper mounting rod on the storage module;

the left slot is a left upper slot;

the right slot is a right upper slot; and the pair of slots is an upper pair of slots, wherein the pair of slotted walls further comprises:

a left lower slot of the left slotted wall;

a right lower slot of the right slotted wall, wherein the left lower slot and the right lower slot are directed towards each other and form a lower pair of slots; and the left lower slot is configured to receive the left lower mounting rod and the right lower slot is configured to receive the right lower mounting rod, thereby enabling a user mounting and unmounting of the storage module to the upper pair of slots and the lower pair of slots of the pair of slotted walls, wherein, when mounted, each slot of the upper pair of slots and each slot of the lower pair of slots engages a mounting rod of the storage module, and a rotation of the storage module about an axis normal to both slotted wall faces is limited.

30. The storage apparatus of claim 29, wherein the storage module is a ring holder.

31. The storage apparatus of claim 24, wherein:

the left slot comprises a left pocket configured to receive the left mounting rod, the left pocket having a left front surface; and the right slot comprises a right pocket configured to receive the right mounting rod, the right pocket having a right front surface, wherein when the left mounting rod is received in the left pocket and the right mounting rod is received in the right pocket, the left front surface and the right front surface prevent an unmounting of the storage module when a horizontal outward force is applied to the storage module, unless the horizontal outward force is accompanied by a vertical upward force sufficient to lift the storage module and the left mounting rod and the right mounting rod from the left pocket and the right pocket, respectively.

* * * * *